US005501946A

United States Patent [19]

Takagi et al.

[11] Patent Number: 5,501,946

[45] Date of Patent: Mar. 26, 1996

[54] PRE-FOGGED DIRECT REVERSAL SILVER HALIDE PHOTOGRAPHIC MATERIAL

[75] Inventors: Yoshihiro Takagi; Yoshio Inagaki, both of Kanagawa, Japan

[73] Assignee: Fuji Photo Film Co., Ltd., Kanagawa, Japan

[21] Appl. No.: 281,139

[22] Filed: Jul. 27, 1994

Related U.S. Application Data

[63] Continuation of Ser. No. 98,728, Jul. 29, 1993, abandoned.

[30] Foreign Application Priority Data

| | | | |
|---|---|---|---|
| Jul. 29, 1992 | [JP] | Japan | 4-220906 |
| Jul. 30, 1992 | [JP] | Japan | 4-203929 |
| Jul. 31, 1992 | [JP] | Japan | 4-205737 |
| Aug. 10, 1992 | [JP] | Japan | 4-212670 |
| Aug. 10, 1992 | [JP] | Japan | 4-212671 |
| Aug. 10, 1992 | [JP] | Japan | 4-232696 |
| Aug. 11, 1992 | [JP] | Japan | 4-214110 |

[51] Int. Cl.[6] ..... G03C 1/12; G03C 1/485

[52] U.S. Cl. ..... 430/573; 430/578; 430/587; 430/596

[58] Field of Search ..... 430/587, 944, 430/573, 578, 598, 596

[56] References Cited

U.S. PATENT DOCUMENTS

| | | | |
|---|---|---|---|
| 3,650,758 | 3/1972 | Gilman, Jr. | 430/596 |
| 3,936,308 | 2/1976 | Gaugh et al. | 430/591 |
| 4,376,817 | 3/1983 | Steiger et al. | 430/596 |
| 4,599,300 | 7/1986 | Tanaka et al. | 430/596 |
| 4,614,801 | 9/1986 | Wheeler | 430/596 |
| 5,183,733 | 2/1993 | Inagaki et al. | 430/587 |

*Primary Examiner*—Thorl Chea
*Attorney, Agent, or Firm*—Sughrue, Mion, Zinn, Macpeak & Seas

[57] ABSTRACT

A pre-fogged direct reversal silver halide photographic material comprises on a support at least an emulsion layer comprising a previously fogged silver halide emulsion for forming a direct positive image. The emulsion layer comprises at least one compound represented by one of formulae (I) to wherein the variables are as defined in the specification:

(I)

-continued (II)

(III)

(IV)

(V)

(VI)

(VII)

(VIII)

5 Claims, No Drawings

PRE-FOGGED DIRECT REVERSAL SILVER HALIDE PHOTOGRAPHIC MATERIAL

This is a Continuation of application Ser. No. 08/098,728 filed Jul. 29, 1993, now abandoned.

FIELD OF THE INVENTION

The present invention relates to a red-sensitive and infrared-sensitive pre-fogged direct reversal silver halide photographic material. More particularly, the present invention relates to a pre-fogged direct reversal silver halide photographic material for use in a system in which exposure is effected by laser or another high intensity light source.

BACKGROUND OF THE INVENTION

A silver halide used for a direct positive silver halide photographic material may be previously fogged. Utilizing solarization or Heschel effect, this direct positive silver halide photographic material undergoes exposure to destroy fogged nuclei to provide a positive image. Examples of such a direct positive photographic light-sensitive material include a photographic light-sensitive material for picture taking comprising desenstizing dyes as disclosed in JP-B-50-3938 and JP-B-50-3937 (The term "JP-B" as used herein means an "examined Japanese patent publication") and a daylight photographic light-sensitive material for daylight use as disclosed in JP-A-62-234156 and JP-A-61-251843 (the term "JP-A" as used herein means an "unexamined published Japanese patent application" ). These photographic light-sensitive material systems are mainly adapted for low intensity exposure for 1 second to about 100 seconds. These photographic light-sensitive materials are disadvantageous in that when exposed to a high intensity light such as a laser, they cannot undergo sufficient reversion and thus exhibit a high Dmin value or that they exhibit insufficient sensitivity to red light or infrared light.

Various desensitizing dyes are disclosed in U.S. Pat. Nos. 4,007,170, 3,743,640, 3,615,639, 3,579,346, 3,723,422, 35,586,671, 350,570, 3,941,602, and 3,846,137, 3,141,602, 3,816,141, 3,764,338, 3,887,380, and 3,970,461, German Patents 1,153,246, and 2,121,783, JP-B-55-47373, and JP-B-52-6617, and JP-A-63-18343. These densitizing dyes have been developed for low intensity exposure. None of their combinations with emulsions described in these disclosures provide excellent reversibility upon high intensity exposure.

When rendered red-sensitive or infrared-sensitive, densensitizing dyes are subject to a drop in the bleachability of the Ag nucleus in dye positive holes that causes a deterioration of their reversibility. In the case of high intensity exposure, the positive holes move slowly, lowering the bleaching efficiency of the Ag nucleus and hence deteriorating reversibility. Accordingly, it has been desired to develop a direct reversal photographic light-sensitive material which exhibits an excellent reversibility upon high intensity exposure.

SUMMARY OF THE INVENTION

It is therefore an object of the present invention to provide a method for providing a pre-fogged direct reversal silver halide photographic material with an excellent reversibility upon exposure to a high intensity light source such as a laser for a short period of time.

It is another object of the present invention to provide a pre-fogged direct reversal silver halide photographic material sensitive to red light or infrared light.

These and other objects of the present invention will become more apparent from the following detailed description and examples.

The foregoing objects of the present invention are accomplished with a material comprising on a support at least an emulsion layer comprising a previously fogged silver halide emulsion for forming a direct positive image, wherein the emulsion layer comprises at least one compounds represented by one of the following formulae (I) to (VIII):

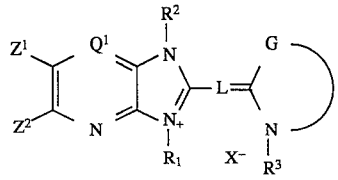

(I)

wherein $Z^1$ and $Z^2$, which may be the same or different and may be connected to each other to form a ring, each represents an alkyl group, an aryl group or an alkenyl group; $Q^1$ represents N or C—$R^6$ in which $R^6$ represents a hydrogen atom, alkyl group or aryl group; $R^1$, $R^2$ and $R^3$, which may be the same or different, each represents an alkyl group, alkenyl group or aryl group, and at least one of which may be connected to L to form a ring; $X^-$ represents an anion; G represents a group which is connected to N—$R^3$ to form a 5- or 6-membered ring; and L represents a trivalent group in which 5 or 7 methine or substituted methine groups are connected to form conjugated double bonds;

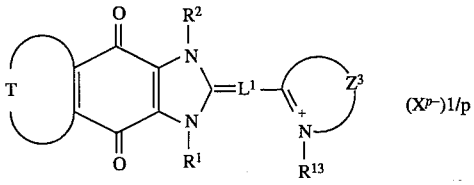

(II)

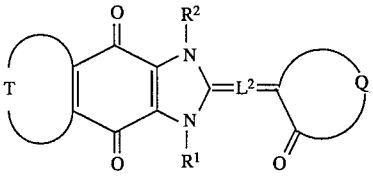

(III)

wherein T represents an atomic group necessary for the formation of a benzene ring which may contain substituents; $R^1$, $R^2$ and $R^3$ each represents an alkyl, aralkyl, phenyl or allyl group which may contain substituents; $L^1$ represents a trivalent connecting group in which 1, 3, 5 or 7 methine or substituted methine groups are connected to form conjugated double bonds; $Z^3$ represents an atomic group necessary for the formation of a 5- or 6-membered ring; X represents an anion; p represents an integer 1 or 2; $L^2$ represents a tetravalent connecting group in which 2, 4 or 6 methine or substituted methine groups are connected to form conjugated double bonds; and Q represents an atomic group necessary for the formation of a 5- or 6-membered ring;

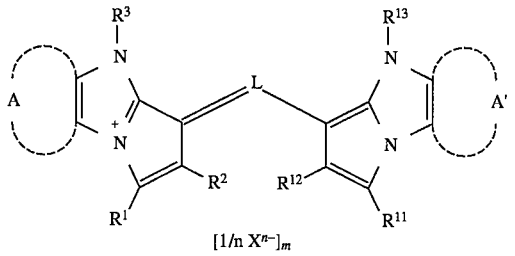

(IV)

wherein A and A' each represents an atomatic group necessary for the formation of an aromatic ring which may contain substituents; L represents a trivalent group in which 3, 5 or 7 methine or substituted methine groups are connected to form conjugated double bonds; $R^1$ $R^2$, $R^{11}$ and $R^{12}$ each represents a hydrogen atom or an alkyl, phenyl, acyl, alkoxy or 5- or 6-membered heterocyclic group which may contain substituents; $R^3$ and $R^{13}$ each represents an alkyl group which may contain substituents which may contain anions; $X^{n-}$ represents an anion; n represents an integer 1 to 3; and m represents an integer 0 or 1, with the proviso that when $R^3$ or $R^{13}$ contains groups having anions as substituents, m is 0;

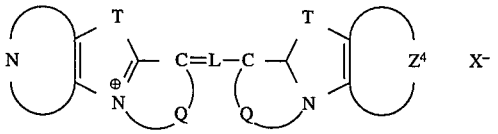

(V)

wherein $Z^4$ represents an atomic group necessary for the formation of a benzene ring, naphthalene ring or heterocyclic aromatic ring; T represents O, S, Se, N—$R^1$, $CR^2R^3$ or —$CR^4$=$CR^5$–; $R^1$, $R^2$ and $R^3$ each independently represents an alkyl group, alkenyl group or aryl group; $R^4$ and $R^5$ each independently represents a hydrogen atom, halogen atom, alkyl group, aryl group, alkoxy group, aryloxy group, carboxyl group, acyl group, acylamino group, carbamoyl group, sulfamoyl group or sulfonamido group; Q represents an atomic group which connects N to C to form a 5-, 6- or 7-membered ring; L represents a trivalent connecting group in which 5 or 7 methine or substituted methine groups are connected to form conjugated double bonds; and $X^-$ represents an anion;

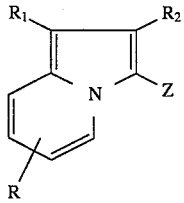

(VI)

wherein R represents a hydrogen atom, alkyl group, aryl group, alkoxy group, halogen atom or benzene ring condensed with pyridine ring; $R_1$ represents an alkyl group or aryl group; $R_2$ represents a hydrogen atom, alkyl group or aryl group; and Z represents an atomic group having nitrogen- or oxygen-containing conjugated double bonds which forms a conjugated chain with the pyrocoline nucleus;

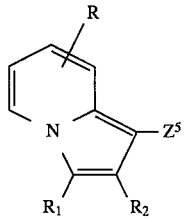

(VII)

wherein R represents a hydrogen atom, halogen atom, alkyl group, alkoxy group, aryl group or benzene ring condensed with a pyridine ring; $R_1$ and $R_2$ each independently represents a hydrogen atom, alkyl group or aryl group; $Z^5$ represents an atomic group having nitrogen- or oxygen-containing conjugated double bonds which forms a conjugated chain with the pyrocoline nucleus;

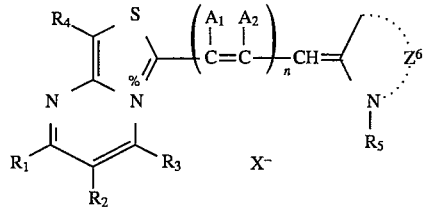

(VIII)

wherein $A_1$ and $A_2$ each independently represents a hydrogen atom or substituent; $Z^6$ represents an atomic group necessary for the formation of a 5-membered heterocyclic group; $R_1$ to $R_4$ each independently represents a hydrogen atom or a substituent; $R_5$ may represent a substituent or may form a 6-membered heterocyclic group with $Z^6$; n represents an integer 0, 1 or 2; and $X^-$ represents an anion.

DETAILED DESCRIPTION OF THE INVENTION

In the foregoing formula (I), $Z^1$ and $Z^2$ may be connected to each other to form a benzene ring, a naphthalene ring, a substituted benzene ring or a substituted naphthalene ring.

$Q^1$ represents N or C—H. The 5- or 6-membered ring formed by the connection of G to N—$R^3$ is preferably an imidazoquinoxaline ring, quinoline ring, benzothiazole ring, benzoimidazole ring or imidazoquinoline ring.

Preferred among compounds represented by formula (I) are those represented by the following general formula (Ia):

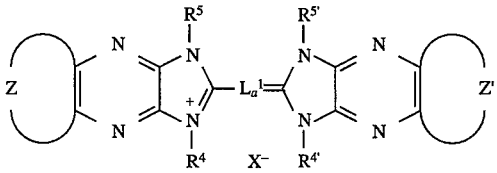

(Ia)

wherein $R^4$, $R^{4'}$, $R^5$ and $R^{5'}$, which may be the same or different, each represents an alkyl group, alkenyl group or aryl group; $La^1$ represents a trivalent group in which 5 or 7 methine or substituted methine groups are connected to form conjugated double bonds; Z and Z' each represents an atomic group necessary for the formation of an aromatic ring; and $X^-$ represents an anion.

In formula (Ia), Z, Z', $La^1$, $R^4$, $R^5$, $R^{4'}$, and $R^{5'}$ may further contain substituents.

Preferred among these substituents are those having a hydrophobicity parameter π of –1.0 to 15 as proposed by C. Hansch et al. The hydrophobicity parameter can be calculated in accordance with the following references:

1) C. Hansch et al., "J. Med.Chem.", vol. 16, page 1207 (1973)

2) C. Hansch et al., "J. Med.Chem.", vol. 20, page 304, (1977)

Preferred examples of the group represented by $R^4$, $R^{4'}$, $R^5$ $R^{5'}$ include a substituted or unsubstituted phenyl group, a substituted or unsubstituted lower alkyl group ($C_{1-8}$), and a substituted or unsubstituted lower alkenyl group ($C_{2-8}$). These substituted groups may further contain substituents having a hydrophobicity parameter π of –10 to 15 as defined above If $R^4$, $R^{4'}$, $R^5$ or $R^{5'}$ contains substituents, particularly preferred examples of these substituents include a halogen atom (e.g., F, Cl, Br, I), a substituted or unsubstituted phenyl group (e.g., phenyl, m-chlorophenyl, p-methyl-phenyl), an alkylthio group (e.g., methylthio, butyl-thio), a substituted or unsubstituted phenylthio group (e.g., phenylthio, p-chlorophenylthio , m-methylphenylthio), and an alkoxy group (e.g., ethoxy, butoxy).

Particularly preferred among groups represented by $R^4$, $R^{4'}$, $R^5$ or $R^{5'}$ are $C_{2-8}$ unsubstituted alkyl and alkenyl groups wherein $R^4$, $R^{4'}$, $R^5$ and $R^{5'}$ are most preferably the same.

Examples of the atomic group represented by Z or Z' include those necessary for the formation of a benzene ring, naphthalene or anthracene ring, preferably those necessary for the formation of a benzene ring or naphthalene These atomic groups may further contain the substituents described for $R^4$, $R^{4'}$, $R^5$ and $R^{5'}$. If Z and Z' contain substituents, particularly preferred examples of these substituents include halogen atom (e.g., F, Cl, Br, I), a substituted or unsubstituted phenyl group (e.g., methylthio, butyl-thio), a substituted or unsubstituted phenylthio group (e.g., phenylthio, p-chlorophenylthio, m-methylphenyl-thio), a substituted or unsubstituted alkyl group (e.g., methyl, trifluoromethyl, tert-amyl), a cyano group, an alkoxycarbonyl group (e.g., propoxycarbonyl, butoxycarbonyl, benzyloxycarbonyl, decyloxycarbonyl, 2-ethyl-hexyloxycarbonyl), and an alkyl or arylsulfonyl group (e.g., butanesulfonyl, phenylsulfonyl, octanesulfonyl).

Particularly preferred among the atomic groups represented by Z or Z' are those necessary for the formation of a benzene ring containing a relatively low electron-donative substituent having a Hammett's sigma constant of −0.2 to +0.7. Most preferred among these atomic groups are those necessary for the formation of a benzene ring substituted by a halogen atom such as F, Cl, Br and I.

The trivalent group represented by $L^1$ is a connecting group formed by the connection of 5 or 7 substituted or unsubstituted methine groups via conjugated double bonds. Particularly preferred examples of such a connecting group include those represented by the following formulae (a) to (g):

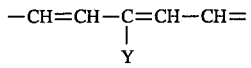
(a)

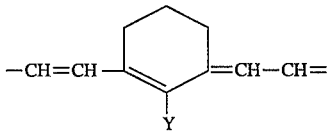
(b)

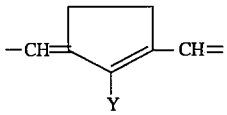
(c)

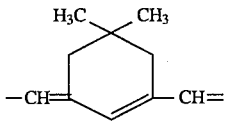
(d)

-continued

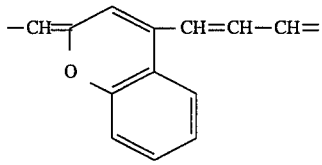
(e)

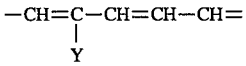
(f)

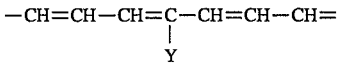
(g)

In formulae (a) to (g), Y represents a hydrogen atom or monovalent group. Preferred examples of the monovalent group represented by Y include a lower alkyl group such as a methyl group, an aralkyl group such as a substituted or unsubstituted phenyl group and benzyl group, a lower alkoxy group such as a methoxy group, a disubstituted amino group such as a dimethylamino group, diphenylamino group, methylphenylamino group, morpholino group, imidazolidino group and ethoxycarbonylpiperadino group, an alkylcarbonyloxy group such as an acetoxy group, alkylthio group such as a methylthio group, cyano group, nitro group, and a halogen atom such as F, Cl and Br.

Particularly preferred among the connecting groups represented by $La^1$ are those represented by formulae (b), (e) and (g).

The anion represented by $X^-$ is a monovalent or divalent anion for supplying negative electric charges required to neutralize the charge of the cationic moiety.

Examples of the anion represented by $X^-$ include halogen ions such as $Cl^-$, $Br^-$ and $I^-$, $SO_4^{2-}$, $HSO_4^-$, alkylsulfuric ions such as $CH_3OSO_3-$, sulfonic ions such as paratoluenesulfonic ion, naphthalene-1,5-disulfonic ion, methanesulfonic ion, trifluoromethanesulfonic ion and octanesulfonic ion, carboxylic ions such as acetic ion, p-chlorobenzoic ion, trifluoroacetic ion, oxalic ion and succinic ion, $PF_6^-$, $BF_4^-$, $ClO_4^-$, $IO_4^-$, tungstic ion, heteropolyacid ions such as tungstophosphoric ion, $H_2PO_4^-$, $NO_3^-$, and phenolate ions such as picric ion.

Preferred examples of the anion represented by $X^-$ include $Cl^-$, $Br^-$, $I^-$, $CH_3OSO_3^-$, $C_2H_5OSO_3^-$, perfluorosulfonic ions such as paratoluenesulfonic ion, p-chloro-benzenesulfonic ion, methanesulfonic ion, butanesulfonic ion, naphthalene-1,5-disulfonic ion and trifluoromethanesulfonic ion, $PF_6^-$, $BF_4^-$, and $ClO_4^-$. Particularly preferred among these anions are $I^-$, $ClO_4^-$, and paratoluenesulfonic ions.

Specific examples of dyes of formula (I) are given below, but the present invention should not be construed as being limited thereto:

I-1
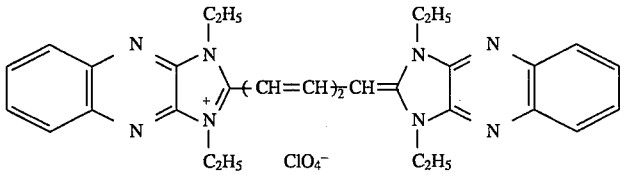
I-2
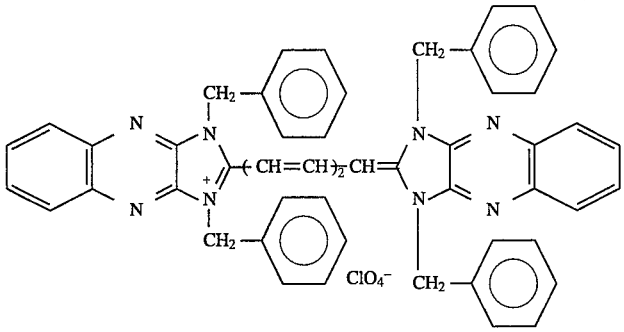
I-3
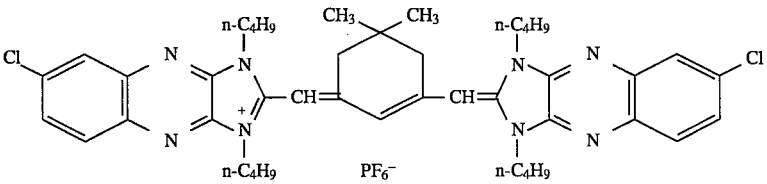
I-4
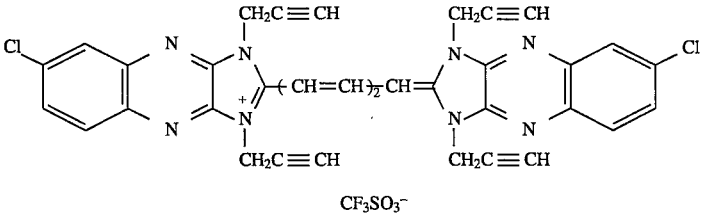
I-5
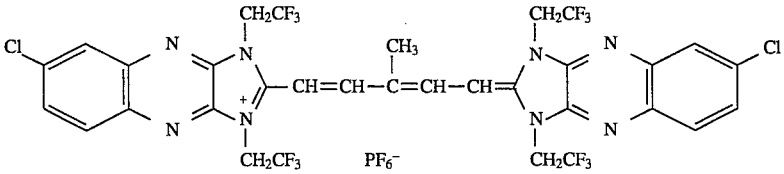
I-6
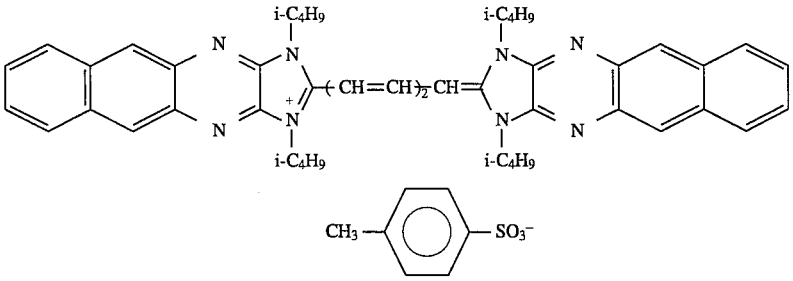
I-7
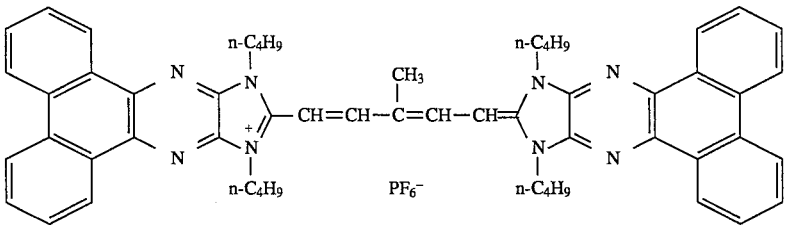

-continued
I-8
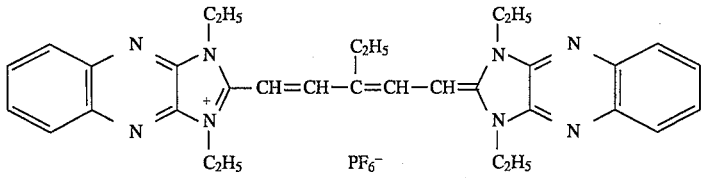
I-9
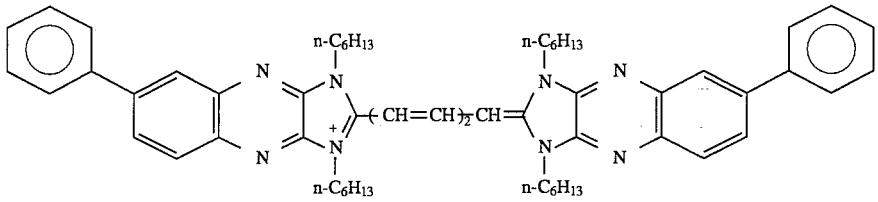
I-10
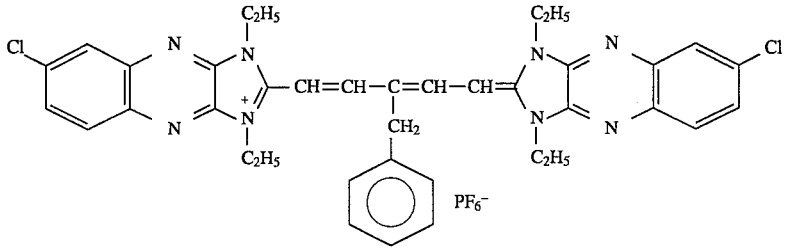
I-11
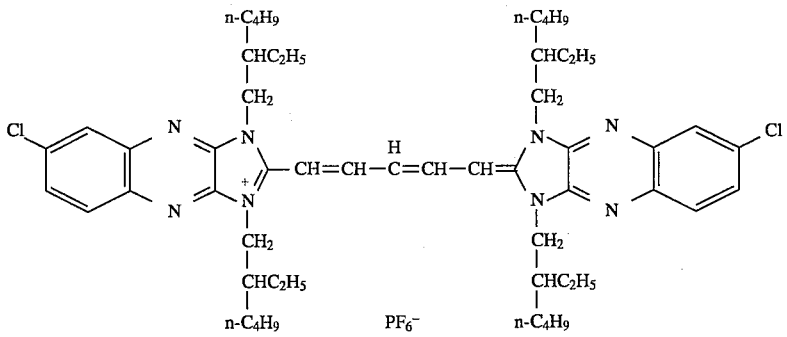
I-12
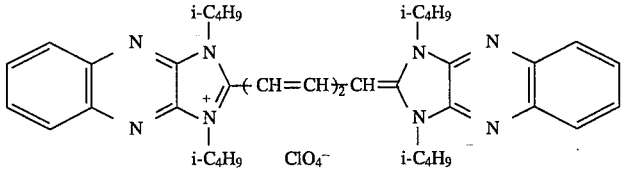
I-13
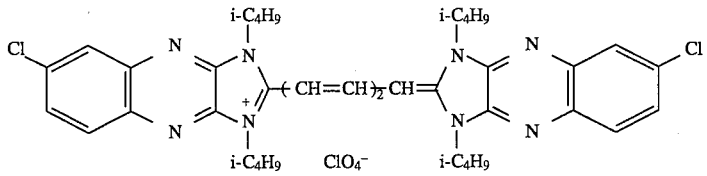
I-14
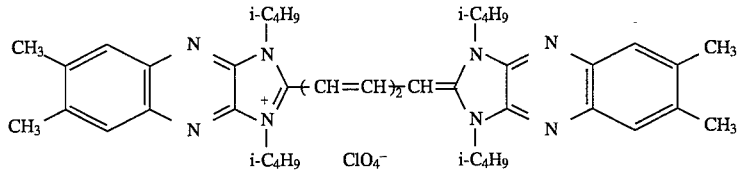
I-15
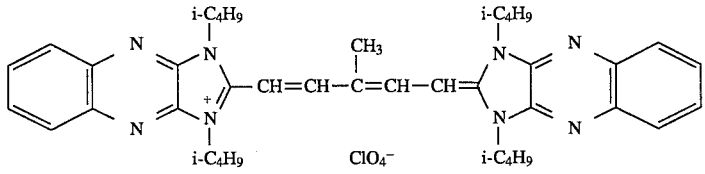

-continued
I-16
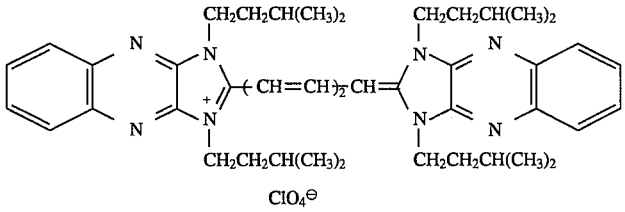
I-17
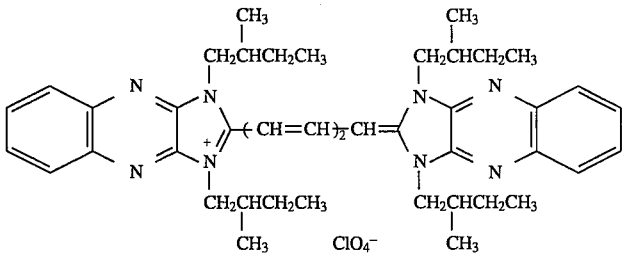
I-18
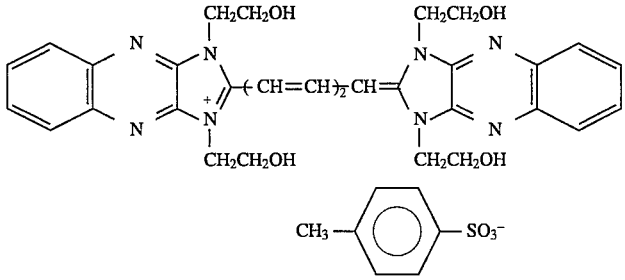
I-19
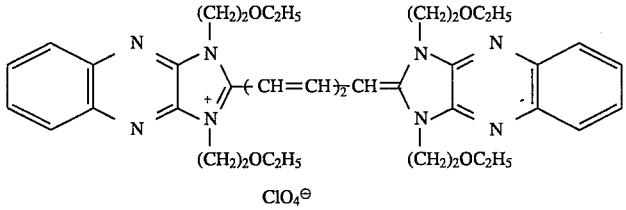
I-20
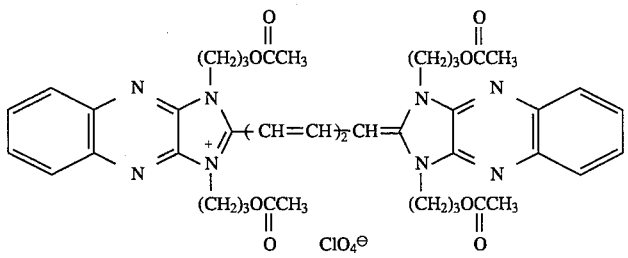
I-21
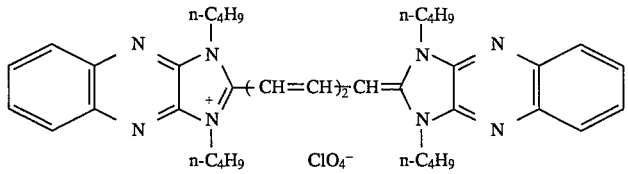
I-22
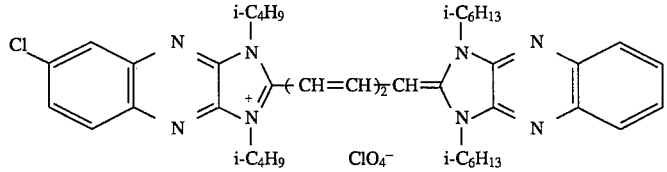

-continued
I-23
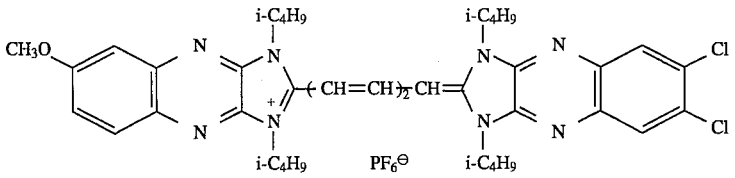
I-24
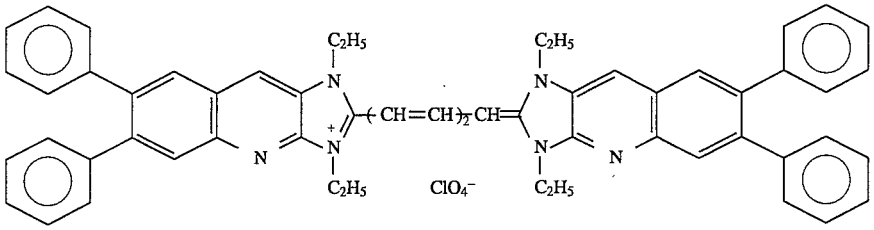
I-25
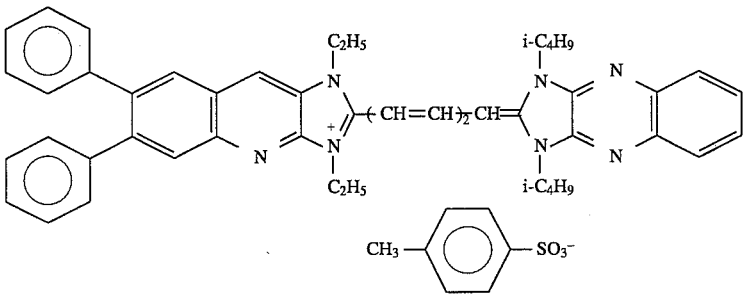
I-26
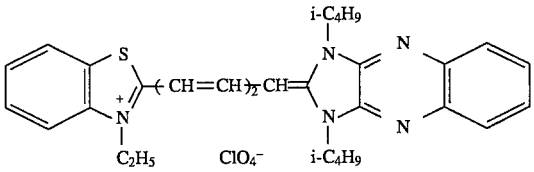
I-27
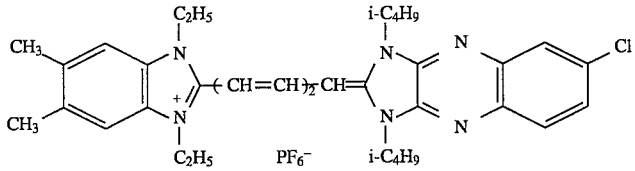
I-28
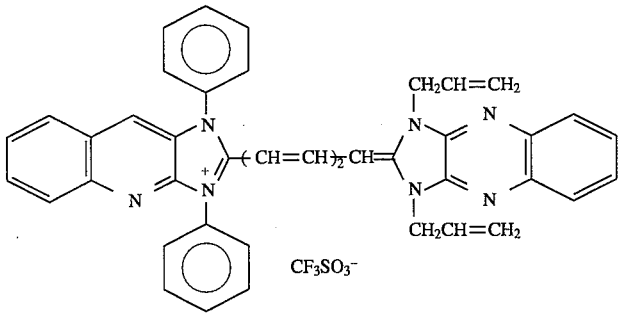

-continued
I-29
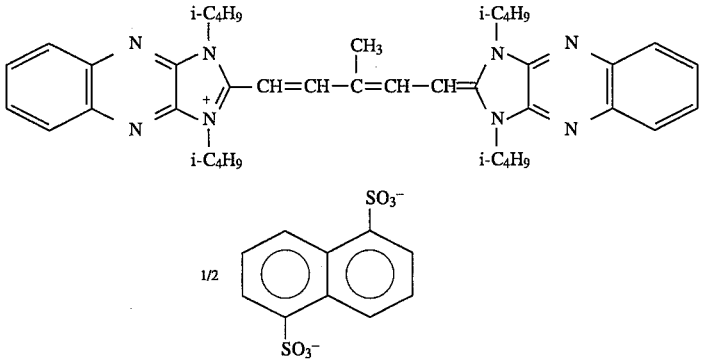
I-30
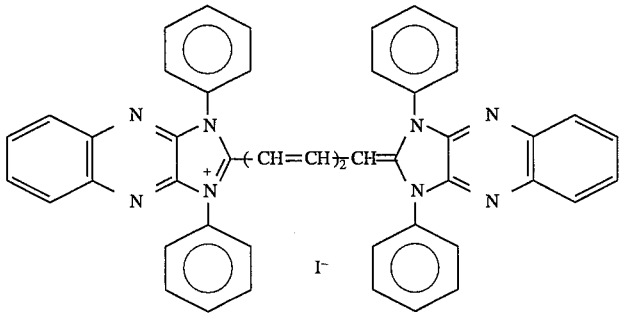
I-31
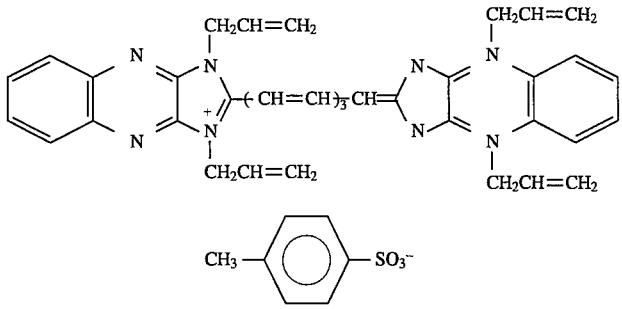
I-32
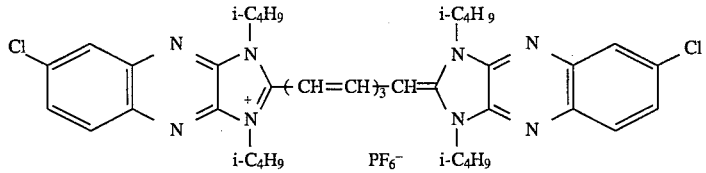
I-33
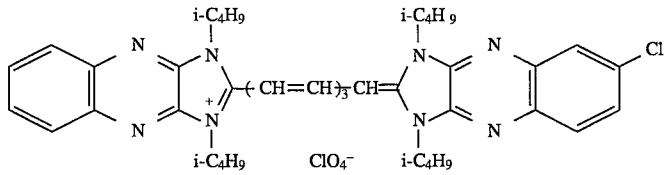
I-34
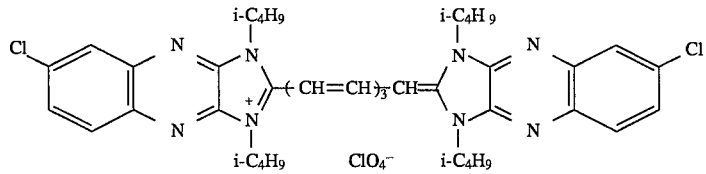

-continued
I-35
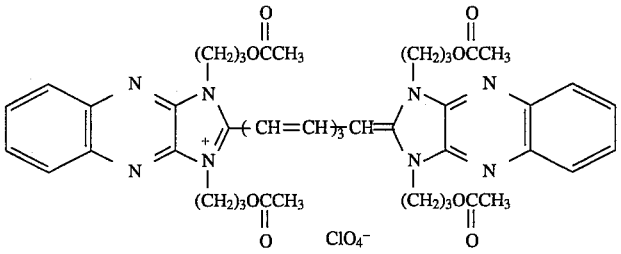
I-36
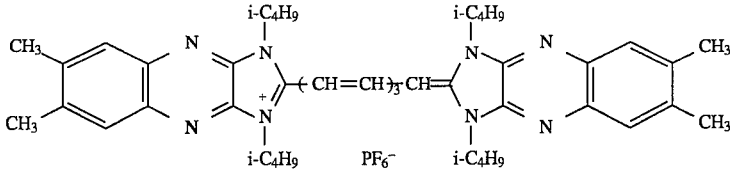
I-37
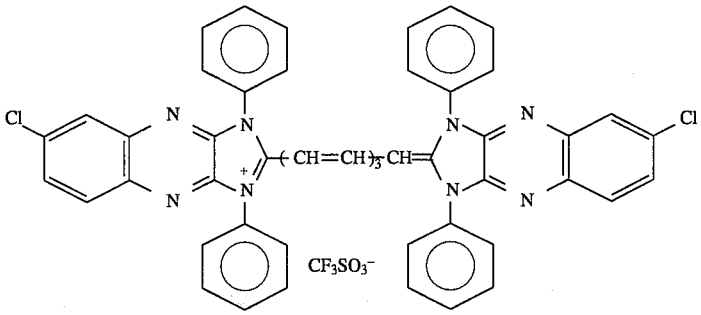
I-38
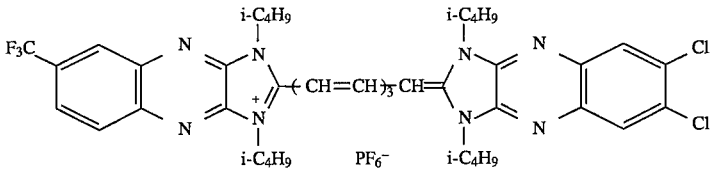
I-39
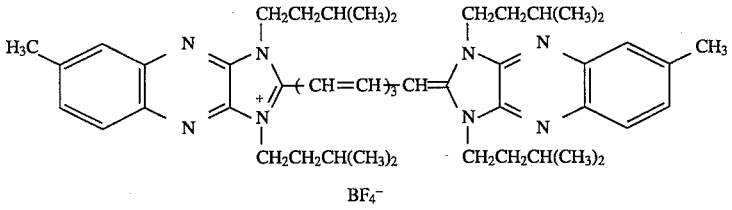
I-40
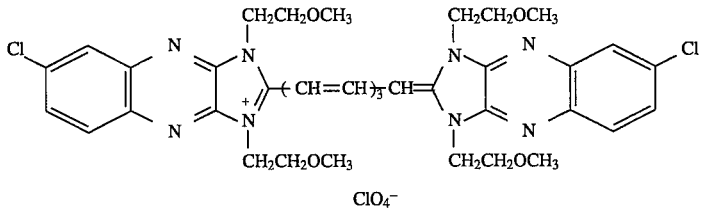
I-41
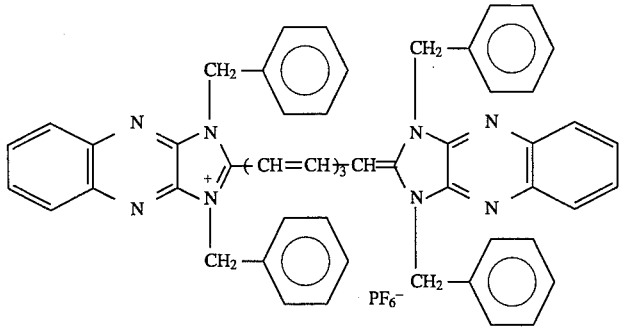

-continued

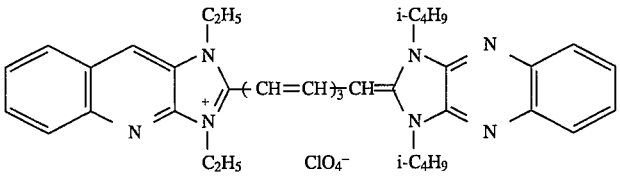

I-42

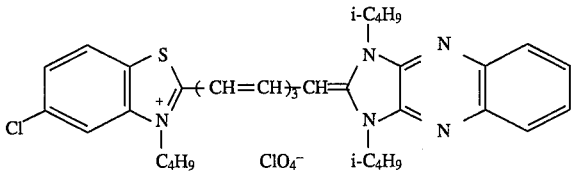

I-43

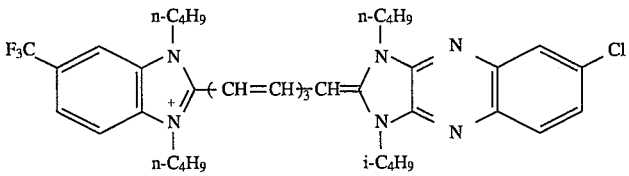

I-44

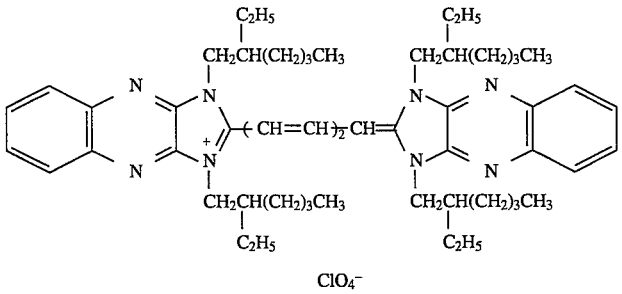

I-45

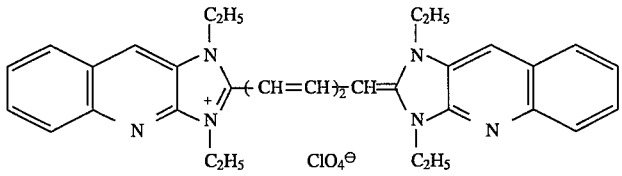

I-46

The synthesis of the compound of formula (I) can be accomplished by a known method such as disclosed in "Daiyuukikagaku (Comprehensive Organic Chemistry)", Asakura Shoten, page 432 (Nitrogen-containing Compound I). That is, the compound of formula (I) can be synthesized by condensing a quaternary salt represented by the following formula:

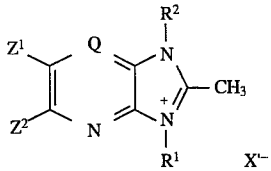

wherein $Z^1$, $Z^2$, Q, $R^1$ and $R^2$ are as defined in formula (I); and $X'^-$ represents an anion, with a dialdehyde such as 1,1,3,3-tetramethoxypropane and glutaconaldehyde or a polymethine source such as 1,7-diaza-1,7-diphenyl-1,3,5-heptatriene. In particular, the synthesis of a dye having an imidazo[4,5]-quinoxaline skeleton can be accomplished by a method such as that disclosed in U.S. Pat. No. 3,431,111.

In formulae (II) and (III), preferred examples of substituents on the benzene ring formed by the atomic group represented by T include halogen atoms (e.g., F, Cl, Br, I), $C_{1-8}$ alkyl group, $C_{1-8}$ alkoxy group, $C_{6-10}$ substituted or unsubstituted phenoxy group, amino group, mono- or di-substituted amino group, $C_{1-8}$ alkylthio group, and $C_{6-10}$ substituted or unsubstituted phenylthio group. These groups may be connected to each other to form a ring.

Particularly preferred among atomic groups represented by T are those necessary for the formation of unsubstituted benzene ring.

The group represented by $R^1$ or $R^2$ is preferably a $C_{1-8}$ alkyl group or $C_{7-8}$ benzyl group, phenethyl group, phenylpropyl group, phenyl group or allyl group which may be further substituted by halogen atoms (e.g., F, Cl, Br, I), alkoxy groups or alkylthio groups. Particularly preferred among the groups represented by $R_1$ or $R_2$ are $C_{3-6}$ alkyl groups which may be substituted by halogen atoms, $C_{1-4}$ alkoxy groups or $C_{1-4}$ alkylthio groups.

The 5- or 6-membered ring formed by the atomic group represented by $Z^3$ is preferably a so-called basic nucleus such as a pyridine ring, quinoline ring, oxazole ring, benzoxazole ring, thiazole ring, benzothiazole ring, imidazole ring, benzimidazole ring, indolenine ring and benzindolenine ring. Particularly preferred among these basic nuclei are those represented by the following formula (IIa):

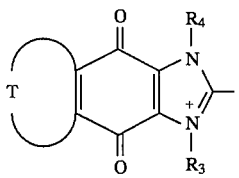

(IIa)

wherein T is as defined in the formula (II); and $R_3$ and $R_4$ have the same meaning as $R_1$ and $R_2$, respectively in formula (II).

The connecting group represented by $L^1$ is preferably one formed by 1, 3, 5 or 7 unsubstituted methine groups, methine groups substituted by $C_{1-8}$ alkyl groups, methine groups substituted by benzyl groups, methine groups substituted by phenyl groups, methine groups substituted by halogen atoms or methine groups substituted by unsubstituted or di-substituted amino groups. Substituents on these methine groups may be connected to each other to form a ring. Particularly preferred among connecting groups represented by $L^1$ are those formed only by unsubstituted methine groups and those having only a central methine group substituted by methyl group, ethyl group, benzyl group or phenyl group.

Preferred examples of the anion represented by X include halide ions, perhalogenic ions, sulfonic ions, phosphoric ions which may be substituted, tetra-substituted boric ions, hexa-substituted phosphoric ions, hexa-substituted antimonic ions, and heavy metal complex ions such as bis(benzene-1,2-dithiolate)nickelate ion. Particularly preferred among these anions are $ClO_4^-$, $PF_6^-$, $CF_3SO_3^-$, paratoluenesulfonic ion, $BF_4^-$, and $I^-$.

The connecting group represented by $L^2$ is preferably one formed by 2, 4 or 6 unsubstituted methine groups, methine groups substituted by $C_{1-8}$ alkyl groups, methine groups substituted by benzyl groups, methine groups substituted by phenyl groups or methine groups substituted by halogen atoms. Substituents on these methine groups may be connected to each other to form a ring. Particularly preferred among connecting groups represented by $L^2$ are those formed by 2, 4 or 6 unsubstituted methine groups.

The atomic group represented by Q necessary for the formation of a 5- or 6-membered ring is preferably one necessary for the formation of a so-called acidic nucleus. Examples of 5- or 6-membered rings thus formed include heterocyclic such as pyridone, 1,3-substituted-2-pyrazoline-5-one, 3,5-dioxopyrazole, barbituric acid, hydantoin and rhodanine. Particularly preferred among 5- or 6-membered rings represented by Q are 1,3-substituted-2-pyrazoline-5-one and rhodanine ring.

The group represented by $R_3$ has the same meaning as $R_1$. The suffix p is preferably an integer 1.

Specific examples of compounds represented by formulae (II) and (III) are given below, but the present invention should not be construed as being limited thereto:

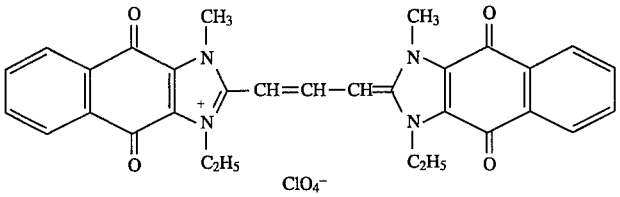

II-1

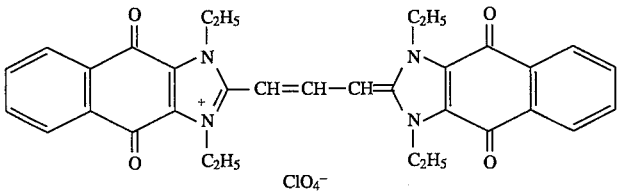

II-2

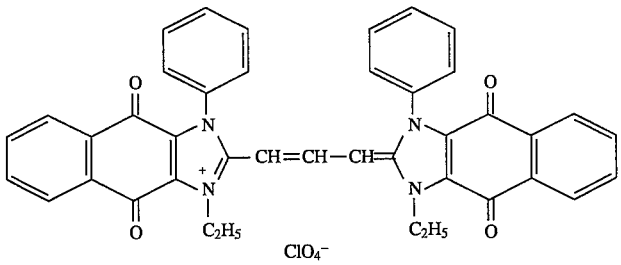

II-3

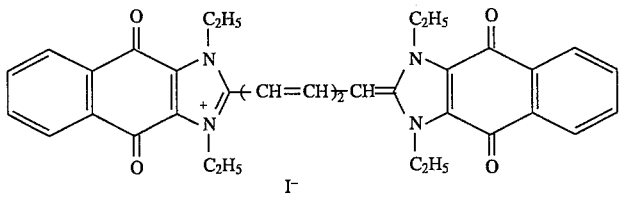

II-4

-continued
II-5
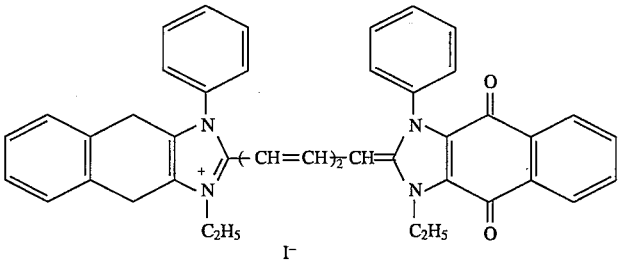
II-6
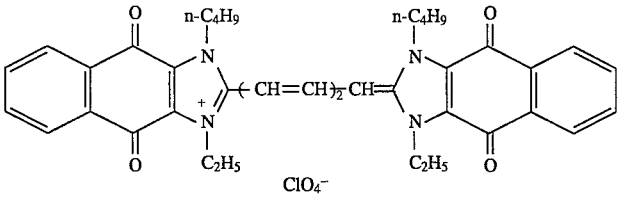
II-7
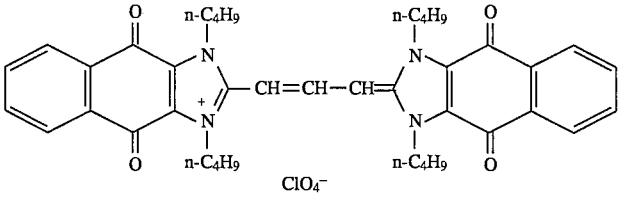
II-8
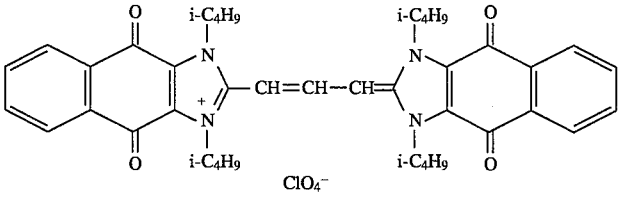
II-9
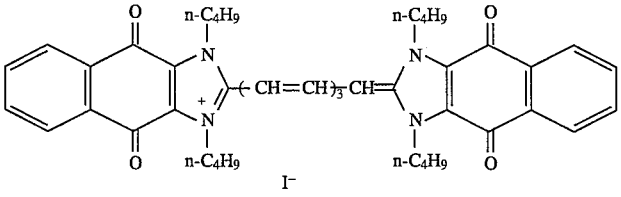
II-10
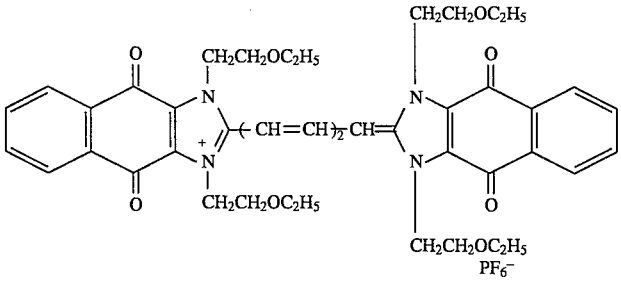
II-11
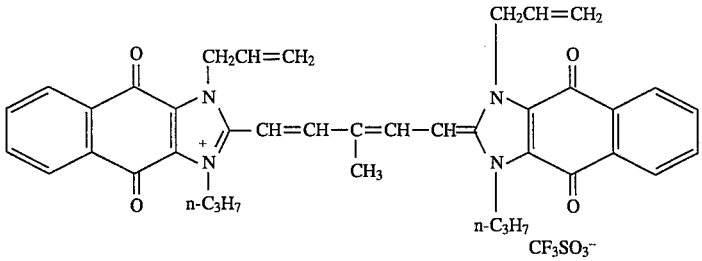

-continued
II-12
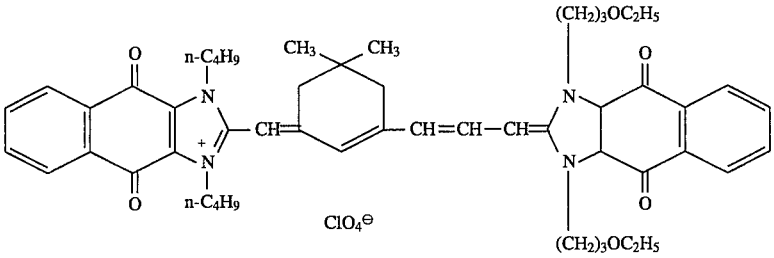
II-13
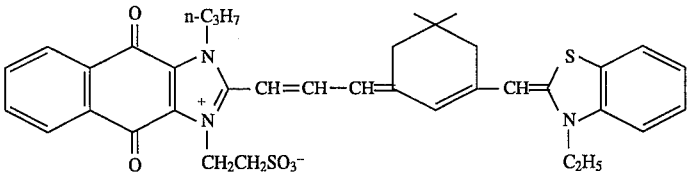
II-14
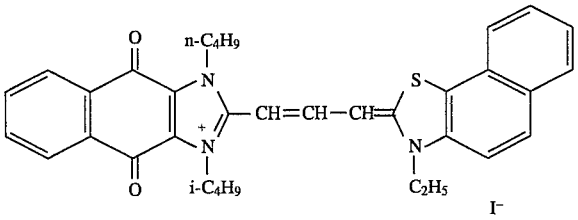
II-15
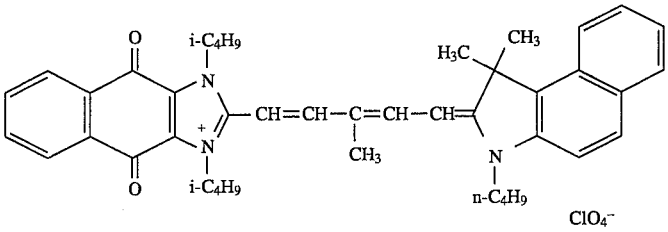
II-16
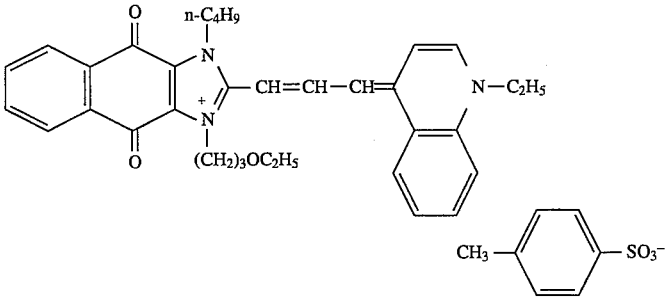
II-17
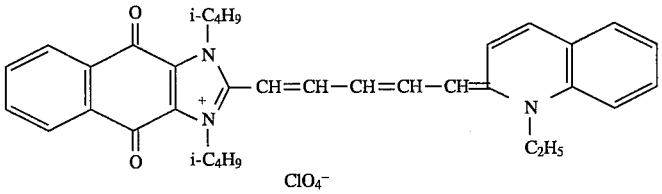
II-18
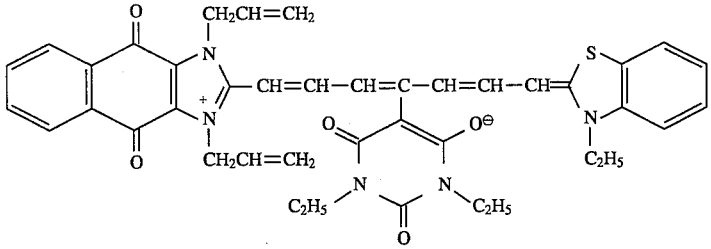

-continued
II-19
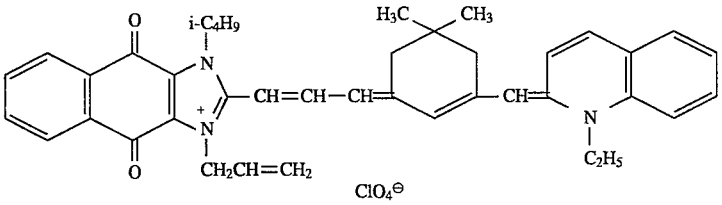
II-20
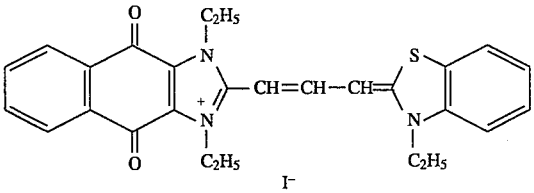
II-21
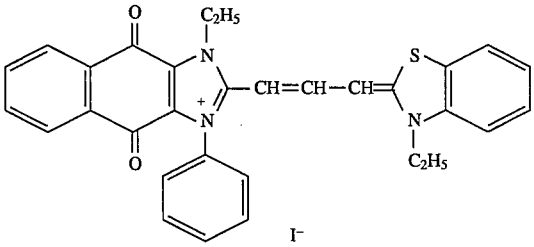
II-22
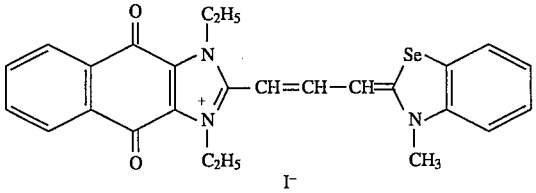
II-23
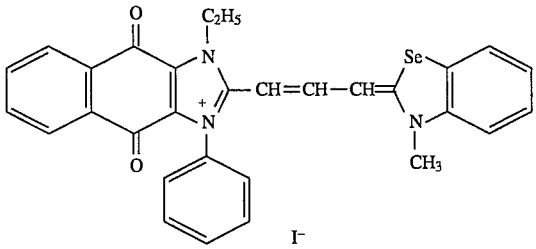
II-24
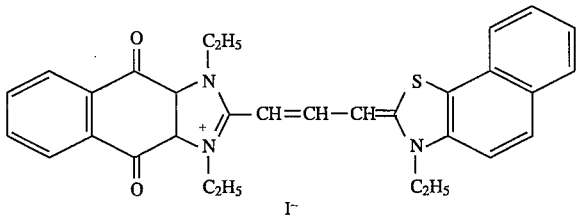
II-25
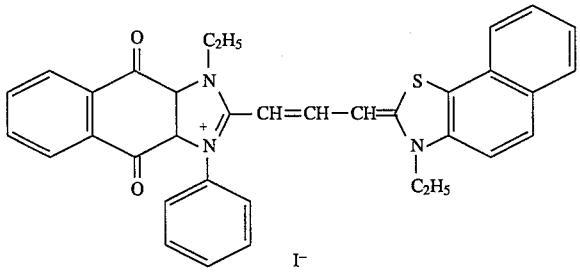

-continued
II-26
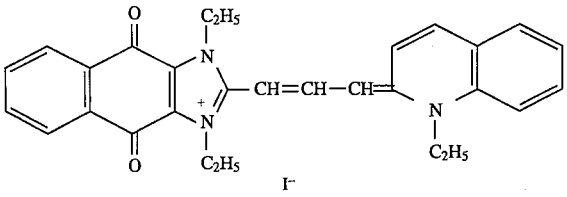
II-27
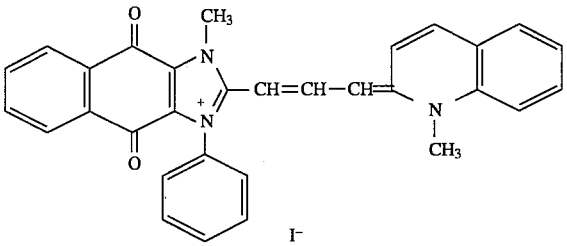
II-28
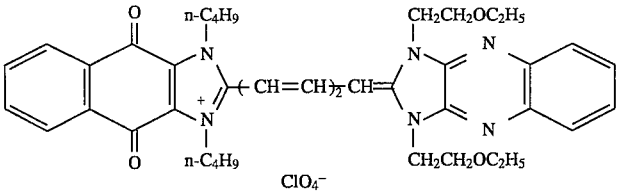
II-29
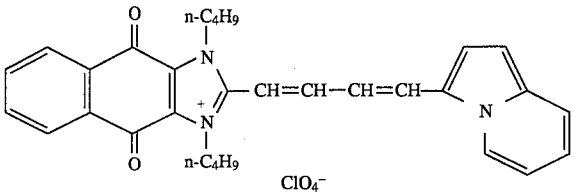
II-30
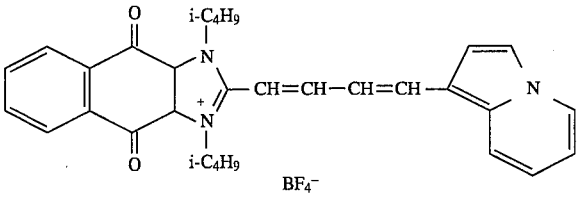
II-31
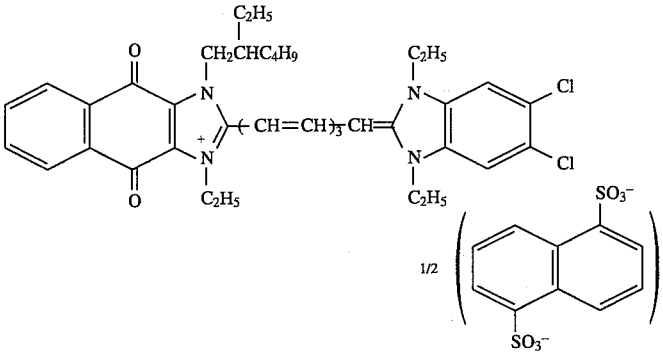
II-32
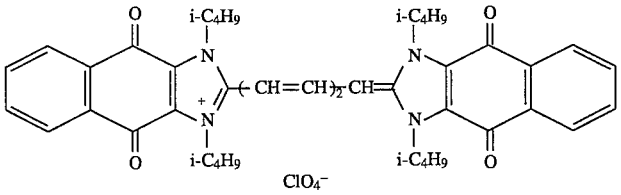

-continued
II-33
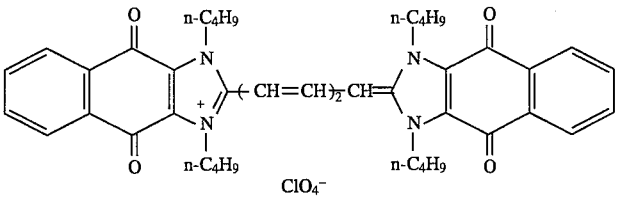
II-34
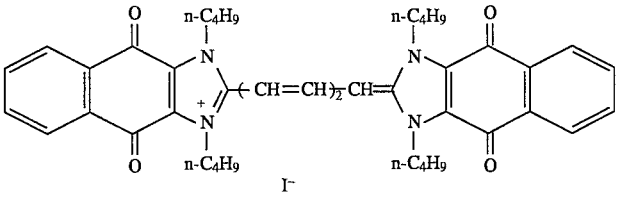
II-35
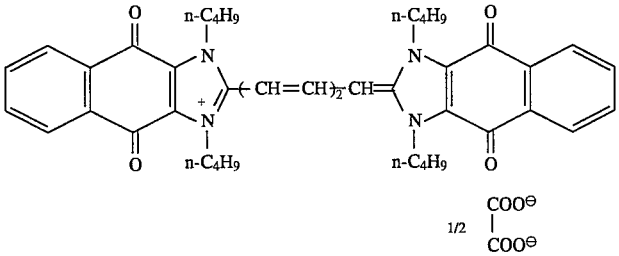
II-36
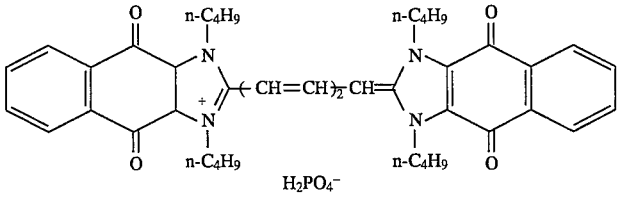
II-37
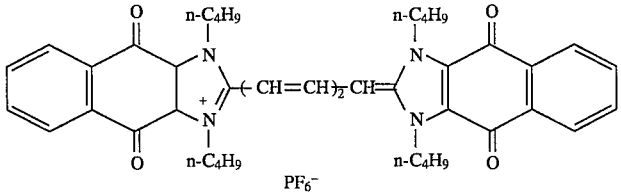
II-38
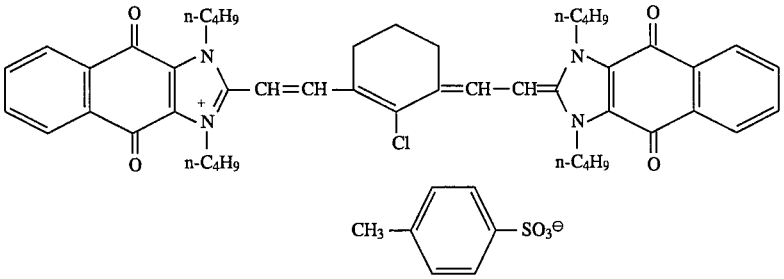
II-39
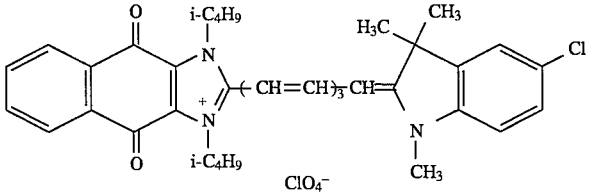

-continued
III-1
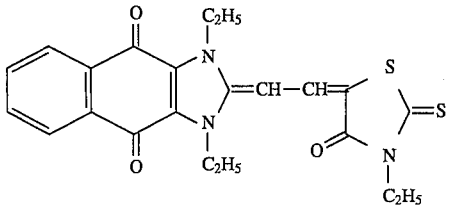
III-2
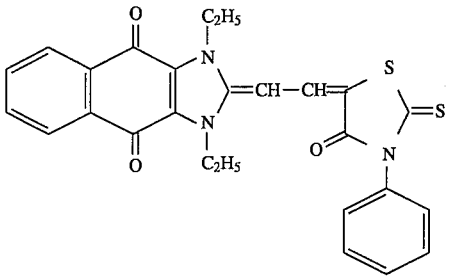
III-3
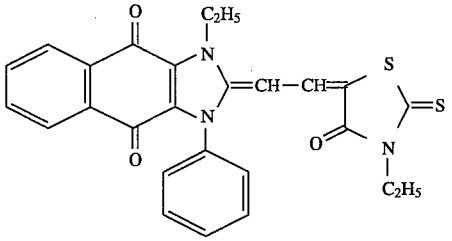
III-4
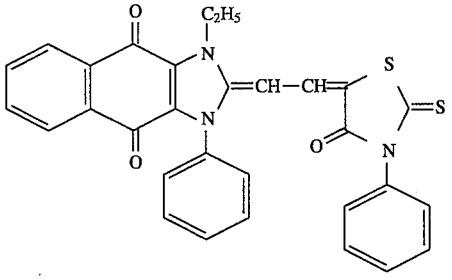
III-5
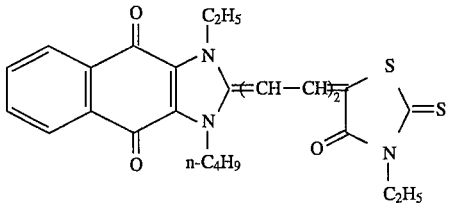
III-6
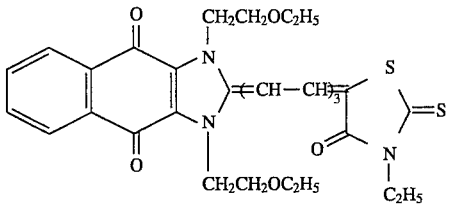
III-7
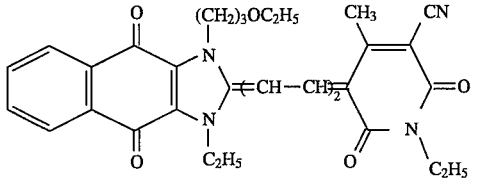

-continued

III-8

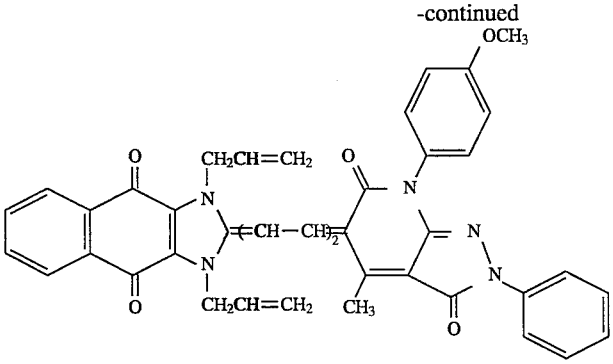

The synthesis of the compound of formula (II) or (III) can be accomplished by a method as disclosed in Ukr. Khim. Zh., vol. 35, 1969, pp. 288–291, cited in *Chemical Abstracts,* vol. 71, 22892k. Specific examples of the synthesis method are given below.

SYNTHESIS EXAMPLE 1

Synthesis of Compound II-8

To 4 ml of pyridine were added 0.23 g of 1,3-diisobutyl-2-methyl-4,9-dihydro-4,9-dioxonaphtho[2,3-d]imidazolium-4-methylbenzenesulfonate and 1 ml of ethyl orthoformate. The material was heated under reflux for 6.5 hours. The solvent was then distilled off under reduced pressure. To the material was then added 3 ml of methanol. To the material was then added a solution of 0.3 g of tetrabutylammonium perchlorate in 3 ml of methanol. The resulting crystal was then filtered off, and then washed with methanol to obtain Compound II-8 in the form of bluish green crystal.

Yield: 86 mg λmax (methanol): 502 nm

SYNTHESIS EXAMPLE 2

Synthesis of Compound II-32

0.9 g of 1,3-diisobutyl-2-methyl-4,9-dihydro-4,9-dioxonaphtho[2,3-d]imidazolium-4-methylbenzene-sulfonate and 180 mg of 1,5-diaza-1,5-diphenyl-1,3pentadiene were dissolved in 4 ml of N,N-dimethylformamide. To the solution were then added 0.18 ml of acetic anhydride and 0.27 ml of 1,8-diazabicyclo[5.4.0]-7-undecene. The material was then stirred at room temperature for 2 hours. The reaction solution was then poured into 150 ml of water. The resulting solid was filtered off, and then washed with water. The solid thus obtained was then dissolved in 20 ml of methanol. To the solution was then added a solution of 1 g of tetrabutylammonium perchlorate in 2 ml of methanol. The resulting crystal was filtered off, and then washed with methanol to obtain Compound II-32 in the form of green crystal.

Yield: 210 mg Melting point: 225°–226° C. (decomposition) λmax (methanol): 600 nm

SYNTHESIS EXAMPLE 3

Synthesis of Compound II–33

To 30 ml of N,N-dimethylformamide were added 5 g of 1,3-dibutyl-2-methyl-4,9-dihydro-4,9-dioxonaphtho-[2,3-d] imidazolium-4-methylbenzenesulfonate, 1.1 g of 1,5-diaza-1,5-diphenyl-1,3-pentadiene, 1 ml of acetic anhydride and 2.2 ml of 1,8-diazabicyclo[5.4.0]-7-undecene. The material was then stirred at room temperature for 2 hours.

The reaction mixture was then poured into a solution of 5 g of tetrabutylammonium perchlorate in 150 ml of methanol. The resulting crystal was filtered off, and then washed with methanol to obtain 0.5 g of Compound II-33 in the form of yellowish green crystal.

(m.p. 215°–216° C. (decomposition)) λmax (methanol): 596 nm

In the compound represented by formula (IV), , $R^1$, $R^2$, $R^3$ and A are preferably the same as $R^{11}$, $R^{12}$, $R^{13}$ and A', respectively.

The atomic group represented by A or A' necessary for the formation of an aromatic ring is preferably a benzene ring or naphthalene ring which may be substituted. Preferred examples of substituents for the benzene ring or naphthalene ring include a halogen atom such as F and Cl, cyano group, nitro group, carboxyl group, acyl group, $C_{1-8}$ alkylsulfonyl group, $C_{1-8}$ arylsulfonyl group, $C_{1-8}$ alkoxycarbonyl group, amino group, $C_{1-8}$ alkyl group, aryl group, $C_{1-8}$ alkoxy group, $C_{1-8}$ aryloxy group, $C_{1-8}$ alkylthio group, arylthio group, sulfamoyl group, N-substituted sulfamoyl group, carbamoyl group, N-substituted carbamoyl group, and 5- or 6-membered heterocyclic group. Further preferred among these substituents are substituents whose Hammett's σ constant or conversion value thereof is positive. Particularly preferred among these substituents are a halogen atom such as F and Cl, $C_{1-4}$ halogenated alkyl group (e.g., trifluoromethyl), cyano group, and $C_{1-4}$ alkoxycarbonyl group (e.g., ethoxycarbonyl).

A preferred example of the connecting group represented by L is a conjugated methine group formed by 3 or 5 methine groups. This conjugated methine group may contain substituents. Preferred examples of such substituents include a halogen atom, $C_{1-8}$ alkyl group, $C_{1-6}$ alkoxy group, and aralkyl group. Further preferred among these substituents are a halogen atom, $C_{1-4}$ alkyl group, benzyl group, and phenyl group. Particularly preferred among these substituents are a methyl group, benzyl group, and a halogen atom such as Cl.

Preferred examples of the groups represented by $R^1$, $R^2$, $R^{11}$ and $R^{12}$ include a $C_{1-18}$ alkyl group which may be substituted (e.g., methyl, ethyl, butyl, isobutyl, 2-ethylhexyl, dodecyl, trifluoromethyl, 2-ethoxyethyl, 2-hydroxyethyl, 3-sulfopropyl, 3-sulfobutyl, 2-sulfoethyl), and $C_{6-18}$ phenyl or naphthyyl group which may be substituted (e.g., phenyl, 4-methylphenyl, 3,5-dichlorophenyl, 4-methoxyphenyl, β-naphthyl, 2,5-di-t-amylphenyl). Further preferred among these groups is a $C_{1-8}$ unsubstituted alkyl group or unsubstituted phenyl or naphthyl group. Most preferred among these groups are a methyl group, ethyl group, n-propyl group, and phenyl group.

The group represented by $R^3$ or $R^{13}$ is preferably a $C_{1-18}$ (preferably $C_{1-5}$) alkyl group which may be substituted by a $C_{1-4}$ alkoxy group, $C_{1-4}$ alkylthio group, $C_{1-4}$ alkoxycarbonyl group, $C_{1-4}$ sulfonyl group, halogen atom or hydroxyl group. The group represented by $R^3$ or $R^{13}$ is more preferably a methyl group, ethyl group, isopropyl group, sec-butyl group, cyclohexyl group, 2-ethylhexyl group, benzyl group, 2-phenylthio group, dodecyl group, 2-ethoxyethyl group, 3-ethoxypropyl group, hydroxyethyl group, 3-acetoxypropyl group, ethoxycarbonylmethyl group, 3-sulfopropyl group, 2,3-tetrafluoropropyl group, allyl group, 2-methylthioethyl group, 3-methoxypropyl group, phenyl group, 4-methylphenyl group, 3,5-dichlorophenyl group, 4-methoxyphenyl group, β-naphthyl group or 2,5-di-t-amylphenyl group. The group represented by $R^3$ or $R^{13}$ is most preferably a methyl group, ethyl group, sec-butyl group, 2-ethoxyethyl group, 3-ethoxypropyl group, 3-methoxypropyl group, hydroxyethyl group, 3-acetoxypropyl group, ethoxycarbonylmethyl group, 3-sulfopropyl group or 2,3-tetrafluoropropyl group.

Preferred examples of the anion represented by X include a halide ion (e.g., $Cl^-$, $Br^-$, $I^-$), sulfonate ion (e.g., $CH_3SO_3^-$, $CF_3SO_3^-$, $CH_3OSO_3^-$, naphthalene-1,5-disulfonate ion), $ClO_4^-$, $BF_4^-$, and

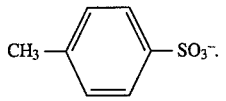

Particularly preferred among these anions are $ClO_4^-$, $BF_4^-$, $I^-$ and

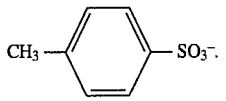

Specific examples of the compound represented by formula (IV) include Compounds IV-1 to IV-20 set forth below:

IV-1

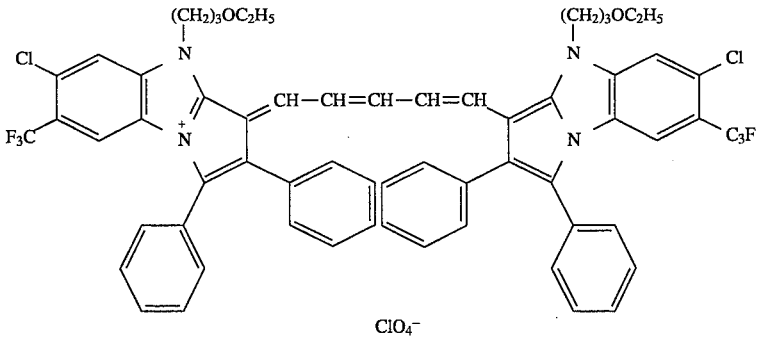

IV-2

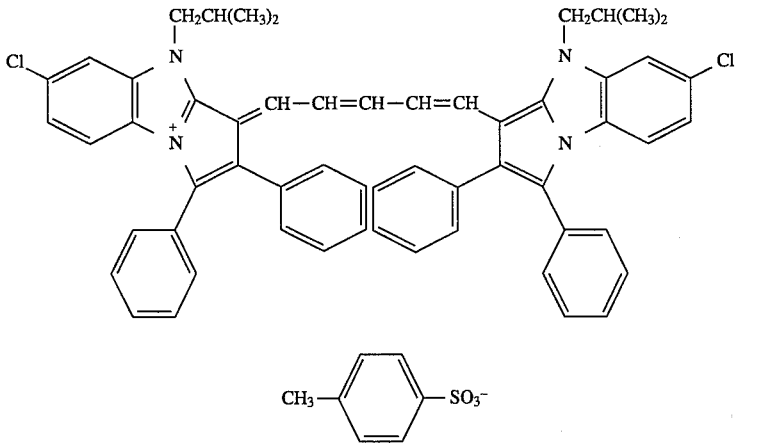

IV-3

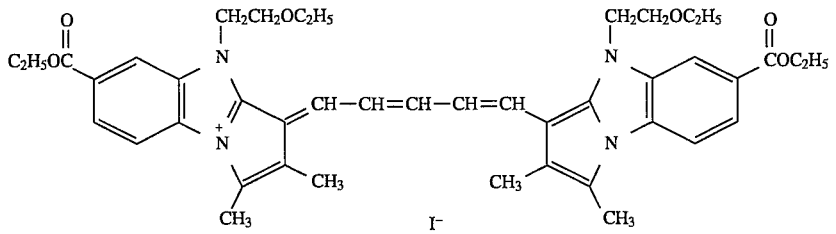

-continued
IV-4
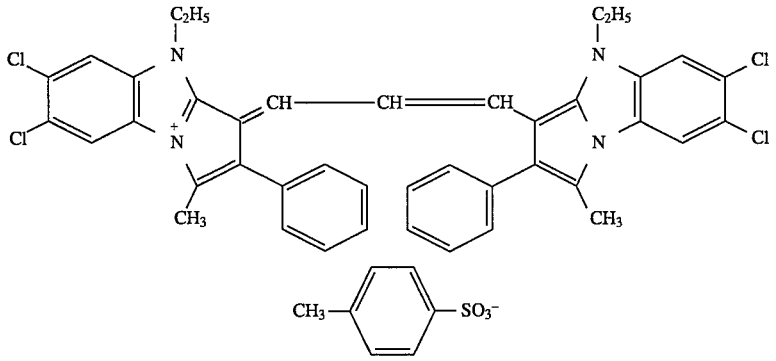
IV-5
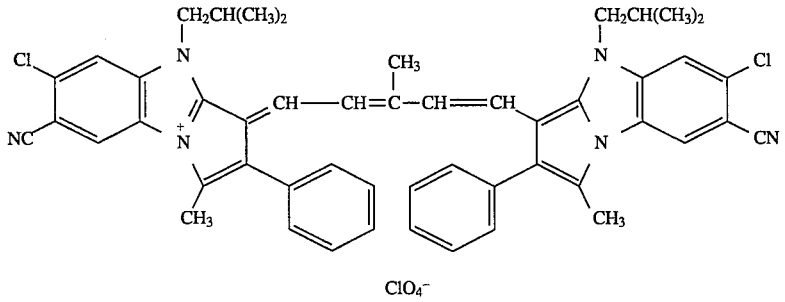
IV-6
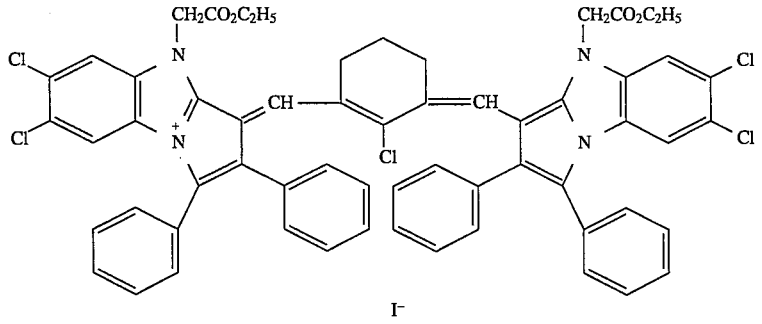
IV-7
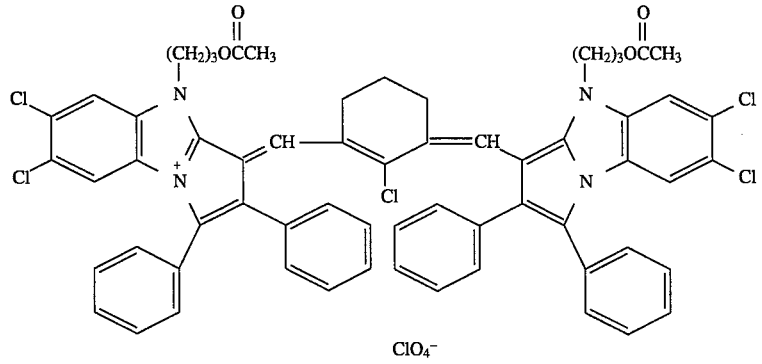
IV-8
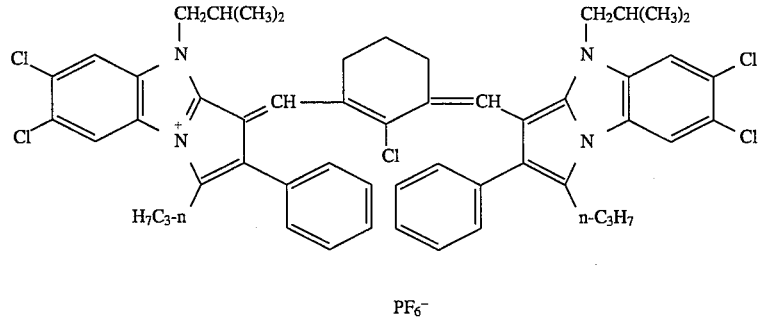

-continued
IV-9
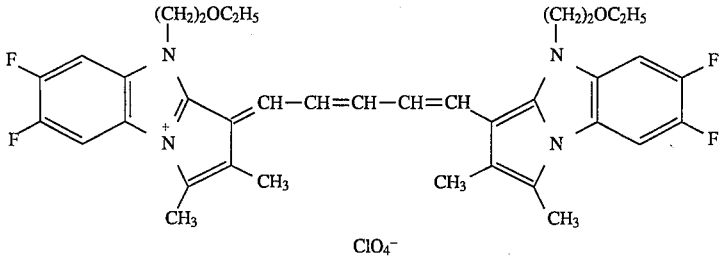
IV-10
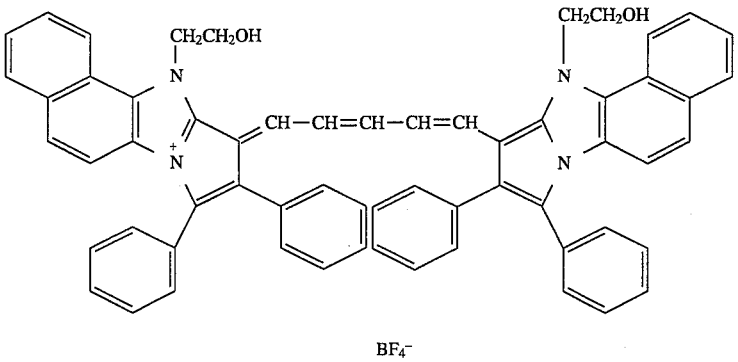
IV-11
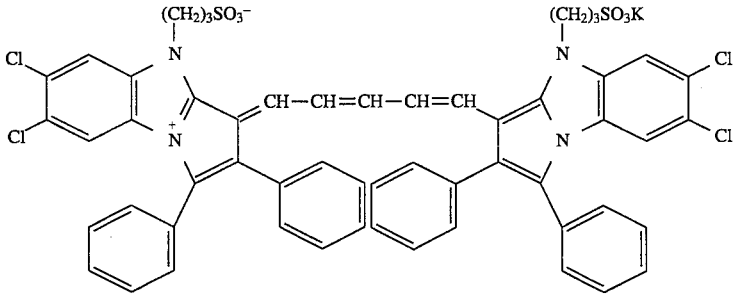
IV-12
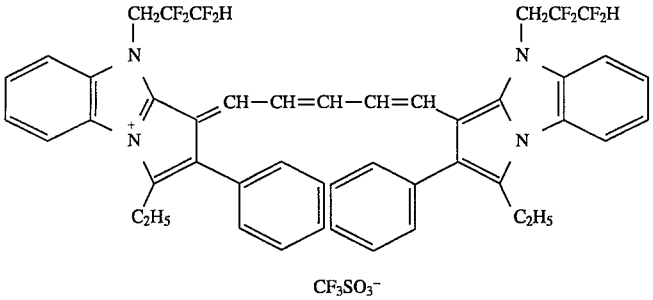
IV-13
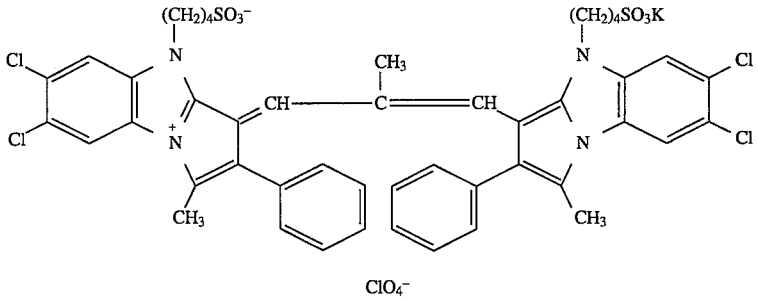

-continued
IV-14
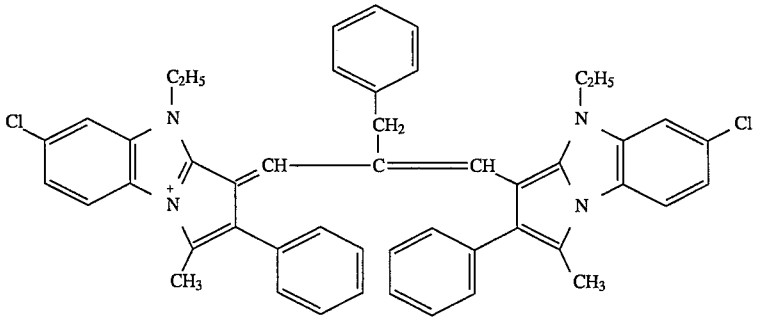
$I^-$
IV-15
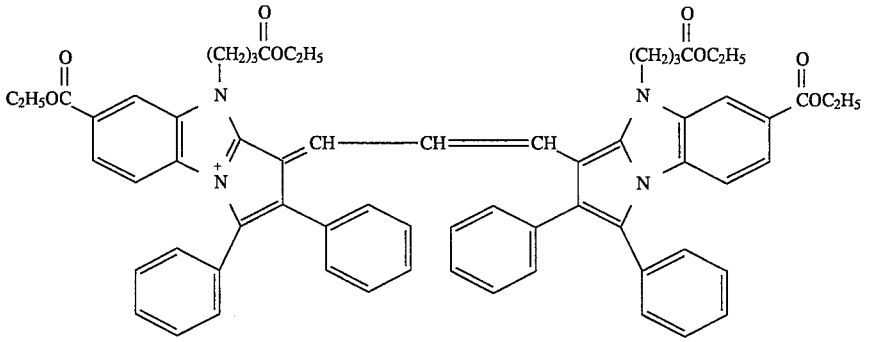
$BF_4^-$
IV-16
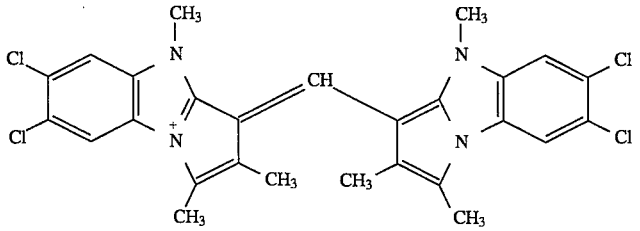
$I^-$
IV-17
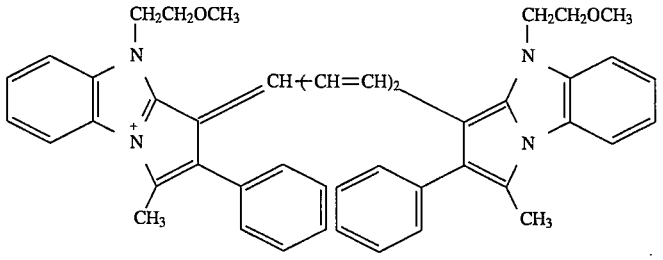
$ClO_4^-$
IV-18
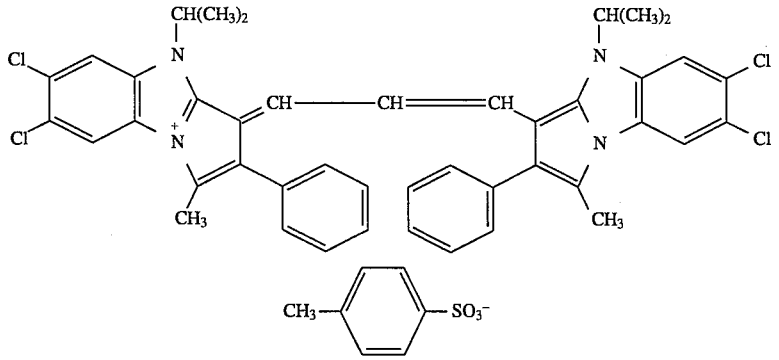

-continued

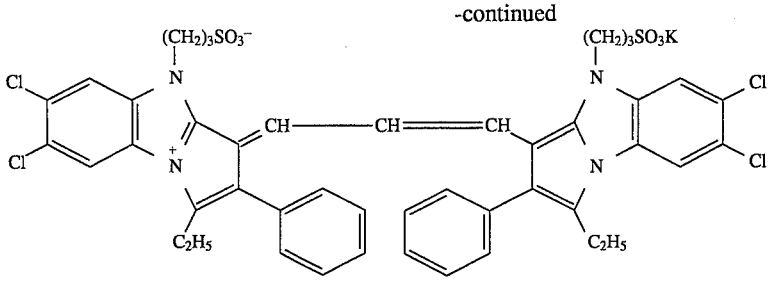

IV-19

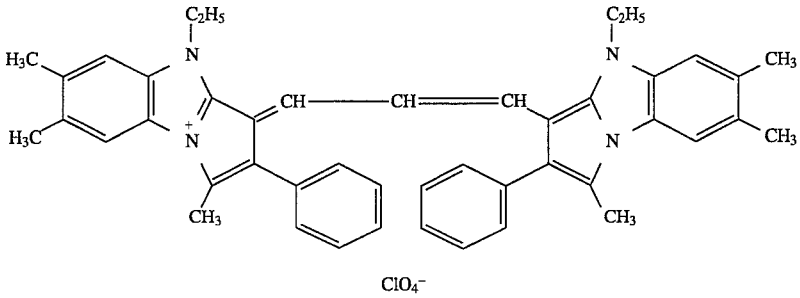

IV-20

A few examples of the dye of the present invention represented by formula (IV) (in particular, the dye represented by the formula (IV) wherein A and A' each represents an unsubstituted benzene ring, $R^1$, $R^2$, $R^3$,$R^{11}$, $R^{12}$ $R^{13}$ and each represents a methyl group, $X^{n-}$ represents $ClO_4^-$, and L represents an unsubstituted methine and another dye represented by formula (IV) wherein L represents a trimethine group, and the others are as defined above) are disclosed in and can be synthesized by the methods described in F. S. Babichev and A. F. Babicheva, "Khim. Geterotsikl Soedin.", 1967, pp. 917–922, an excerpt of which is cited in "Chemical Abstracts", vol. 69, Section 60031V. However, there no reference to the application of these dyes to photographic light-sensitive materials. Other dyes can be synthesized in accordance with the foregoing synthesis methods.

The method for the synthesis of the compound of the present invention will be further described with reference to specific examples of the method for the synthesis of the compound represented by formula (IV).

SYNTHESIS EXAMPLE 4

Synthesis of Dye IV-4

To 4.58 g of 5,6-dichloro-1-ethyl-2-methylbenzimidazole was added 25 ml of acetone to make a solution. To the solution was then added 3 ml of α-bromopropiophenone. The material was heated under reflux for 100 minutes. The acetone was then distilled off. The material was then heated to a temperature of 100° C. for 1 hour. To the reaction mixture was then added 100 ml of acetone. The material was then stirred. The resulting colorless crystal was filtered off, washed with acetone, and then dried. (Yield: 5.4 g)

The crystal thus obtained was then added to an aqueous solution of 1.3 g of sodium carbonate in 60 ml of water. The material was then heated over a steam bath for 80 minutes. The material was allowed to cool. The resulting crystal was filtered off, and then washed with water to obtain 4.8 g of a colorless crystal. The crystal was then recrystallized from 600 ml of methanol to obtain 2 g of 6,7-dichloro-4-ethyl-1-methyl-2-phenylpyrrolo[1,2-a]benzimidazole in the form of colorless acicular crystal.

To 1 g of the crystal thus obtained were added 20 ml of acetonitrile and 0.3 g of paratoluenesulfonic acid monohydrate to make a solution. To the solution was added 1 ml of 1,3,3-trimethoxypropene. The material was then heated under reflux for 5 minutes. The material was then allowed to cool. The resulting crystal was filtered off, and then washed with 25 ml of acetonitrile to obtain 0.75 g of the desired compound in the form of crystal.

Melting point: 247°–249° C. λmax (methanol): 626 nm

SYNTHESIS EXAMPLE 5

Synthesis of Dye IV-18

To 2.57 g of 5,6-dichloro-1-isopropyl-2-methylbenzimidazole were added 1.52 ml of α-bromopropiophenone and 1 ml of anisole. The material was then heated over a steam bath for 2 hours. To the material was then added 50 ml of acetone.

The resulting crystal was then withdrawn by filtration. To the crystal thus obtained was added 40 ml of a 2% aqueous solution of sodium carbonate. The material was then heated over a steam bath for 80 minutes. The material was then allowed to cool. The resulting crystal was filtered off, and then washed with water to obtain 6,7-dichloro-4-isopropyl-1-methyl-2phenylpyrrolo[1,2-a]benzimidazole.

To 0.6 g of the crystal thus obtained were then added 1 ml of acetonitrile, 0.17 g of paratoluene-sulfonic acid monohydrate and 0.6 ml of 1,3,3-trimethoxypropene. The material was heated under reflux for 15 minutes. The material was then allowed to cool. The resulting crystal was filtered off, and then washed with acetonitrile to obtain 0.2 g of the desired compound.

Melting point: 167° C. λmax (methanol): 626 nm

Examples of the ring formed by $Z^4$ in formula (V) include benzene ring, naphthalene ring, pyridine ring, quinoline ring, pyrazine ring, and quinoxaline ring.

$Z^4$ may further comprise another substituent connected thereto. Examples of such a substituent include various substituents such as an alkyl group, aryl group, heterocyclic residue, halogen atom, alkoxy group, aryloxy group, alkylthio group, arylthio group, alkylcarbonyl group, arylcarbonyl group, alkyloxycarbonyl group, aryloxycarbonyl group, alkylcarbonyloxy group, arylcarbonyloxy group, alkylamide group, arylamide group, alkylcarbamoyl group, arylcarbamoyl group, alkylamino group, arylamino group, carboxylic group, alkylsulfonyl group, arylsulfonyl group, alkylsulfonamido group, arylsulfonamido group, alkylsulfamoyl group, arylsulfamoyl group, cyano group and nitro group.

The number .of these substituents is normally 0 or from 1 to 4. When the number is 2 or more, the plurality of $R^6$ groups may be different.

Preferred among substituents are a halogen atom (e.g., F, Cl), cyano group, substituted or unsubstituted $C_{1-20}$ alkoxycarbonyl group (e.g., methoxycarbonyl, ethoxycarbonyl, dodecyloxycarbonyl), substituted or unsubstituted $C_{1-20}$ alkylsulfonyl group or arylsulfonyl group (e.g., methylsulfonyl, ethylsulfonyl, isobutylsulfonyl, t-pentylsulfonyl, octadecylsulfonyl, cyclohexylsulfonyl, trifluoromethylsulfonyl), and electron attractive group such as nitro group.

Preferred among groups represented by $R^1$, R2, $R^3$, $R^4$, and $R^5$ in T in formula (V) are a substituted or unsubstituted alkyl, aryl and alkenyl groups, particularly alkyl group The group represented by $R^1$, $R^2$, $R^3$, $R^4$ or $R^5$ preferably has 1 to 30 carbon atoms, particularly 1 to 20 carbon atoms.

If the groups represented by $R^1$, $R^2$, $R^3$, $R^4$, and $R^5$ further contain substituents, examples of such substituents include a sulfonic group, alkylcarbonyloxy group, alkylamido group, alkylsulfonamido group, alkoxycarbonyl group, alkylamino group, alkylcarbamoyl group, alkylsulfamoyl group, alkoxy group, aryloxy group, alkylthio group, arylthio group, alkyl group, aryl group, carboxyl group, halogen atom, and cyano group. Particularly preferred among these substituents are a halogen atom (e.g., F, Cl), cyano group, substituted or unsubstituted $C_{1-20}$ alkoxy group (e.g., methoxy, ethoxy, dodecyloxy, methoxyethoxy), $C_{6-20}$ substituted or unsubstituted phenoxy group (e.g., phenoxy, 3,5-dichlorophenoxy, 2,4-di-t-pentylphenoxy), substituted or unsubstituted $C_{1-20}$ alkyl group (e.g., methyl, ethyl, isobutyl, t-pentyl, octadecyl, cyclohexyl), and substituted or unsubstituted $C_{6-20}$ phenyl group (e.g., phenyl, 4-methylphenyl, 4-trifluoromethylphenyl, 3,5-dichlorophenyl).

Particularly preferred among the groups represented by $R^1$, $R^2$, $R^3$, $R^4$, and $R^5$ is an unsubstituted $C_{1-8}$ alkyl group.

Particularly preferred among the groups represented by T is $C(CH_3)_2$.

The ring formed by the divalent group represented by Q is preferably a 5-, 6- or 7-membered heterocycle.

The divalent group represented by Q is preferably an ethylene group, propylene group, butylene group or group produced by replacing the methylene group which is not on the terminal positions of propylene group or butylene group by —O— or —S—. These divalent groups may contain substituents.

Particularly preferred examples of the divalent group represented by Q include an ethylene group, propylene group, butylene group, $—CH_2OCH_2—$, $—CH_2OCH_2CH_2—$, $—CH_2SCH_2—$, and $—CH_2SCH_2CH_2—$. These groups may contain substituents.

Examples of substituents which may substitute for a hydrogen atom or other atoms in the divalent groups represented by Q include a halogen atom (e.g., F, C1), nitro group, cyano group, alkyl group having 20 or less carbon atoms which may be substituted (e.g., methyl, ethyl, trifluoromethyl, 2-methoxyethyl, cyclohexyl, benzyl), $C_{6-20}$ phenyl group which may be substituted (e.g., phenyl, p-methoxyphenyl, m-chlorophenyl, p-tolyl, p-fluorophenyl), $C_{1-20}$ alkoxy group which may be substituted (e.g., methoxy, 2-methoxyethoxy, 2,2,3,3-tetrafluoropropyloxy), $C_{6-20}$ phenoxy group which may be substituted (e.g., phenoxy, p-methoxyphenoxy, 3,5-dichlorophenoxy, p-butylphenoxy), $C_{1-20}$ alkylthio group which may be substituted (e.g., methylthio, butylthio, dodecylthio), $C_{6-20}$ arylthio group which may be substituted (e.g., phenylthio), $C_{1-20}$ alkylsulfonyl group which may be substituted (e.g., methanesulfonyl, butanesulfonyl, dodecanesulfonyl), and $C_{6-20}$ arylsulfonyl group which may be substituted (e.g., phenylsulfonyl, p-toluenesulfonyl, m-chlorobenzenesulfonyl).

Particularly preferred among divalent groups represented by Q are an ethylene group, propylene group, butylene group, and group formed by replacing one or more hydrogen atoms in these groups by F, Cl or $C_{1-4}$ alkyl group.

The group represented by L in formula (V) preferably represents a pentamethine group or heptamethine group formed by the connection of methine groups which may be substituted, via conjugated double bonds. The group represented by L is preferably one represented by any one of the following formulae (LI) to (LVI):

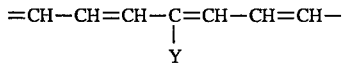
(LI)

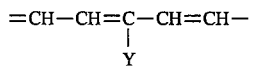
(LII)

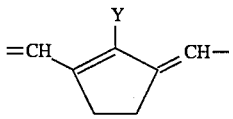
(LIII)

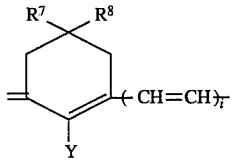
(LIV)

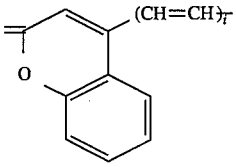
(LV)

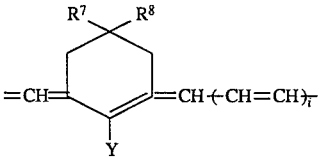
(LVI)

Particularly preferred among these groups are connecting groups constituting tricarbocyanines represented by formulae (LII), (LIII), (LIV), (LV), or (LVI).

In formulae (LI) to (LVI), i represents an integer 1 or 2, j represents an integer 0 or 1, and Y represents a hydrogen atom or monovalent group.

Examples of the monovalent group represented by Y include a lower alkyl group (e.g., methyl), lower alkoxy group (e.g., methoxy), substituted amino group (e.g., dimethylamino, diphenylamino, methylphenylamino, morpholino, imidazolidine, ethoxycarbonylpiperadine), alkylcarbonyloxy group (e.g., acetoxy), alkylthio group (e.g., methylthio), cyano group, nitro group, and halogen atoms (e.g., Br, Cl, F).

Particularly preferred among these groups represented by Y is a hydrogen atom.

$R^7$ and $R^8$ each represents a hydrogen atom or lower alkyl group (e.g., methyl).

Preferred examples of the anion represented by $X^-$ in the general formula (V) include halide ions (e.g., $I^-$, $Br^-$, $Cl^-$), perhalogenic ions (e.g., $ClO_4^-$, $BrO_4^-$), $BF_4^-$, $PF_4^-$, sulfonic ions (e.g., $CH_3SO_3^-$, $CF_3SO_3^-$, benzenesulfonic ion, toluenesulfonic ion, naphthalenesulfonic ion), $HSO_3^-$, $SO_4^{2-}$, $PO_4^{3-}$, $H_2PO_4^-$, heteropolyacid ions (e.g., $[PO_4.12MoO_3]^{3-}$), and carboxylic ions (e.g., $HCO_3$—, $CO_3^{2-}$, $CH_3CO_2^-$, benzenecarboxylic ion, $^-O_2C$—$CO_2^-$, $^-O_2C$—$H_2C$—CH=CH—$_2$—$CO_2^-$).

$X^-$ may be connected to Z, Q, T or L as a substituent (e.g., as —$SO_3^-$ or —$(CH_2)_4SO_3^-$).

Specific examples (V-1 to V-18) of the compound represented by formula (V) are given below, but the present invention should not be construed as being limited thereto:

V-1

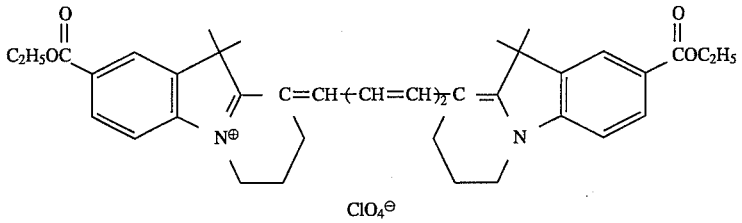

V-2

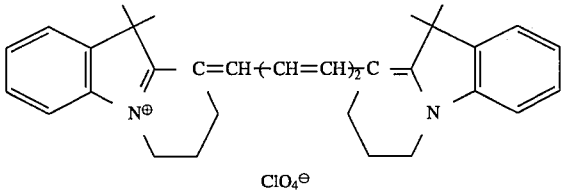

V-3

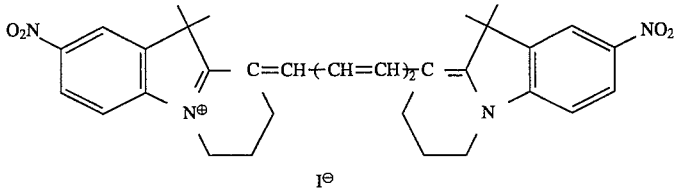

V-4

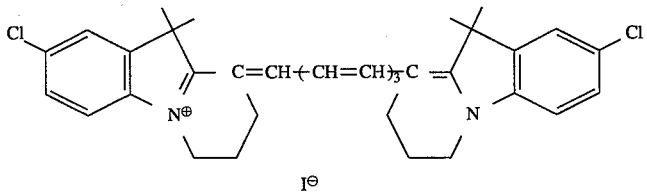

V-5

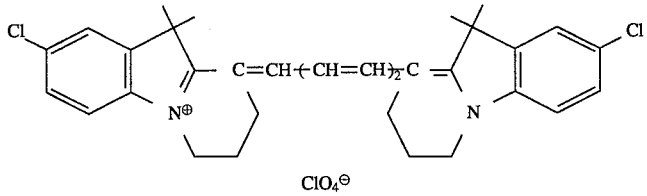

V-6

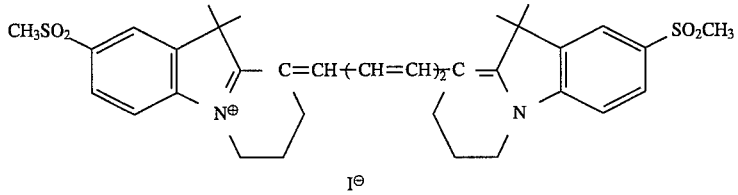

V-7

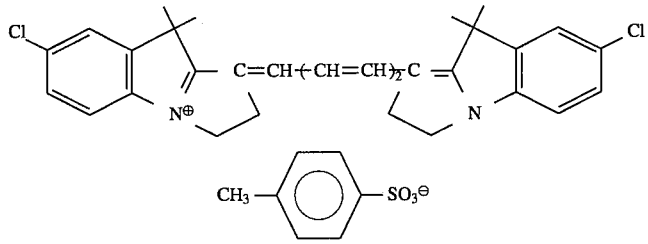

-continued
V-8
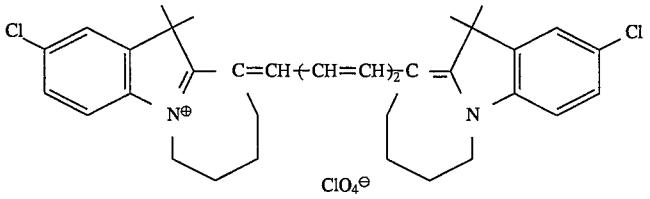
V-9
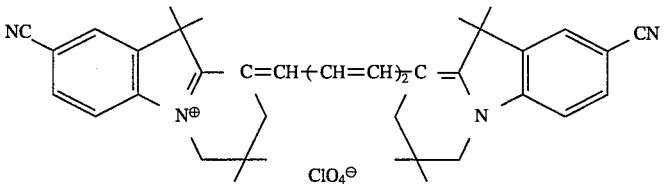
V-10
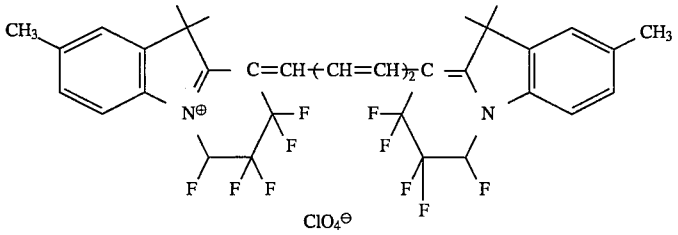
V-11
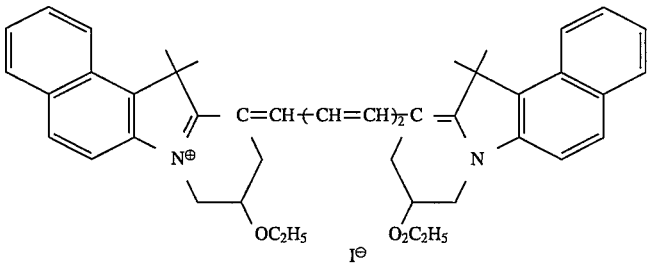
V-12
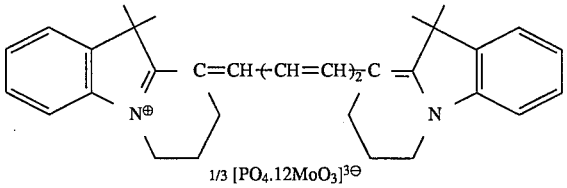
V-13
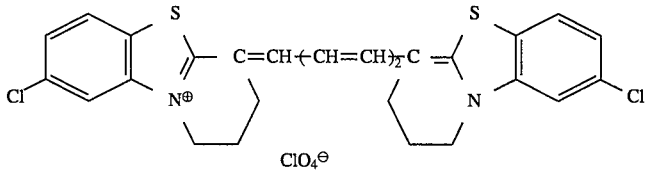
V-14
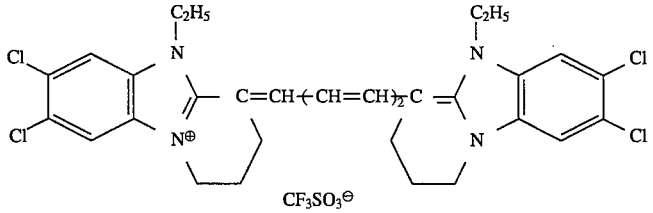
V-15
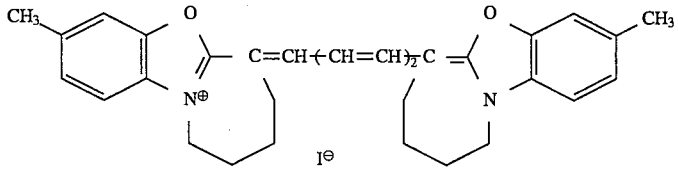

-continued

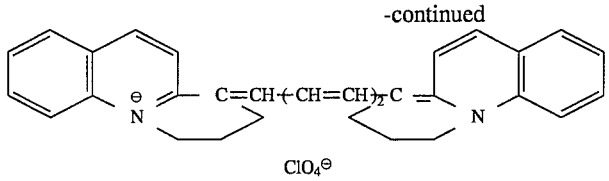

V-16

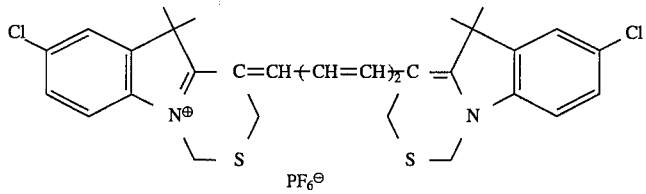

V-17

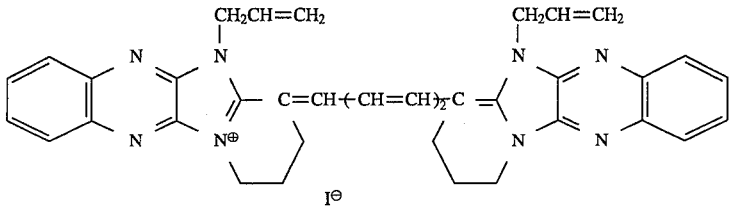

V-18

The compound represented by formula (V) can be normally synthesized in the same manner as carbocyanine dyes.

That is, the compound represented by formula (V) can be synthesized by reacting a heterocyclic enamine represented by the following formula (A) with an acetal such as $CH_3O$—CH=CH—CH=CH—$CH(OCH_3)_2$ or a compound such as PhN=CH—$(CH=CH)_2$—NHPh.

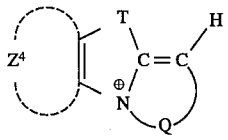

(A)

wherein T, Q and $Z^4$ are as defined in formula (V).

Examples of the method for the synthesis of the compound of formula (V) are given below.

SYNTHESIS EXAMPLE 6

Synthesis of Compound V-2

15.9 g of 2,3,3-trimethylindolenine was added dropwise to 100 ml of 1,3-dibromopropane with stirring over a steam bath in 15 minutes. The material was further heated with stirring for 4 hours and 20 minutes. The reaction solution was cooled with water. The resulting crystal was filtered off, washed with acetone, and then dried to obtain 11.6 g of 1-(3-bromopropyl)-2,3,3-trimethylindolenium bromide in the form of colorless tabular crystal.

To 3.6 g of the crystal thus obtained were then added 50 ml of ethanol and 4.2 ml of triethylamine. The material was then heated under reflux for 2 hours and 40 minutes. To the reaction mixture were then added 1.4 g of 1,7-diphenyl-1,7-diaza-1,3,5-heptatriene and 1.25 ml of acetic anhydride. The material was then stirred with occasional heating for 2.5 hours. To the reaction solution was then added 20 ml of ethyl acetate. The reaction solution was then poured into 1 l of water. The resulting crystal was filtered off, and then washed with ethyl acetate to obtain 1.5 g of a yellowish green crystal. The crystal thus obtained was dissolved in 150 ml of isopropyl alcohol, filtered out, and then recrystallized from hexane.

The crystal was filtered off, and then washed with a 1:1 mixture of isopropyl alcohol and hexane to obtain 0.9 g of a metallic lustrous crystal. 0.8 g of the crystal thus obtained was then dissolved in methanol. To the solution was then added 1 ml of a 60% aqueous solution of perchloric acid. The resulting crystal was filtered off, washed with methanol, and then dried to obtain 0.9 g of Compound V-2.

Melting point: 288.5°–291° C. (metallic lustrous yellowish green crystal)

SYNTHESIS EXAMPLE 7

Synthesis of Compound V-12

The synthesis was conducted in the same manner as in Synthesis Example 2 except that instead of being dissolved in methanol, and then subjected to salt formation with the addition of a 60% aqueous solution of perchloric acid, 0.8 g of the crude crystal was dissolved in 25 ml of acetic acid. A solution of 1 g of sodium phosphomolybdate ($Na_3PO_4.12MoO_3$) in 50 ml of acetic acid was added to the solution which was then stirred. The resulting crystal was filtered off, washed with acetic acid, methanol and then ethyl acetate, and then dried in vacuo to obtain 0.5 g of Compound V-12.

Preferred examples of the infrared absorbing dye having a pyrocoline nucleus of formula (VI) to be used in the present invention (hereinafter referred to as "pyrocoline dye") include those represented by the following formulae (a'), (b') and (c'):

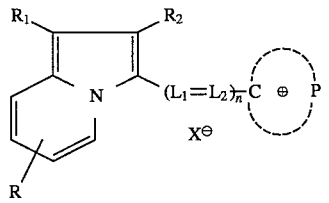

(a')

-continued (b')

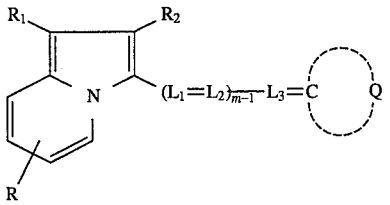

(c')

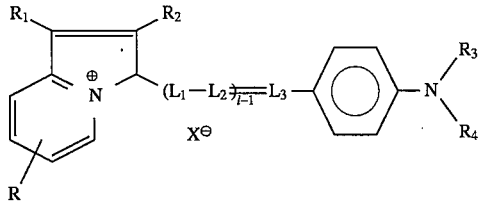

In formula (a'), R, $R_1$, and $R_2$ are as defined in formula (VI), $L_1$ and $L_2$ each represents a methine group which may be substituted, n represents an integer 1, 2 or 3, P represents an atomic group necessary for the formation of a heterocycle, and $X^-$ represents an anion.

In formula (b'), R, $R_1$, and $R_2$ are the same as defined in formula (VI), $L_1$, $L_2$ and $L_3$ each represents a methine group which may be substituted, m represents an integer 1, 2 or 3, and Q represents an atomic group necessary for the formation of a heterocycle. In formula (c'), R, $R_1$, and $R_2$ are the same as defined in formula (VI), $L_1$, $L_2$ and $L_3$ each represents a methine group which may be substituted, 1 represents an integer 1 or 2, $R_3$ and $R_4$ each represents a hydrogen atom, alkyl group or aryl group, and $X^-$ represents an anion.

In preferred examples of the compound represented by formula (a'), (b') or (c'), R represents a hydrogen atom, $C_{1-20}$ alkyl group (e.g., methyl, ethyl, butyl, dodecyl, octadecyl, benzyl), $C_{6-18}$ aryl group (e.g., phenyl, tolyl, p-methoxyphenyl), $C_{1-18}$ alkoxy group (e.g., methoxy, ethoxy, butoxy, dodecyloxy, benzyloxy), halogen atom (e.g., fluorine, chlorine, bromine, iodine) or phenyl group condensed with a pyridine ring (e.g., 5,6-benzo, 6,7-benzo, 7,8-benzo condensed ring).

$R_1$ and $R_2$ each represents a $C_{1-20}$ alkyl group (e.g., methyl, ethyl, isopropyl, butyl, dodecyl, benzyl) or $C_{6-20}$ aryl group (e.g., phenyl, p-tolyl, p-methoxyphenyl, p-acetamidophenyl, p-myristoylaminophenyl). $R_2$ may also represented a hydrogen atom.

$R_3$ and $R_4$ each represents a hydrogen atom, $C_{1-16}$ alkyl group (e.g., methyl, ethyl, hexyl, ethoxycarbonylmethyl, 2-cyanoethyl, 2-methoxyethyl, 2-chloroethyl, 2-hydroxyethyl, 2-myristoyloxyethyl, benzyl, 4-chlorobenzyl, 4-isopropylbenzyl) or $C_{6-10}$ aryl group (e.g., phenyl, naphthyl, 4-tolyl).

$L_1$, $L_2$ and $L_3$ each represents a methine group which may be substituted by substituents. Examples of such substituents include lower alkyl group (e.g., methyl, ethyl), aryl group (e.g., phenyl), and halogen atoms (e.g., chlorine). These substituents may form a 5- Or 6-membered ring.

P represents an atomic group necessary for the formation of a basic heterocycle (e.g., indolenine, oxazole, benzoxazole, imidazole, benzoimidazole, thiazole, benzothiazole, selenazole, benzoselenazole, naphthoxazole, naphthothiazole, naphthoimidazole, naphthoindolenine).

Q represents an atomic group necessary for the formation of a heterocycle which may form an acidic nucleus (e.g., indanedione, isoxazolone, pyrazolone, barbituric acid, thiobarbituric acid, hydroxypyridone) or heterocycle which may form a basic nucleus (e.g., pyrrole, indole, pyrocoline).

$X^-$ represents an anion such as chloride and bromide ion.

Preferred examples of the compounds represented by formula (VI) are given below:

VI-1

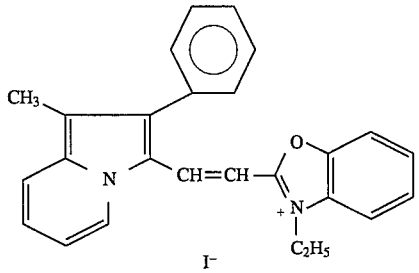

VI-2.

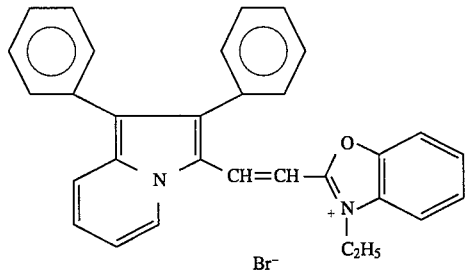

-continued
VI-3.
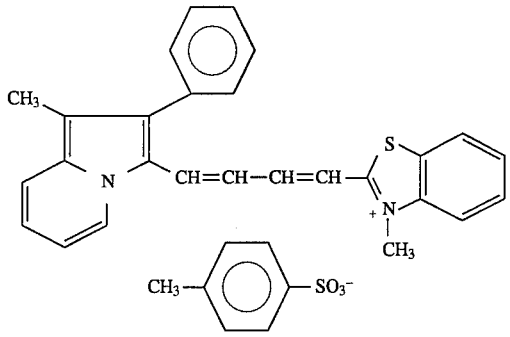
VI-4.
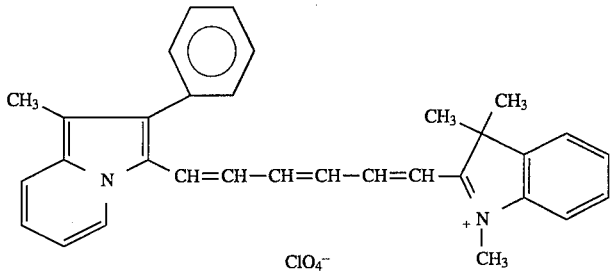
VI-5.
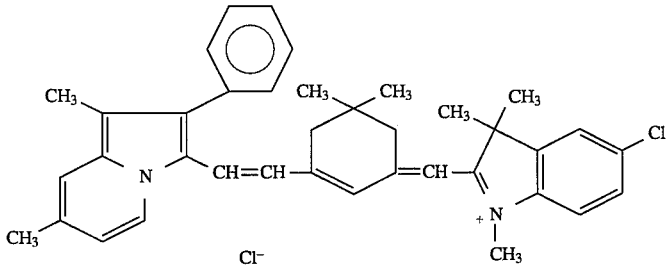
VI-6.
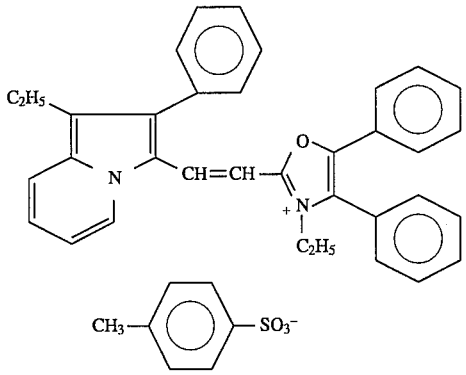
VI-7.
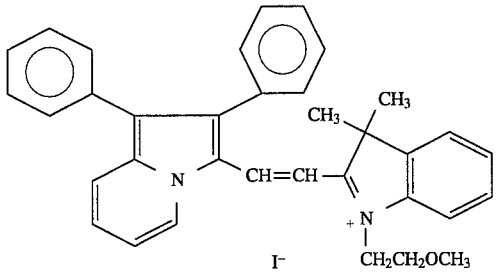

-continued
VI-8.
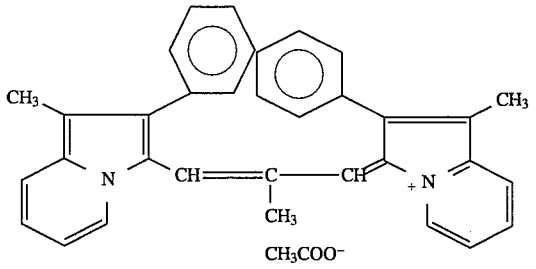
VI-9.
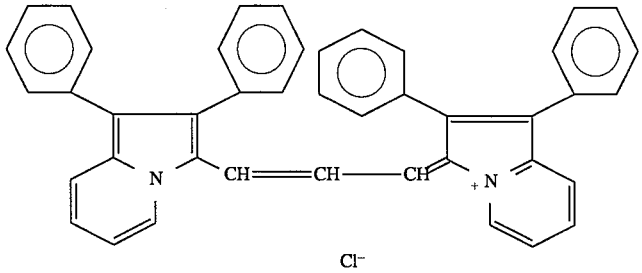
VI-10.
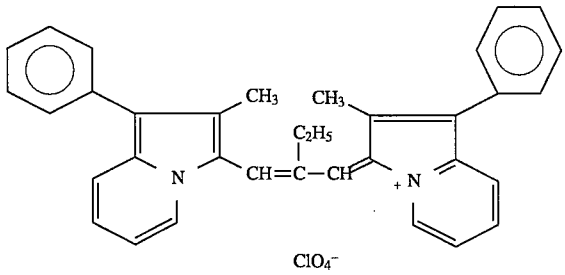
VI-11.
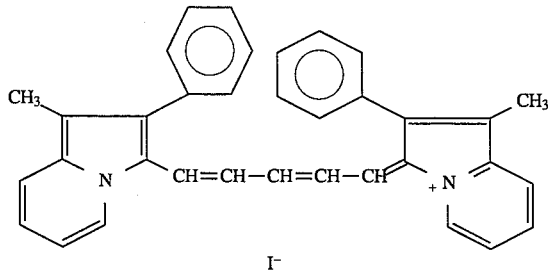
VI-12.
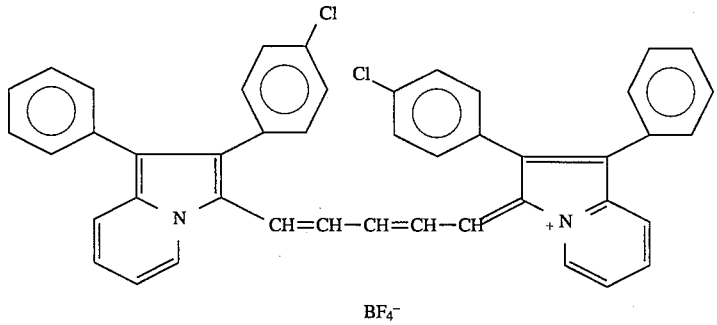
VI-13.
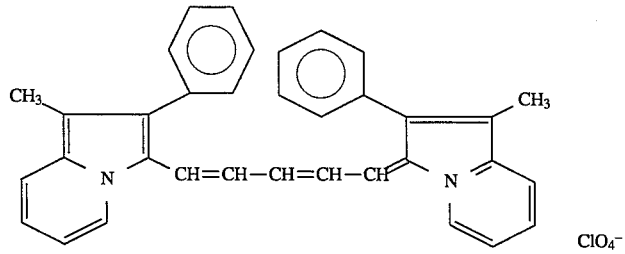

-continued
VI-14.
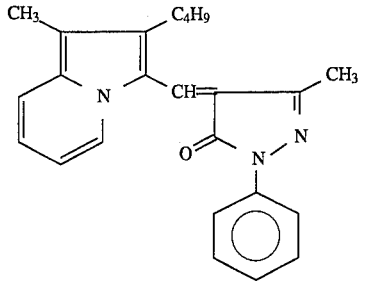
VI-15.
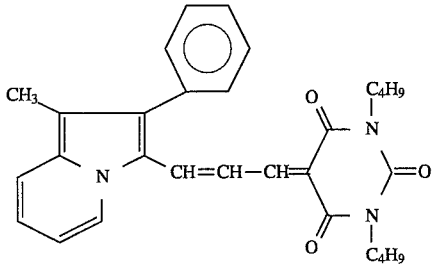
VI-16.
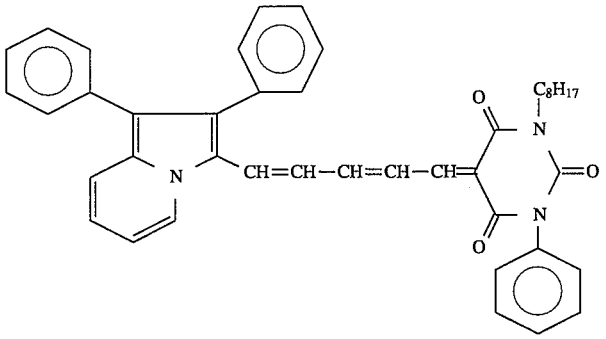
VI-17.
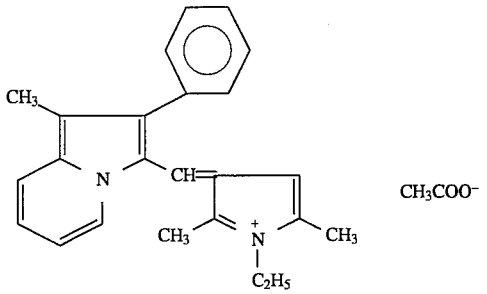
VI-18.
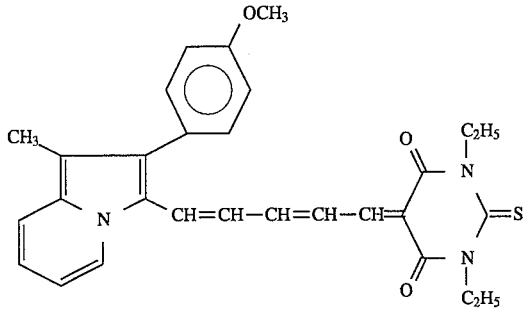

-continued
VI-19.
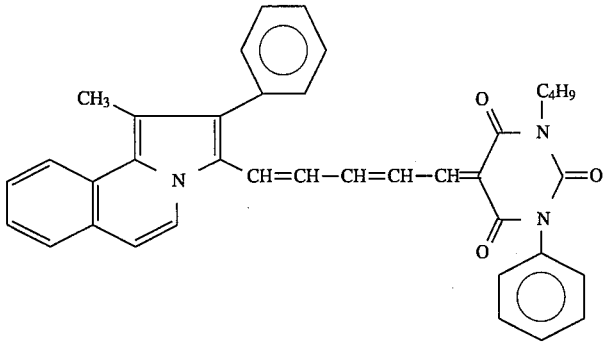
VI-20.
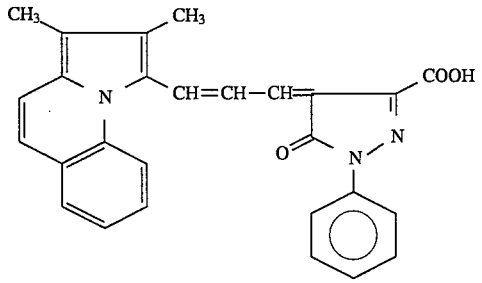
VI-21.
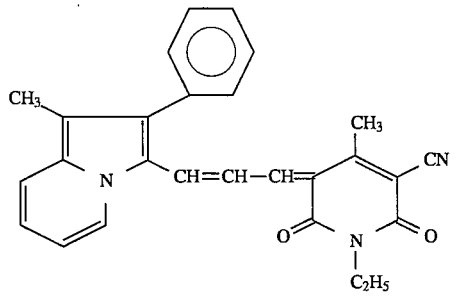
VI-22.
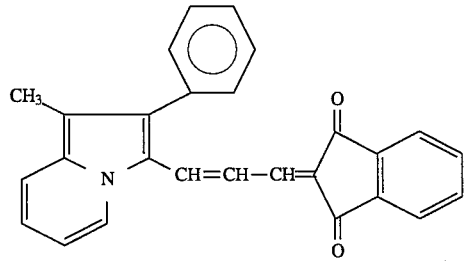
VI-23.
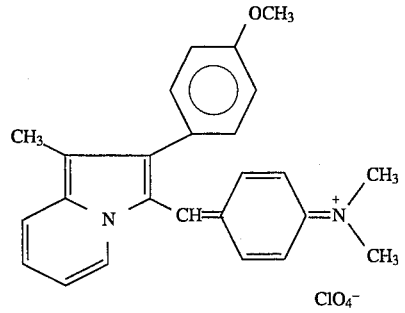

-continued

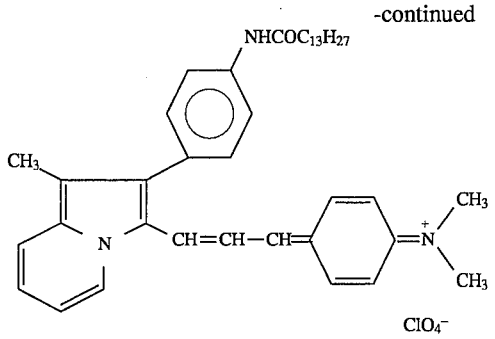

VI-24.

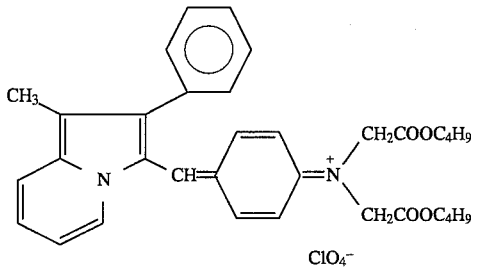

VI-25.

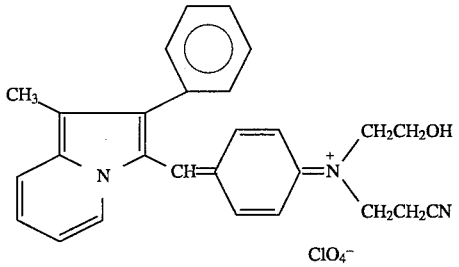

VI-26.

The pyrocoline dye to be used in the present invention can be synthesized by a method as disclosed in W. L. Mosby, "Heterocyclic Systems with Bridge-Head Nitrogen Atoms; Part I", Interscience Publishers, 1961 or U.S. Pat. No. 3,260,601.

Typical examples of the synthesis of pyrocoline dyes to be used in the present invention are given below.

SYNTHESIS EXAMPLE 8

Synthesis of Compound VI-15

2.5 g of 1-methyl-2-phenylpyrocoline and 1.7 g of 1,7-diaza-1,3,5-heptatriene were added to 30 ml of methanol. The material was then heated to a temperature of 50° C. with stirring. To the material was then added 1 ml of acetic anhydride. The material was then heated to a temperature of 50 to 60° C. for 2 hours. The material was then allowed to cool to room temperature. 3 ml of a 60% aqueous solution of perchloric acid was then added dropwise to the material. The resulting crystal was filtered off, washed with ethanol, and then dried to obtain 2.3 g of Compound VI-15.

Melting point: 231°–232° C. λmax (methanol): 810 nm

SYNTHESIS EXAMPLE 9

Synthesis of Compound VI-11

2.7 g of 1,2-diphenylpyrocoline and 1.5 ml of β-methoxyacroleinacetal were added to 50 ml of ethanol. To the material was then added 1.5 ml of concentrated sulfuric acid. The material was then heated to a temperature of 40° to 50° C. for about 30 minutes. The material was then cooled. The resulting crystal was filtered off, washed with ethanol, and then dried to obtain 1.7 g of Compound VI-11.

Melting point: 232°–235° C. (decomposition) λmax (methanol): 708 nm

Preferred examples of the infrared absorbing dye having a pyrocoline nucleus of formula (VII) to be used in the present invention (hereinafter referred to as "pyrocoline dye") include those represented by the following general formulae (a"), (b") and (c"):

(a")

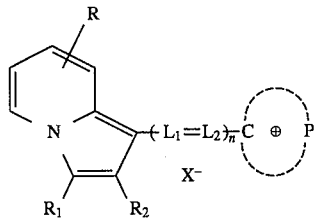

(b")

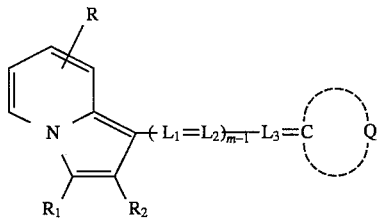

-continued

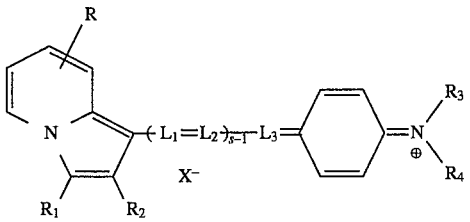

(c")

In formula (a"), R, $R_1$ and $R_2$ are the same as defined in formula (VII), $L_1$ and $L_2$ each represents a methine group which may be substituted, n represents an integer 2 or 3, P represents an atomic group necessary for the formation of a 5- or 6-membered heterocycle, and $X^-$ represents an anion.

In formula (b"), R, $R_1$ and $R_2$ are the same as defined in formula (VII), $L_1$, $L_2$ and $L_3$ each represents a methine group which may be substituted, m represents an integer 2 or 3, and Q represents an atomic group necessary for the formation of a 5- or 6-membered heterocycle.

In formula (c), R, $R_1$ and $R_2$ are the same as defined in formula (VII), $L_1$, $L_2$ and $L_3$ each represents a methine group which may be substituted, s represents an integer 2 or 3, $R_3$ and $R_4$ each represents a hydrogen atom, alkyl group or aryl group, and $X^-$ represents an anion.

More particularly, in preferred examples of the compound represented by formula (a"), (b") or (c"), R represents a hydrogen atom, a halogen atom (e.g., chlorine, fluorine) $C_{1-10}$ alkyl group (e.g., methyl, ethyl, butyl), $C_{1-10}$ alkoxy group (e.g., methoxy, ethoxy, butoxy, methoxyethoxy), $C_{6-20}$ aryl group (e.g., phenyl, tolyl, m-chlorophenyl, p-methoxyphenyl) or benzene ring condensed with pyridine ring (e.g., 5,6-benzo, 6,7-benzo, 7,8-benzo).

$R_1$ and $R_2$ each independently represents a hydrogen atom, $C_{1-10}$ alkyl group (e.g., methyl, ethyl, butyl, benzyl) Or $C_{6-20}$ aryl group (e.g., phenyl, p-bromophenyl, p-acetylaminophenyl, p-methoxyphenyl, p-tolyl).

$L_1$, $L_2$ and $L_3$ each represents a methine group which may be substituted by substituents. Examples of such substituents include $C_{1-4}$ alkyl group (e.g., methyl, ethyl), phenyl group, and halogen atoms (e.g., chlorine). These substituents may form a 5- or 6-membered ring.

The suffixes n, m and s each represents an integer 2 or 3.

P represents an atomic group necessary for the formation of a basic heterocycle (e.g., oxazole, benzoxazole, naphthoxazole, thiazole, benzothiazole, naphthothiazole, selenazole, benzoselenazole, indolenine, benzoindolenine, imidazole, benzoimidzole).

Q represents an atomic group necessary for the formation of a heterocycle which may form an acidic nucleus (e.g., indanedione, isoxazolone, pyrazolone, barbituric acid, thiobarbituric acid, hydroxypyridone, pyrocoline).

$R_3$ and $R_4$ each represents a hydrogen atom or $C_{1-10}$ alkyl group (e.g., methyl, ethyl, hexyl, 2-ethoxycarbonylethyl, 2-chloroethyl, 2-methoxyethyl, 2cyanoethyl, 2-hydroxyethyl, 2-methanesulfonylaminoethyl). $R_3$ and $R_4$ may together form a 5- or 6-membered ring (e.g., morpholine, piperidine).

$X^-$ represents an anion, preferably $Cl^-$, $Br^-$, $I^-$, $CH_3COO^-$, $CH_3SO_4O^-$, $CF_3CO_2O^-$, $ClO_4^-$, $BF_4^-$, $PF_6^-$, $HSO_4^-$, toluenesulfonic ion, etc.

Specific examples (VII-1 to VII-30) of the dye to be used in the present invention are given below, but the present invention should not be construed as being limited thereto:

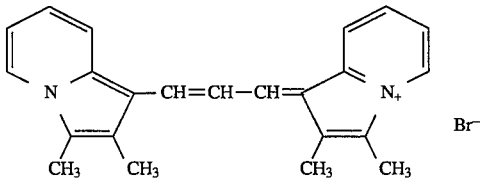

VII-1

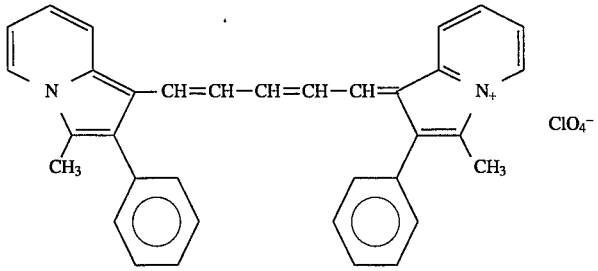

VII-2

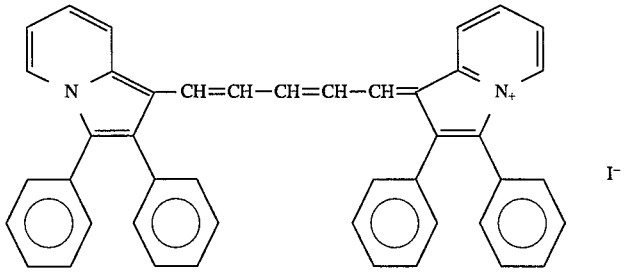

VII-3

-continued
VII-4
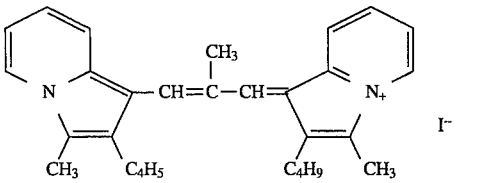
VII-5
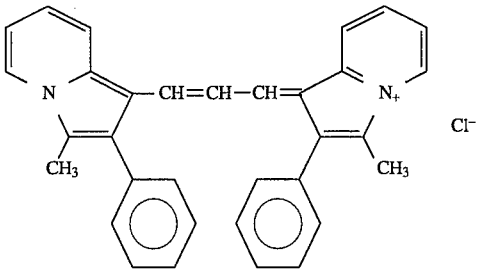
VII-6
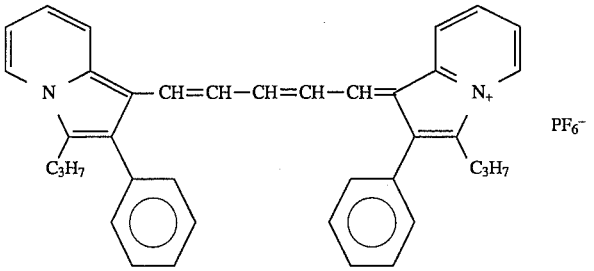
VII-7
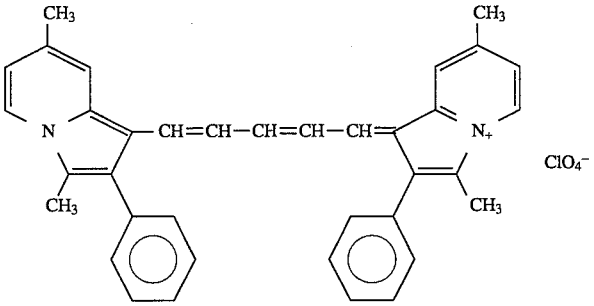
VII-8
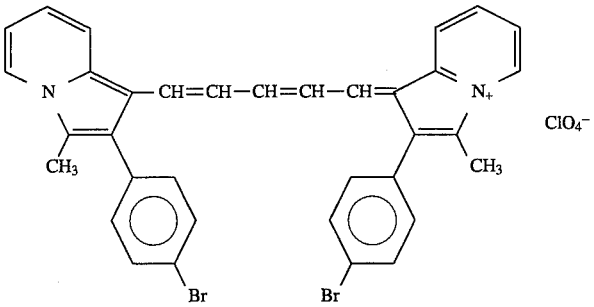
VII-9
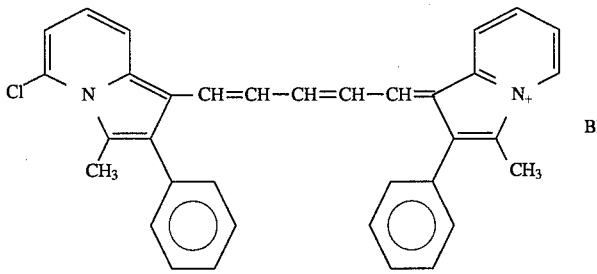

-continued
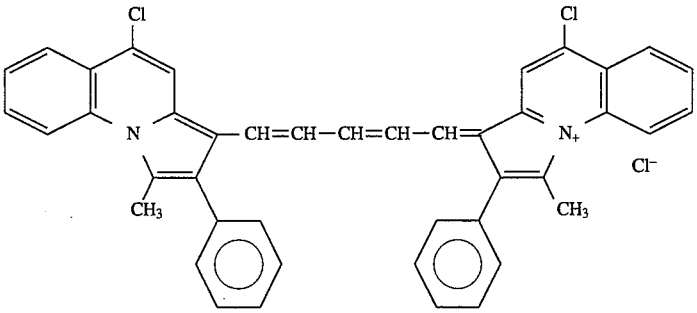
VII-10
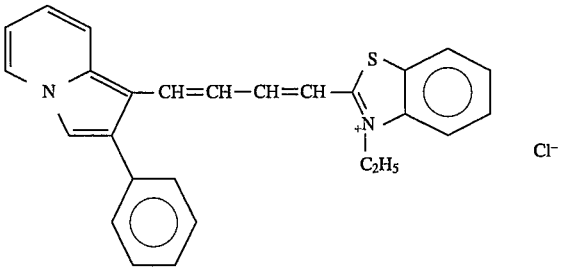
VII-11
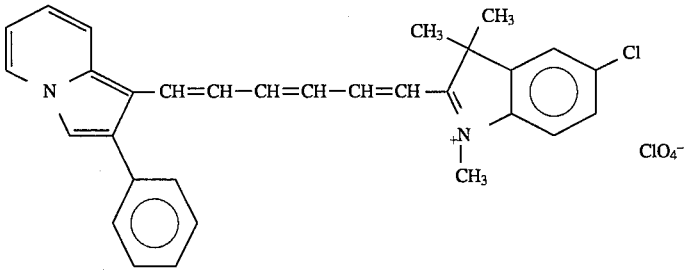
VII-12
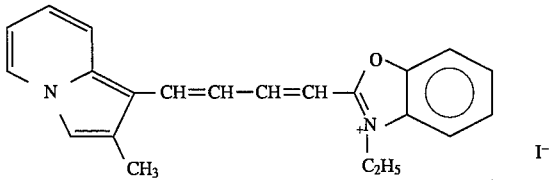
VII-13
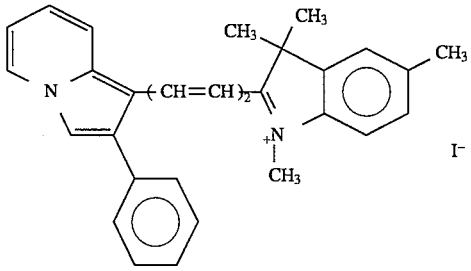
VII-14
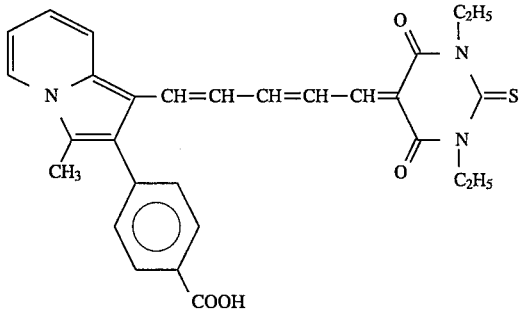
VII-15

-continued
VII-16
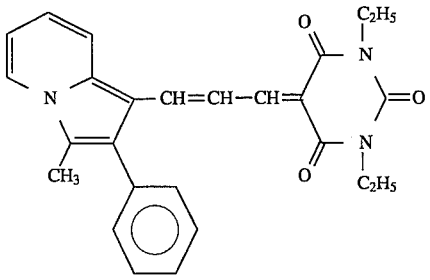
VII-17
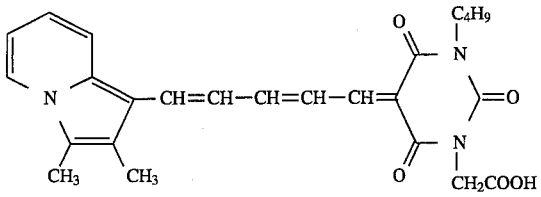
VII-18
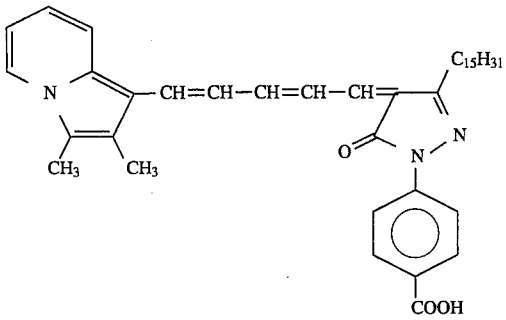
VII-19
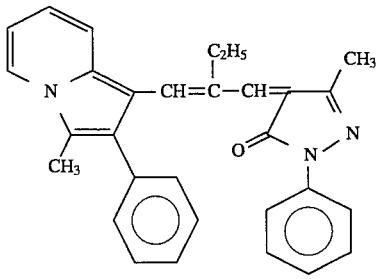
VII-20
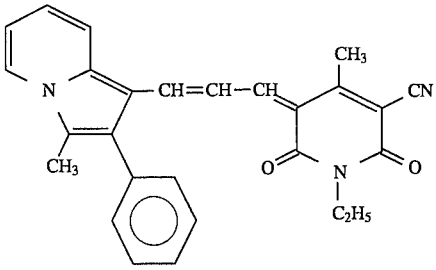
VII-21
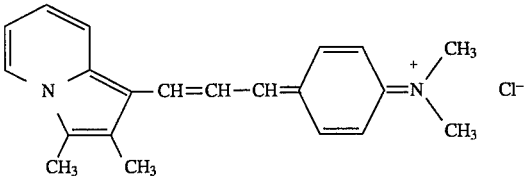

-continued
VII-22
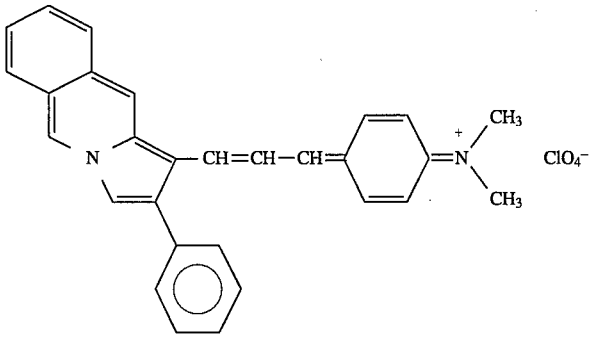
VII-23
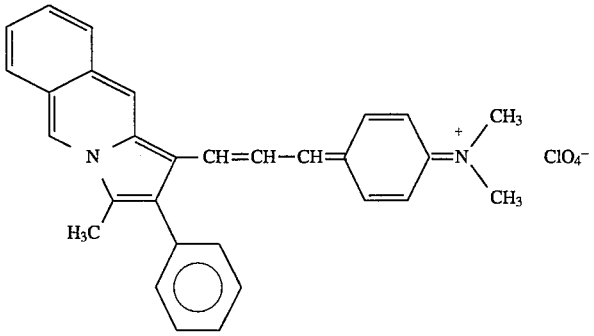
VII-24
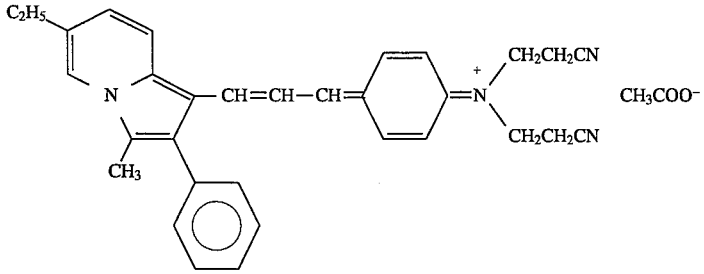
VII-25
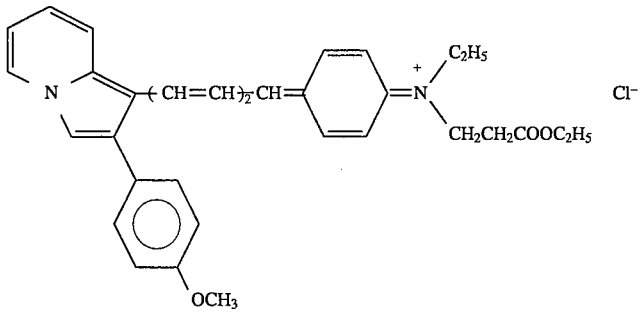
VII-26
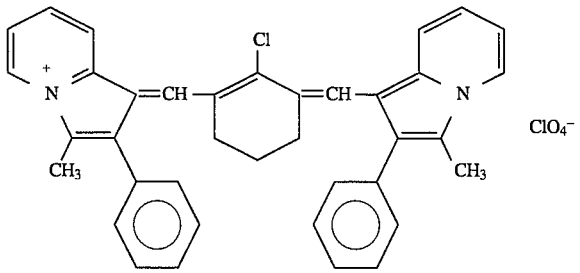

-continued

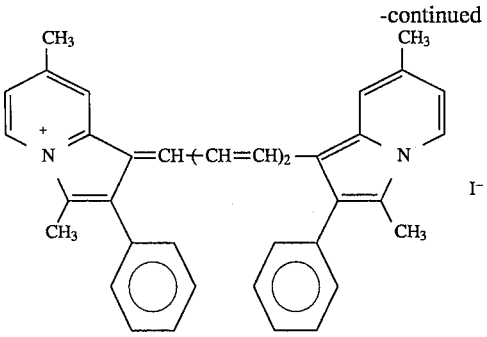

VII-27

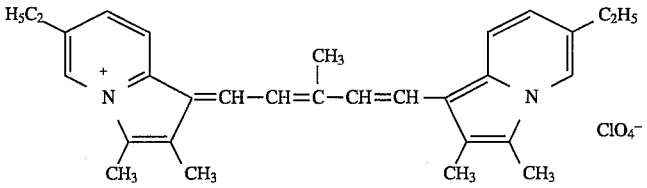

VII-28

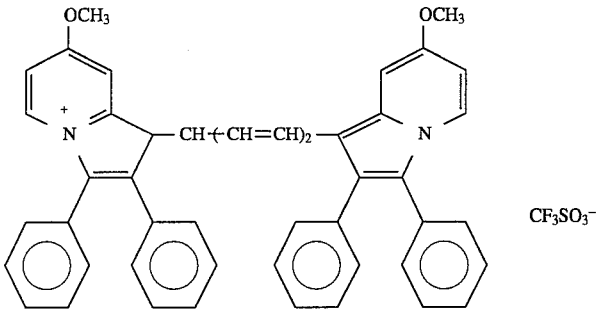

VII-29

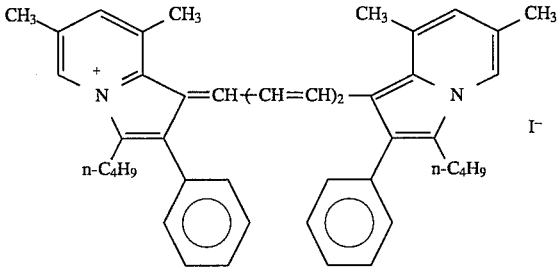

VII-30

The pyrocoline dye to be used in the present invention can be synthesized by a method as disclosed in W. L. Mosby, *Heterocyclic Systems with Bridgehead Nitrogen Atoms; Part I*, Interscience Publishers, 1961 or U.S. Pat. Nos. 2,409,612, 2,511,222, 2,571,775, 2,622,082, and 2,706,193.

Examples of the synthesis of the compounds of formula (VII) to be used in the present invention are given below.

SYNTHESIS EXAMPLE 10

Synthesis of Compound VII-5

2.1 g of 2-phenyl-3-methylpyrocoline and 1.5 ml of 1,3,3-trimethoxypropene were mixed with 15 ml of ethanol. The material was then heated to a temperature of 40° C. to make a solution. To the mixture was then added 1.5 ml of concentrated sulfuric acid. The material was then heated under reflux for 10 to 15 minutes. The reaction mixture was then cooled to a temperature of 0° C. The resulting crystal was recovered, washed with cold ethanol, and then dried to obtain 2.2 g of Compound VII-5.

Melting point: 201°–203° C. λmax (methanol): 655 nm

SYNTHESIS EXAMPLE 11

Synthesis of Compound VII-2

2.5 g of 2-phenyl-3-methylpyrocoline and 1.7 g of glutaconedialdehydodianyl hydrochloride were added to 30 ml of methanol. To the mixture was then added dropwise 3 ml of acetic anhydride. The material was then heated under reflux: for about 30 minutes. The mixture was then cooled to a temperature of 0° C. 3 ml of an aqueous solution of perchloric acid was added dropwise to the material with stirring. The resulting crystal was recovered, washed with methanol, and then dried to obtain 2.8 g of Compound VII-2.

Melting point: 210°–213° C. λmax (methanol): 748 nm

Particularly preferred examples of the compounds of formula (VIII) are compounds represented by formula (VIIIa):

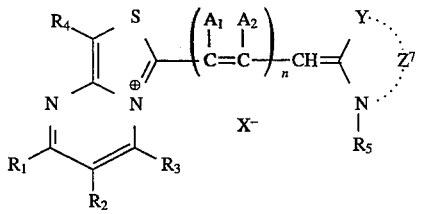

(VIIIa)

wherein $A_1$ and $A_2$ each independently represents a hydrogen atom, halogen atom, substituted or unsubstituted alkoxy group, substituted or unsubstituted aryloxy group, cyano group, substituted or unsubstituted alkyl group, substituted or substituted aryl group, or substituted or unsubstituted aralkyl group; Y represents $NR_6$ (in which $R_6$ represents a substituted or unsubstituted alkyl group, substituted or unsubstituted aryl group, or substituted or unsubstituted aralkyl group), O, S, Se or Te; $Z^7$ represents an atomic group necessary for the formation of a 5-membered heterocycle; $R_1$, $R_2$, $R_3$ and $R_4$ each represents a substituted or unsubstituted alkyl group, substituted or unsubstituted aryl group, substituted or unsubstituted aralkyl group or hydrogen atom; $R_5$ represents a substituted or unsubstituted alkyl group, substituted or unsubstituted aryl group, substituted or unsubstituted aralkyl group, or atomic group necessary for the formation of a 6-membered heterocycle with $Z^7$; n represents an integer 0, 1 or 2; and X represents an anion, with the proviso that X may be connected to $R_1$, $R_2$, $R_3$, $R_4$, $R_5$, $R_6$, $Z^7$, $A_1$ or $A_2$ to form an inner salt.

The compound represented by formula (VIIIa) is further described hereinafter.

Preferred among the groups represented by $A_1$ or $A_2$ are a hydrogen atom, chlorine atom, $C_{1-20}$ substituted or unsubstituted alkyl group, $C_{6-20}$ substituted or unsubstituted phenyl group, $C_{7-20}$ substituted or unsubstituted benzyl group, $C_{1-20}$ substituted or unsubstituted alkoxy group, $C_{6-20}$ substituted or unsubstituted phenoxy group, and $C_{7-20}$ substituted or unsubstituted benzyloxy group. Preferred examples of substituents for these substituted groups represented by $A_1$ or $A_2$ include a halogen atom (e.g., F, Cl, Br, I), cyano group, alkoxy group, aryloxy group, ester group, carbonamido group, sulfonamido group, carbamoyl group, sulfamoyl group, ureido group, sulfonyl group, hydroxyl group, sulfo group, and carboxyl group. These substituents may further be substituted. Particularly preferred among the groups represented by $A_1$ or $A_2$ are a hydrogen atom, chlorine atom, $C_{1-6}$ alkyl group, phenyl group, benzyl group, and $C_{1-6}$ alkoxy group or phenoxy group.

Preferred among the groups represented by Y are O, S, Se, Te, and $C_{1-20}$ $NR_6$ in which $R_6$ represents a substituted or unsubstituted alkyl group, substituted or unsubstituted phenyl group or substituted or unsubstituted benzyl group. Preferred examples of substituents for the substituted alkyl, phenyl or benzyl group represented by R6 include those described with reference to $A_1$ and $A_2$.

Particularly preferred among the groups represented by Y are O, S, Se, Te, and $NR_6$ wherein $R_6$ is a $C_{1-6}$ alkyl, phenyl or benzyl group.

Preferred among the atomic groups represented by $Z^7$ is an atomic group necessary for the formation of a benzoazole ring or naphthoazole ring or —(CH=CH)$_2$—which may be substituted by groups described as preferred examples for the group represented by $A_1$ or $A_2$. Particularly preferred among the atomic groups represented by $Z^7$ are —(CH=CH)$_2$—, —(CH=CH)$_2$— substituted by a halogen atom (e.g., F, Cl, Br, I), $C_1$-6 alkyl or phenyl group, $C_{6-12}$ substituted phenyl group, $C_{1-6}$ alkoxy group, $C_{6-20}$ substituted or unsubstituted phenoxy group, $C_{1-20}$ carbonamido group, $C_{1-20}$ sulfonamido group or $C_{1-20}$ ureido group, and atomic group which may be connected to $R_5$ to form a condensed pyrimidine ring.

Preferred among the groups represented by $R_1$, $R_2$, $R_3$ and $R_4$ are a $C_{1-20}$ substituted or unsubstituted alkyl group, $C_{6-20}$ substituted or unsubstituted phenyl group, $C_{7-20}$ substituted or unsubstituted benzyl group, and hydrogen atom. Examples of substituents for these substituted alkyl, phenyl and benzyl groups represented by $R_1$, $R_2$, $R_3$ and $R_4$ include those described as preferred substituents for the groups represented by $A_1$ or $A_2$. Particularly preferred among the groups represented by $R_1$ and $R_3$ are a $C_{1-12}$ substituted or unsubstituted alkyl group and $C_{6-12}$ substituted or unsubstituted phenyl group. Particularly preferred among the groups represented by $R_2$ are a hydrogen atom, $C_{1-20}$ alkyl group, and $C_{6-20}$ substituted or unsubstituted phenyl group. Particularly preferred among the groups represented by $R_4$ are a phenyl group and $C_{6-20}$ substituted phenyl group.

Preferred among the substituents represented by $R_5$ are a $C_{1-20}$ substituted or unsubstituted alkyl group, $C_{6-20}$ substituted or unsubstituted phenyl group, $C_{7-20}$ substituted or unsubstituted aralkyl group, and an atomic group necessary for the formation of a condensed pyrimidine ring with $Z^7$. Preferred examples of substituents for these substituted alkyl, phenyl and aralkyl groups represented by $R_5$ include those listed above for $A_1$ and $A_2$.

Particularly preferred among the substituents represented by $R_5$ are a $C_{1-20}$ alkyl group, $C_{2-4}$ sulfoalkyl group, phenyl group, sulfophenyl group, benzyl group, sulfobenzyl group, phenethyl group, sulfophenethyl group, and an atomic group (—$CR_3$=$CR_2$—$CR_1$=N—) necessary for the formation of a condensed pyrimidine ring with $Z^7$.

The value of n depends on the wavelength of the light used for exposure of photographic light-sensitive material. That is, when the wavelength of the light source is longer a larger value of n is preferred because the absorption wavelength range of the dye shifts to a longer wavelength range as the value of n is larger. For example, when light of 700 nm to 900 nm is used, n is 2. When light of 600 nm to 850 nm, in particular, when light of 660 nm to 800 nm is used, n is 1. When light of 500 nm to 650 nm, in particular, light of 540 nm to 560 nm is used, n is preferably 0.

Preferred examples of the anion represented by X include a halide ion, sulfate ion, monoalkylsulfate ion, perchlorate ion, sulfonate ion, carbonate ion, nitrate ion, acetate ion, benzoate ion, oxalate ion, phosphorate ion, tetraphenylborate ion, and tetrafluorophosphorate ion.

Particularly preferred among the anions represented by X are a bromine ion, iodine ion, sulfate ion, monoalkylsulfate ion, perchlorate ion, alkylsulfonate ion, and arylsulfonate ion.

Specific examples of the compound represented by formula (VIII) are given below, but the present invention should not be construed as being limited thereto:

VIII-1
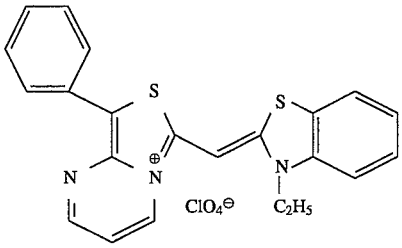
VIII-2.
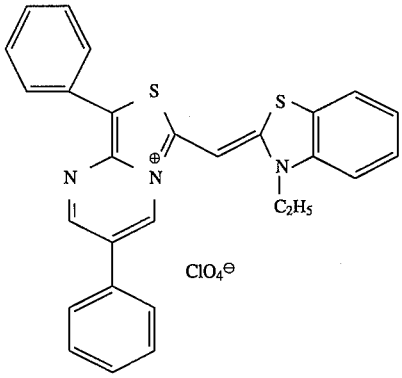
VIII-3.
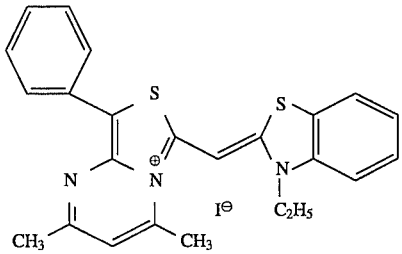
VIII-4.
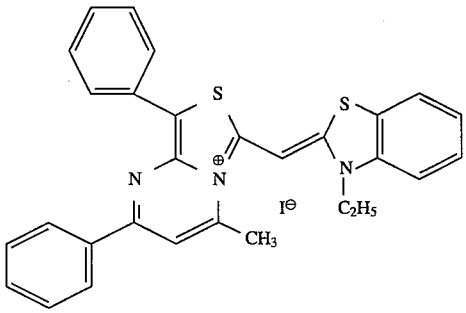
VIII-5.
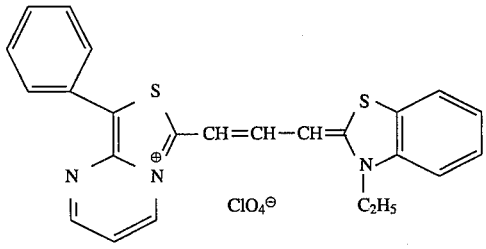

-continued
VIII-6.
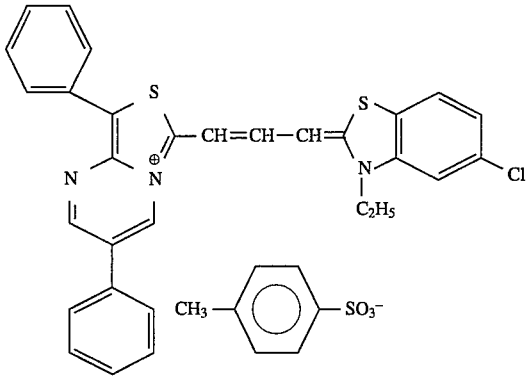
VIII-7.
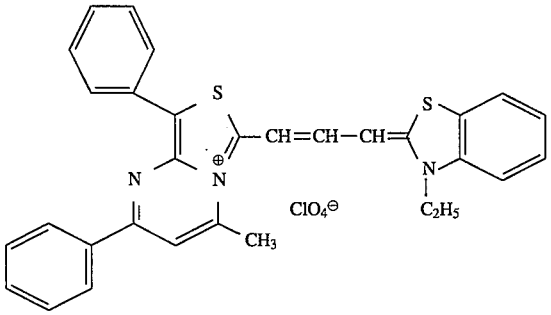
VIII-8.
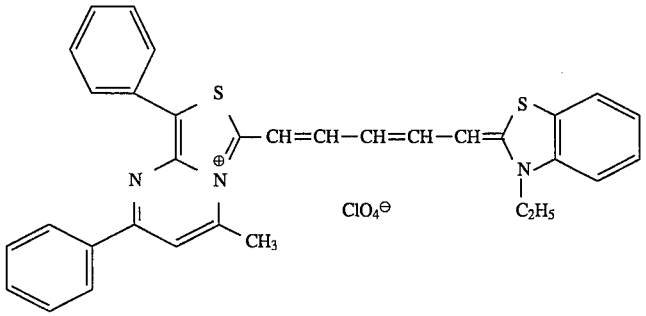
VIII-9.
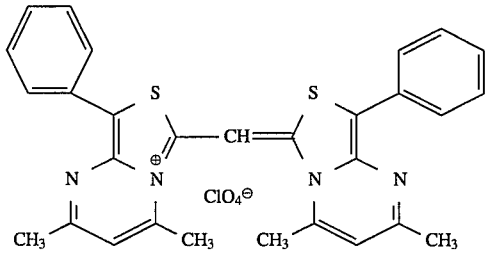
VIII-10.
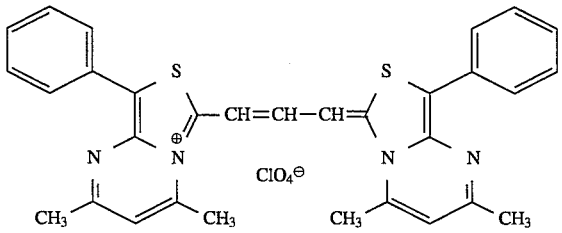

-continued
VIII-11.
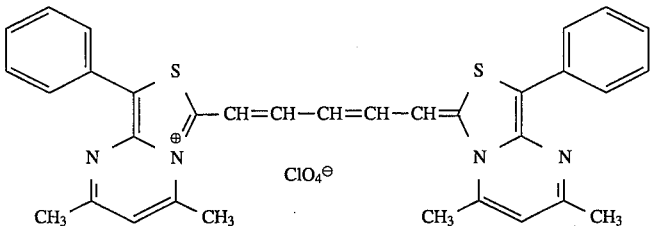
VIII-12.
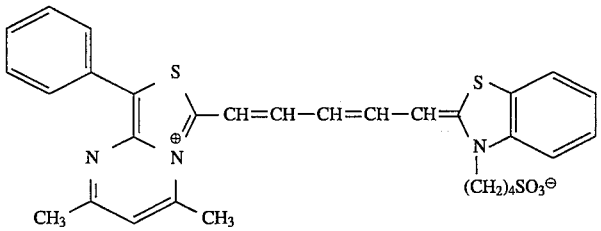
VIII-13.
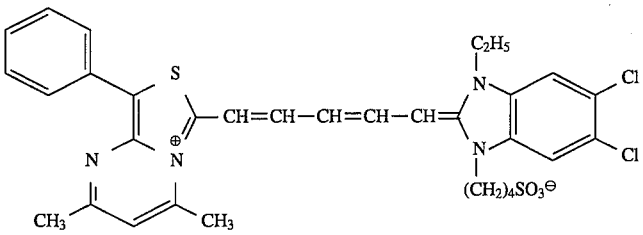
VIII-14.
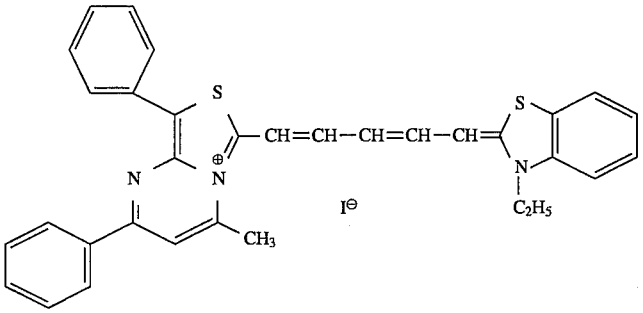
VIII-15.
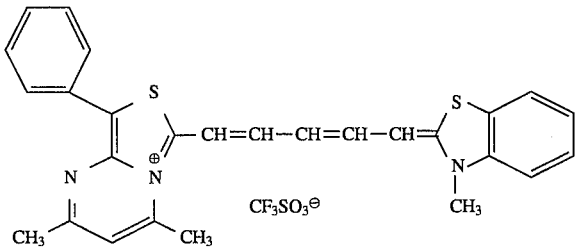
VIII-16.
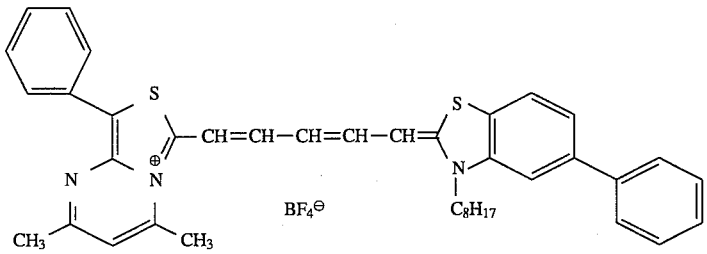

-continued
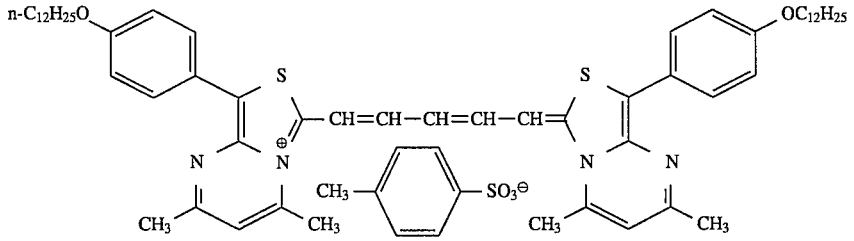
VIII-17.
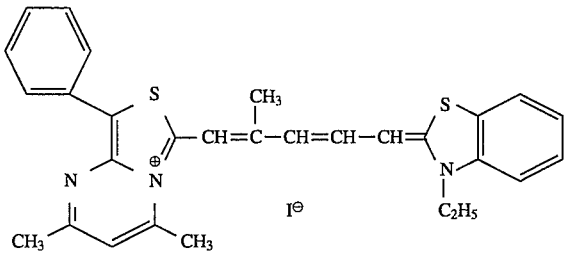
VIII-18.
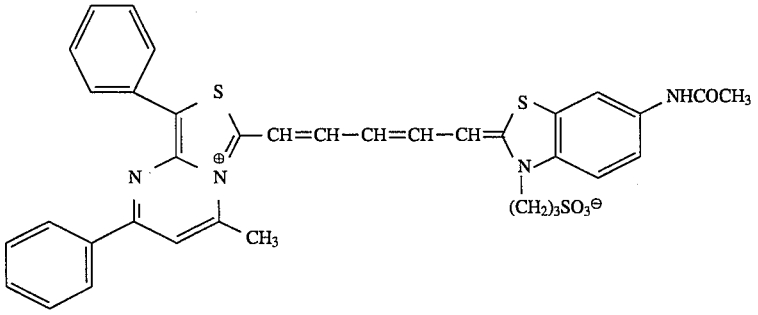
VIII-20.
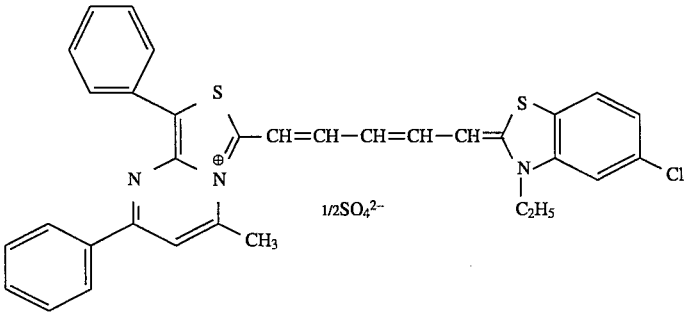
VIII-21.
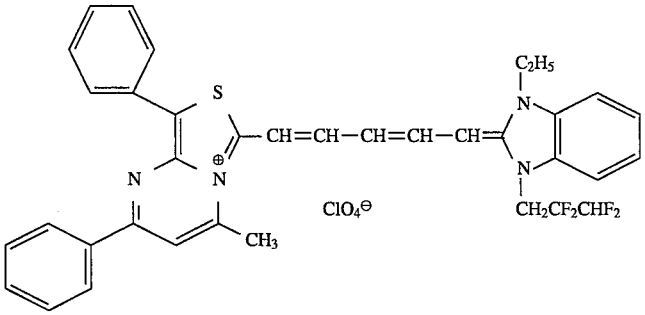
VIII-22.
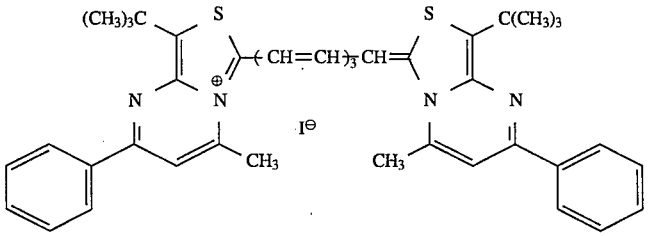

-continued

VIII-23.

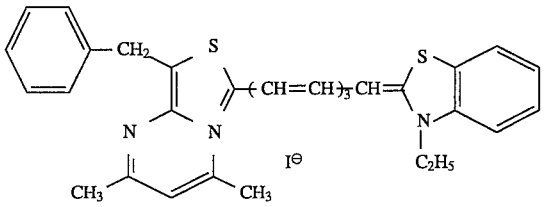

VIII-24.

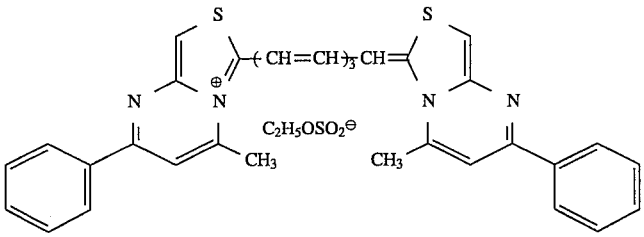

VIII-25.

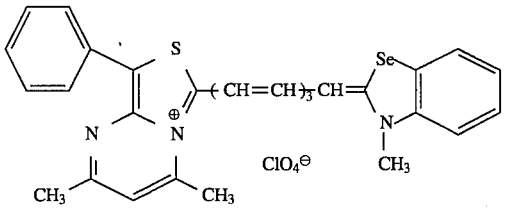

VIII-26.

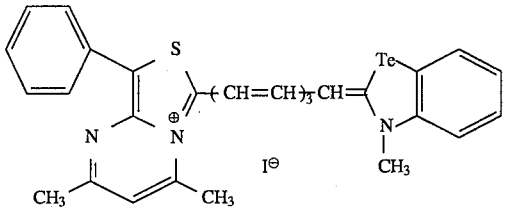

VIII-27.

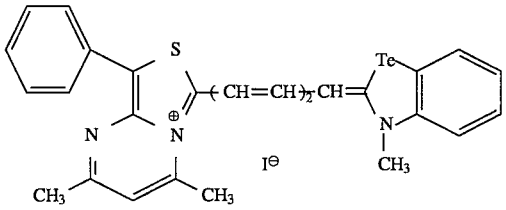

The synthesis of the compound represented by formula (VIII) is described in, e.g., G. G. Dyadyusha et al.'s report, *Dyes and Pigments*, vol. 4, pp. 179–194, 1983. Various derivatives of the compound represented by formula (VIII) can be synthesized in accordance with this method. Examples of the synthesis method are given below.

SYNTHESIS EXAMPLE 12

Synthesis of Compound VIII-8

0.43 g of 3-ethyl-2-(4-acetanilide-1,3-butadienyl)benzothiazolium perchlorate was dissolved in 5 ml of ethanol. To the solution was then added a solution of 0.35 g of 4,6-dimethyl-2,8-diphenylthiazolo[3,4-a]-pyrimidinium perchlorate in 3 ml of acetonitrile. 0.1 g of triethylamine was then added to the solution while the latter was heated under reflux. The resulting dye precipitate was filtered off, and then recrystallized from acetonitrile. (Yield: 0.21 g; melting point: 200 to 201° C.; absorption spectrum of acetonitrile solution: λmax=790 nm, logεmax=4.91)

SYNTHESIS EXAMPLE 13

Synthesis of Compound VIII-10

A mixture of 0.35 g of 2,4,6-trimethyl-8-phenylthiazolo[3,4-a]pyrimidinium perchlorate, 0.25 g of diphenylformamidine, and 3 ml of acetic anhydride was heated to a temperature of 110° C for 1 hour. To the material was then added ether. The resulting precipitate pitate was washed with ethanol, and then recovered by filtration. To the material were then added 0.35 g of 2,4,6-trimethyl-8-phenylthiazolo[3,4-a]pyrimidinium perchlorate and 2 ml of acetic anhydride. The material was then heated to its boiling point. To the material was then added 0.1 g of triethylamine. The resulting dye precipitate was then recovered by filtration. (Yield: 0.11 g; melting point: 243° to 244° C.; absorption spectrum in acetonitrile: λmax=805 nm, logεmax=4.76)

SYNTHESIS EXAMPLE 14

Synthesis of Compound VIII-11

A mixture of 0.75 g of 2,4,6-trimethyl-8-phenylthiazolo[3,4-a]pyrimidinium perchlorate, 0.26 g of (3-anilino-2-propenilidene)phenylammonium chloride, and 5 ml of acetic anhydride was heated to its boiling point. To the solution was added 0.1 g of triethylamine. The resulting dye crystal was then recovered by filtration. (Yield: 0.14 g; melting point: 269 to 297° C.; absorption spectrum in acetonitrile: λmax=895 nm, logεmax=4.92)

The dye represented by formula (VIII) was found to be excellent particularly in heat resistance, moisture resistance and light resistance as compared with conventional cyanine dyes having similar absorption wavelength maxima. The reason is unknown. Taking into account the general tendency that the longer the length of the methine chain in the cyanine dye, the lower the storage stability of the cyanine dye, the dye represented by formula (VIII) can have a shorter methine chain than the conventional cyanine dyes, but still exhibit the same absorption wavelength maxima as the conventional cyanine dyes. This is a possible reason why the dye represented by formula (VIII) exhibits a higher stability than conventional cyanine dyes.

The amount of the compound represented by formula (I), (II), (III), (IV), (V), (VI), (VII) or (VIII) to be incorporated into the photographic material is from 100 mg to 10 g, preferably 50 mg to 20 g.

The time at which the compound of the present invention is added to the system may be any point during the preparation of the raw emulsion or may be between the completion of the dissolution of the raw emulsion and before the coating thereof. These methods may be used in combination. The compound of the present invention is added to the system, for example, in the form of its solution in water or in a water-miscible solvent such as methanol or in the form of a dispersion prepared by mechanically dispersing fine powders of the compound in water or an aqueous gelatin.

The grain size of the silver halide grains to be used in the present invention is particularly preferably in the range of 0.10 μm to 0.40 μm. If the grain size of the silver halide grains is too large, the silver halide grains exhibit a deteriorated graininess, a poor reversibility and a high Dmin. On the other hand, if the grain size of the silver halide grain is too small, the silver halide grains cannot exhibit a desired Dmax and also exhibit poor reversibility and high Dmin. This tendency becomes remarkable particularly when a red-sensitive or infrared-sensitive desensitizing dye is used. Accordingly, there is an optimum grain size with photographic light-sensitive materials having such a sensitivity range.

In a high intensity short time exposure for $10^{-2}$ seconds or more, the grain size is important. In a low intensity exposure, Dmax and Dmin have little dependence on the grain size. In any grain size, a high development efficiency, a high Dmax and a low Dmin can be provided. However, in a high intensity exposure, there is an optimum grain size range.

On the other hand, the amount of gold compound such as chloroauric compound to be used in the fogging procedure after the rinsing procedure following the grain formation varies with the grain size or halogen composition but is normally in the range of 0.05 to 0.0005 mmol per mol of silver. If the amount of the gold compound is too large, Dmin is too high. On the contrary, if the amount of the gold compound is too small, Dmax cannot be sufficiently achieved.

In a high intensity exposure, pre-fogged photographic light-sensitive material comprising a desensitizing dye represented by formula (I), this phenomenon becomes remarkable. Thus, there is an optimum range of the amount of the gold compound.

The composition of silver halide grains to be used in the present invention is preferably silver bromochloride, silver bromide, silver bromochloroiodide or silver bromoiodide having a bromine content of 5 mol % or more. With silver chloride, an excellent reversibility cannot be provided.

The silver halide emulsion to be used in the present invention may be prepared by any method such as acidic process, neutral process and ammonia process. Examples of the silver halide emulsion thus prepared include silver bromide, silver chloride, silver bromochloride, silver bromoiodide, and silver bromochloroiodide.

The average grain diameter of silver halide grains to be used in the present invention is preferably in the range of 0.1 μm to 0.4 μm. The grain diameter frequency distribution may be wide or narrow, preferably narrow. In particular, a so-called monodisperse emulsion comprising silver halide grains 90% preferably 5% of which fall within the range of the average grain size ±40% preferably ±20% of the average grain size, is preferred. The silver halide grains to be used in the present invention may have a single crystal habit or a mixture of various crystal habits, preferably single crystal habit.

The substituted positive silver halide to be used in the present invention may comprise an inorganic desensitizer (e.g., noble metal atoms contained in silver halide grains) and an organic densensitizer to be adsorbed to the surface of silver halide grains, singly or in combination, in addition to the foregoing components.

In order to incorporate the inorganic desensitizer to be used into the present invention in the silver halide grains, a water-soluble noble metal such as chloride of the group VIII metals such as iridium, rhodium and ruthenium may be incorporated in the system in an amount of $10^{-7}$ to $10^{-2}$ mol, preferably $10^{-5}$ to $10^{-3}$ mol per mol of silver halide in the form of aqueous solution during the preparation of silver halide grains.

The fogging of the direct positive silver halide grains to be used in the present invention may be effected by any known method after the removal of water-soluble salts produced after the precipitation of silver halide grains. The fogging may be effected with a fogging agent (reducing agent), singly or in combination with a gold compound or useful metal compound which is electrically more positive than silver.

Typical examples of fogging agents useful in the preparation of such an emulsion include formaldehyde, hydrazine, polyamine (e.g., triethylenetetramine, tetraethylenepentamine), thiourea dioxide, tetra(hydroxymethyl)phosphonium chloride, amineborane hydrogenated boron compound, stannous chloride, and stannic chloride. Typical examples of useful metal compounds which are electrically more positive than silver include soluble salts of gold, rhodium, platinum, palladium and iridium, such as potassium chloroaurate, chloroauric acid, palladium ammonium chloride and iridium sodium chloride.

The fogging agent is normally used in an amount of $1.0\times10^{-6}$ to $1.0\times10^{-1}$ mol per mol of silver halide.

Typical examples of gold compounds include chloroauric acid, sodium chloroaurate, gold sulfide, and gold selenide. The gold compound is normally incorporated into the system in an amount of $1.0\times10^{-8}$ to $1.0\times10^{-4}$ mol per mol of silver halide.

The degree of fogging of the pre-fogged direct positive silver halide emulsion to be used in the present invention can be widely varied. As well known by those skilled in the art, the degree of fogging depends on the composition of silver halide emulsion, grain size, kind of fogging agent, concentration of fogging agent, emulsion pH, pAg and temperature at the fogging time, etc.

The direct positive silver halide photographic material of the present invention may comprise commonly used other various photographic additives. As a stabilizer, triazole, azaindene, quaternary benzothiazolium compound, mercapto compound or water-soluble inorganic salt such as cadmium, cobalt, nickel, manganese, gold, thallium and zinc salts may be used. As a film hardener, an aldehyde such as formalin, glyoxal and mucochromic acid, s-triazine, epoxy, aziridine, vinylsulfonic acid or the like may be used. As a coating aid, saponin, sodium polyalkylenesulfonate, lauryl or oleyl monoether of polyethylene glycol, amylated alkyltaurine, fluorine-containing compound or the like may be used. As a sensitizer, polyalkylene oxide or a derivative thereof may be used. Further, a color coupler may be incorporated in the direct positive silver halide photographic material of the present invention. In addition to these additives, a brightening agent, an ultraviolet absorbent, a preservative, a matting agent, an antistatic agent, etc. may be incorporated into the system as necessary.

The dye to be used in the present invention exhibits its main absorption in the visible light range within the inherent sensitive wavelength range of a silver halide emulsion which is adapted to be used so as to cause no fogging under anti-irradiation or safelight conditions. In particular, dyes having λmax of 350 nm to 600 nm are preferred. The chemical structure of the dye of the present invention is not specifically limited. As such a dye, an oxonol dye, hemioxonol dye, melocyanine dye, cyanine dye, azo dye or the like may be used. In order to eliminate color remaining after processing, a water-soluble dye may be used to advantage.

Specific examples of such a dye which can be used in the present invention include pyrazolone dyes as disclosed in JP-B-58-12576, pyrazolone oxonol dyes as disclosed in U.S. Pat. No. 2,274,782, diarylazo dyes as disclosed in U.S. Pat. No. 2,956,879, styryl dyes and butadienyl dyes as disclosed in U.S. Pat. No. 3,423,207, and 3,384,487, melocyanine dyes as disclosed in U.S. Pat. No. 2,527,583, melocyanine dyes and oxonol dyes as disclosed in U.S. Pat. Nos. 3,486,897, 3,652,284, and 3,718,472, enaminohemioxonol dyes as disclosed in U.S. Pat. No. 3,976,661, and dyes as disclosed in British Patents 584,609, and 1,177,429, JP-A-48-85130, JP-A-49-99620, and JP-A-49-114420, and U.S. Pat. Nos. 2,533,472, 3,148,187, 3,177,078, 3,247,127, 3,540,887, 3,575,704, and 3,653,905.

As developing agents to be used in the development of the silver halide photographic material of the present invention, organic or inorganic developing agents and developing aids as disclosed in E. K. Mees & H. James, *The Theory of the Photographic Process,* 3rd ed., pp. 278–381, 1966, may be used singly or in combination. Preferred examples of such a developing agent include ferrous oxalate, hydroxylamine, N-hydroxymorpholine, hydroquinone such as hydroquinone, hydroquinonemonosulfonate, chlorohydroquinone and t-butylhydroquinone, catechol, resorcin, pyrogallol, amidol, phenidone, pyrazolidone such as 4-hydroxymethyl-4-methyl-1-phenyl-3-pyrazolidone, para-aminophenol such as para-aminophenol, glycine and Metol(p-methylaminophenol sulfate, available from Agfa), paraphenylenediamine such as paraphenylenediamine and 4-amino-N-ethyl-N-ethoxyaniline, and ascorbic acid. Further preferred among these compounds are methol, a combination of phenidone and methol, a combination of Metol and hydroquinone, a combination of phenidone, Metol and t-butylhydroquinone, a combination of phenidone and ascorbic acid, and a combination of phenidone and paraaminophenol. Various other combinations may be used to obtain similar excellent results.

The amount of developing agent incorporated into the developer for the silver halide photographic material of the present invention is normally in the range of $1\times10^{-5}$ to 1 mol per l of developer.

In particular, hydroquinone is preferably used in an amount of 20 g/l or more, 25 g/l or more. In addition to the foregoing developing agents, the developer for the silver halide photographic materia used in the present invention may optionally comprise a preservative such as sulfite and hydroxylamine. Further, the developer used in the present invention may be pH adjusted or provided with a buffer capacity by the addition of caustic alkali, alkali carbonate, alkali borate, amine or the like. Moreover, the developer used in the present invention may optionally comprise an inorganic development inhibitor such as potassium bromide or an organic development inhibitor such as benzimidazole, benztriazole and nitroindazole as disclosed in British Patent 1,376,600.

The direct positive silver halide photographic material of the present invention can have various applications. For example, it can be used as printing photographic light-sensitive material for duplicating, reproduction, offset master, etc., special photographic light-sensitive material such as X-ray photograph, flash photograph and electron ray photograph or direct positive silver halide photographic material for general copying, microcopying, direct positive color system, quick stabillized system, diffusion transfer system, color diffusion transfer system, combined developing and fixing system, etc. The direct positive silver halide photographic material of the present invention provides a high contrast and an extremely high stability upon prolonged storage and under high humidity and temperature conditions as compared with the prior art direct positive silver halide photographic material.

EXAMPLES

The present invention will be further described in the following examples, but the present invention should not be construed as being limited thereto. Amounts are by weight unless otherwise indicated.

| Developer (A) | |
|---|---|
| Sodium 1,2-dihydroxybenzene-3,5-disulfonate | 0.5 g |
| Diethylenetriaminepentaacetic acid | 2.0 g |
| Sodium carbonate | 5.0 g |
| Boric acid | 10.0 g |
| Potassium sulfite | 85.0 g |
| Sodium bromide | 6.0 g |
| Diethylene glycol | 40.0 g |
| 5-Methybenzotriazole | 0.2 g |
| Hydroquinone | 30.0 g |
| 4-Hydroxymethyl-4-methyl-1-phenyl-3-pyrazolidone | 1.6 g |
| 2,3,5,6,7,8-Hexahydro-2-thioxo-4-(1H)-quinazolinone | 0.09 g |
| Sodium 2-mercaptobenzimidazole-5-sulfonate | 0.3 g |
| Water to make | 1 l |
| pH (adjusted with potassium hydroxide) | 10.7 |
| **Fixing solution (B)** | |
| Sodium thiosulfate | 1.1 mol/l |
| Ammonium thiosulfate | 0.2 mol/l |
| Sodium sulfite | 0.1 mol/l |

-continued

| | |
|---|---|
| Sodium metabisulfite | 0.08 mol/l |
| Disodium ethylenediaminetetraacetate dihydrate | 0.1 g/l |
| pH (adjusted with sodium hydroxide) | 6.0 |
| Water to make | 1 l |

EXAMPLE 1a

To an aqueous solution of gelatin which had been kept at a temperature of 50° C. was added citric acid. $AgNO_3$ and a halogen solution were then added to the material by a controlled double jet process in the presence of thioether ($HOCH_2CH_2SCH_2CH_2SCH_2CH_2OH$) for 60 minutes to prepare a monodisperse emulsion of cubic silver bromide grains having a grain size of 0.24 μm.

The emulsion thus obtained was then subjected to desalting by a flocculation process. To the emulsion was then added gelatin. The emulsion was then kept at a temperature of 65° C. and a pH value of 6.0. The emulsion was then ripened with formamidinesulfinic acid and 0.001 mmol/Ag mol of tetrachloroauric acid. The emulsion was then cooled with the pH value thereof being kept at 6.5. Thus, Emulsion aa was prepared.

To the emulsion was then added Compound I-31 as a desensitizing dye in an amount of 25 mg/m$^2$. The emulsion was then coated on a polyethylene terephthalate film in such an amount that the coated amount of silver reached 3.0 g/m$^2$. As a protective layer, a solution containing 1.2 g/m$^2$ of gelatin, 20 mg/m$^2$ of an amorphous $SiO_2$ matting agent having an average grain size of 3 μm, 0.1 g/m$^2$ of methanol silica, a fluorine surface active agent ($C_8F_{17}SO_2N(C_3H_7)CH_2COOK$) and sodium dodecylbenzenesulfonate as coating aids, and KBr solution for adjusting the pAg value of the film was simultaneously coated on the silver halide emulsion layer. Thus, a Photographic Light-Sensitive Material aA was prepared.

The photographic light-sensitive material thus obtained was subjected to sensitometry exposure through a 780 nm interference filter and a step wedge having a density difference (ΔD) of 0.1 by means of an Xe sensitometer for $10^0$, $10^{-3}$, $10^{-4}$ and $10^{-6}$ seconds, processed with the following Developer A and Fixing Solution B at a temperature of 38° C. by means of an automatic developing machine FG660F available from Fuji Photo Film Co., Ltd. for 20 seconds, and then measured for Dmax and Dmin. As shown in Table 1a, the photographic light-sensitive material exhibited a low Dmin even in a high intensity exposure (for $10^{-3}$ seconds or more).

TABLE 1a

| Exposure time (sec.) | Dmax | Dmin |
|---|---|---|
| $10^0$ | 4.9 | 0.04 |
| $10^{-3}$ | 4.9 | 0.04 |
| $10^{-4}$ | 4.9 | 0.04 |
| $10^{-6}$ | 4.9 | 0.04 |

EXAMPLE 2a

Monodisperse emulsions of cubic silver bromide grains having different grain sizes as set forth in Table 2a were prepared in the same manner as in Emulsion aa of Example 1a except that the temperatures at which grains were formed and the amount of thioether were altered.

The emulsions thus obtained were then subjected to desalting by a flocculation process. To the emulsions were then added gelatin. The emulsions were then kept at a temperature of 65° C. and a pH value of 6.0. The emulsions were then ripened with formamidinesulfinic acid and tetrachloroauric acid. The emulsions were then cooled with the pH value thereof being kept at 6.5. Thus, Emulsions ab, ac, ad, ae, af and ag were prepared.

Photographic Light-Sensitive Materials aB, aC, aD, aE, aF, and aG were prepared from these emulsions in the same manner as in Example 1a, and then measured for Dmax and Dmin in the same manner as in Example 1a. As shown in Table 2a, when the grain size is in the range of 0.1 to 0.40 μm, these photographic light-sensitive materials exhibited Dmin values as low as 0.08 or less even upon a high intensity exposure for $10^{-3}$ seconds or more.

TABLE 2a

| Photographic Light-Sensitive Material | Emulsion | Grain size | Dmax/ Dmin | Exposure time (sec.) $10^0$ | $10^{-3}$ | $10^{-6}$ |
|---|---|---|---|---|---|---|
| aB | ab | 0.45 | Dmax | 3.3 | 3.1 | 2.9 |
| | | | Dmin | 0.07 | 0.45 | 0.75 |
| aC | ac | 0.40 | Dmax | 4.4 | 4.4 | 4.4 |
| | | | Dmin | 0.05 | 0.05 | 0.06 |
| aD | ad | 0.30 | Dmax | 5.0 | 5.0 | 5.0 |
| | | | Dmin | 0.04 | 0.04 | 0.04 |
| aE | ae | 0.15 | Dmax | 4.8 | 4.8 | 4.8 |
| | | | Dmin | 0.04 | 0.04 | 0.05 |
| aF | af | 0.10 | Dmax | 4.7 | 4.7 | 4.7 |
| | | | Dmin | 0.05 | 0.06 | 0.06 |
| aG | ag | 0.08 | Dmax | 3.6 | 3.3 | 3.0 |
| | | | Dmin | 0.33 | 0.33 | 0.82 |

(Note: Photographic Light-Sensitive Materials aB and aG are comparative while the others are according to the present invention).

EXAMPLE 3a

Photographic Light-Sensitive Materials aA-1, aA-2, aA-3, aA-4, and aA-5 were prepared in the same manner as Photographic Light-Sensitive Material aA of Example 1a, except that the desensitizing Dye I-31 was replaced by desensitizing Dyes I-42, I-34, I-16, I-8 and I-1 as set forth in Table 3a, respectively.

These photographic light-sensitive materials were processed in the same manner as in Example 1a, and then measured for Dmax and Dmin. As shown in Table 3a, these photographic light-sensitive materials exhibit Dmin as low as 0.08 or less even upon a high intensity exposure for $10^{-3}$ seconds or more.

TABLE 3a

| Photographic Light-Sensitive Material | Desensitizing Dye | Added amount (mg/m$^2$) | Dmax/ Dmin | Exposure time (sec.) $10^0$ | $10^{-3}$ | $10^{-6}$ |
|---|---|---|---|---|---|---|
| aA-1 | aI-42 | 25 | Dmax | 5.1 | 5.1 | 5.1 |
| | | | Dmin | 0.04 | 0.04 | 0.04 |
| aA-2 | aI-34 | 25 | Dmax | 4.8 | 4.8 | 4.8 |
| | | | Dmin | 0.04 | 0.04 | 0.04 |
| aA-3 | aI-16 | 18 | Dmax | 5.1 | 5.1 | 5.1 |
| | | | Dmin | 0.05 | 0.05 | 0.06 |
| aA-4 | aI-8 | 20 | Dmax | 4.9 | 4.9 | 4.9 |
| | | | Dmin | 0.04 | 0.05 | 0.06 |
| aA-5 | aI-1 | 25 | Dmax | 4.7 | 4.7 | 4.7 |
| | | | Dmin | 0.04 | 0.05 | 0.05 |

(Note: All the specimens are according to the present invention).

EXAMPLE 4a

Ten kinds of emulsions of cubic silver bromochloride, grains having a grain size of 0.24 μm were prepared in the same manner as in Emulsion aa of Example 1a, except that the halogen composition of the halogen solution was altered as set forth in Table 4a and the amount of thioether and the time at which thioether was added were altered.

The emulsions thus obtained were then subjected to desalting by a flocculation process. To the emulsions were then added gelatin. The emulsions were then kept at a temperature of 63° C. and a pH value of 5.8. The emulsions were then ripened with formamidinesulfinic acid and tetrachloroauric acid. The emulsions were then cooled with the pH value thereof being kept at 6.5. Thus, Emulsions ah, ai, aj, ak, al, am, an, ao, ap, and aq were prepared.

Photographic Light-Sensitive Materials aH, aI, aJ, aK, aL, aM, aN, aO, aP, and aQ were prepared from these emulsions, exposed to light, developed, and then measured for Dmax and Dmin in the same manner as Photographic Light-Sensitive Material aA of Example 1a.

As shown in Table 4a, the silver bromochloride emulsion having Br content of 5 mol % or more exhibit Dmin as low as 0.08 or less in a high intensity exposure for $10^{-3}$ seconds or more.

TABLE 4a

| Photographic Light-Sensitive Material | Emulsion | Halogen composition | Dmax/Dmin | Exposure time (sec.) $10^0$ | $10^{-3}$ | $10^{-6}$ |
|---|---|---|---|---|---|---|
| aH | ah | $AgBr_{95}Cl_5$ | Dmax | 5.12 | 5.15 | 5.15 |
| | | | Dmin | 0.04 | 0.04 | 0.04 |
| aI | ai | $AgBr_{90}Cl_{10}$ | Dmax | 5.1 | 5.1 | 5.1 |
| | | | Dmin | 0.04 | 0.04 | 0.04 |
| aJ | aj | $AgBr_{80}Cl_{20}$ | Dmax | 5.05 | 5.07 | 5.08 |
| | | | Dmin | 0.04 | 0.04 | 0.05 |
| aK | ak | $AgBr_{70}Cl_{30}$ | Dmax | 5.0 | 5.0 | 5.0 |
| | | | Dmin | 0.04 | 0.04 | 0.05 |
| aL | al | $AgBr_{50}Cl_{50}$ | Dmax | 4.95 | 4.95 | 4.95 |
| | | | Dmin | 0.04 | 0.04 | 0.05 |
| aM | am | $AgBr_{30}Cl_{70}$ | Dmax | 4.92 | 4.92 | 4.92 |
| | | | Dmin | 0.05 | 0.05 | 0.06 |
| aN | an | $AgBr_{20}Cl_{80}$ | Dmax | 4.90 | 4.90 | 4.90 |
| | | | Dmin | 0.05 | 0.05 | 0.07 |
| aO | a0 | $AgBr_{10}Cl_{90}$ | Dmax | 4.85 | 4.86 | 4.84 |
| | | | Dmin | 0.06 | 0.06 | 0.08 |
| aP | ap | $AgBr_5Cl_{95}$ | Dmax | 4.81 | 4.83 | 4.82 |
| | | | Dmin | 0.06 | 0.06 | 0.08 |
| aQ | aq | $AgCl_{100}$ | Dmax | 4.21 | 4.2 | 4.2 |
| | | | Dmin | 3.5 | 3.84 | 4.0 |

(Note: Specimens aH to aP are according to the present invention while Specimen aQ is comparative).

EXAMPLE 1b

To Emulsion aa prepared in Example 1a was then added Compound II-32 as a desensitizing dye in an amount 15 mg/m$^2$. The emulsion was then coated on a polyethylene terephthalate film in such an amount that the coated amount of silver reached 3.0 g/m$^2$. As a protective layer, a solution containing 1.2 g/m$^2$ of gelatin, 20 mg/m$^2$ of an amorphous $SiO_2$ matting agent having an average grain size of 3 μm, 0.1 g/m$^2$ of methanol silica, a fluorine surface active agent ($C_8F_{17}SO_2N(C_3H_7)CH_2COOK$) and sodium dodecylbenzenesulfonate as coating aids, and a KBr solution for adjusting the pAg value of the film were simultaneously coated on the silver halide emulsion layer. Thus, Photographic Light-Sensitive Material bA was prepared.

The photographic light-sensitive material thus obtained was subjected to sensitometry exposure through a 633 nm interference filter and a step wedge having a density difference (ΔD) of 0.1 by means of an Xe sensitometer for $10^0$, $10^{-3}$, $10^{-4}$ and $10^{-6}$ seconds, processed with the foregoing Developer A and Fixing Solution B at a temperature of 38° C. by means of an automatic developing machine FG660F available from Fuji Photo Film Co., Ltd. for 20 seconds, and then measured for Dmax and Dmin. As shown in Table 1b, the photographic light-sensitive materials exhibited a low Dmin value even in a high intensity exposure (for $10^{-3}$ seconds or more).

TABLE 1b

| Exposure time (sec.) | Dmax | Dmin |
|---|---|---|
| $10^0$ | 5.0 | 0.04 |
| $10^{-3}$ | 5.0 | 0.04 |
| $10^{-4}$ | 5.0 | 0.04 |
| $10^{-6}$ | 5.0 | 0.04 |

EXAMPLE 2b

Monodisperse emulsions of cubic silver bromide grains having different grain sizes as set forth in Table 2b were prepared in the same manner as in Emulsion aa of Example 1a, except that the temperature at which grains were formed and the amount of thioether were altered.

The emulsions thus obtained were then subjected to desalting by a flocculation process. To the emulsions were then added gelatin. The emulsions were then kept at a temperature of 65° C. and a pH value of 6.0. The emulsions were then ripened with formamidinesulfinic acid and tetrachloroauric acid. The emulsions were then cooled with the pH value thereof being kept at 6.5. Thus, Emulsions bb, bc, bd, be, bf and bg were prepared.

Photographic Light-Sensitive Materials bB, bC, bD, bE, bF, and bG were prepared using these emulsions in the same manner as in Example 1b, and then measured for Dmax and Dmin in the same manner as in Example 1b.

As shown in Table 2b, when the grain size is in the range of 0.1 to 0.40 μm, these photographic light-sensitive materials exhibited Dmin as low as 0.06 or less, even upon a high intensity exposure for $10^{-3}$ seconds or more.

TABLE 2b

| Photographic Light-Sensitive Material | Emulsion | Grain size | Dmax/Dmin | Exposure time (sec.) $10^0$ | $10^{-3}$ | $10^{-6}$ |
|---|---|---|---|---|---|---|
| bB | bb | 0.45 | Dmax | 3.5 | 3.30 | 3.10 |
| | | | Dmin | 0.06 | 0.32 | 0.65 |
| bC | bc | 0.40 | Dmax | 4.5 | 4.5 | 4.5 |
| | | | Dmin | 0.05 | 0.05 | 0.06 |
| bD | bd | 0.30 | Dmax | 5.2 | 5.2 | 5.2 |
| | | | Dmin | 0.04 | 0.04 | 0.04 |
| bE | be | 0.15 | Dmax | 5.1 | 5.1 | 5.1 |
| | | | Dmin | 0.04 | 0.04 | 0.05 |
| bF | bf | 0.10 | Dmax | 4.9 | 4.9 | 4.9 |
| | | | Dmin | 0.05 | 0.06 | 0.06 |
| bG | bg | 0.08 | Dmax | 4.0 | 3.58 | 3.20 |
| | | | Dmin | 0.05 | 0.33 | 0.82 |

(Note: Photographic Light-Sensitive Materials bB and bG are comparative while the others are according to the present invention).

EXAMPLE 3b

Photographic Light-Sensitive Materials bA-1, bA-2, bA-3, bA-4, and bA-5 were prepared in the same manner as Photographic Light-Sensitive Material bA of Example 1b, except that the desensitizing dye II-32 was replaced by desensitizing Dyes II-1, II-33, II-34, III-5 and III-6 as set forth in Table 3b, respectively.

These photographic light-sensitive materials were processed in the same manner as in Example 1b, and then measured for Dmax and Dmin. The results are set forth in Table 1b.

As shown in Table 3b, these photographic light-sensitive materials exhibited Dmin as low as 0.06 or less, even upon a high intensity exposure for $10^{-3}$ seconds or more.

TABLE 3b

| Photographic Light-Sensitive Material | Desensitizing Dye | Added amount (mg/m²) | Dmax/Dmin | Exposure time (sec.) $10^0$ | $10^{-3}$ | $10^{-6}$ |
|---|---|---|---|---|---|---|
| bA-1 | II-1 | 20 | Dmax | 5.1 | 5.1 | 5.1 |
| | | | Dmin | 0.04 | 0.04 | 0.04 |
| bA-2 | II-33 | 25 | Dmax | 4.8 | 4.8 | 4.8 |
| | | | Dmin | 0.04 | 0.04 | 0.04 |
| bA-3 | II-34 | 30 | Dmax | 5.1 | 5.1 | 5.1 |
| | | | Dmin | 0.05 | 0.05 | 0.06 |
| bA-4 | III-5 | 20 | Dmax | 4.9 | 4.9 | 4.9 |
| | | | Dmin | 0.04 | 0.05 | 0.06 |
| bA-5 | III-6 | 25 | Dmax | 4.7 | 4.7 | 4.7 |
| | | | Dmin | 0.04 | 0.05 | 0.05 |

(Note: All the specimens are according to the present invention).

EXAMPLE 4b

Ten kinds of emulsions of cubic silver bromochloride grains having a grain size of 0.24 μm were prepared in the same manner as in Emulsion ba of Example 1b, except that the halogen composition of the halogen solution was altered as set forth in Table 4b and the amount of thioether, and the time at which thioether was added were altered.

The emulsions thus obtained were then subjected to desalting by a flocculation process. To the emulsions were then added gelatin. The emulsions were then kept at a temperature of 63° C. and a pH value of 5.8. The emulsions were then ripened with formamidinesulfinic acid and tetrachloroauric acid. The emulsions were then cooled with the pH value thereof being kept at 6.5. Thus, Emulsions bh, hi, bj, bk, bl, bm, bn, bo, bp, and bq were prepared.

Photographic Light-Sensitive Materials bH, bI, bJ, bK, bL, bM, bN, bO, bP, and bQ were prepared from these emulsions, exposed to light, developed, and then measured for Dmax and Dmin in the same manner as Photographic Light-Sensitive Material bA of Example 1b.

As shown in Table 4b, the silver bromochloride emulsion having Br content of 5 mol % or more exhibit Dmin as low as 0.08 or less, even upon a high intensity exposure for $10^{-3}$ seconds or more.

TABLE 4b

| Photographic Light-Sensitive Material | Emulsion | Halogen composition | Dmax/Dmin | Exposure time (sec.) $10^0$ | $10^{-3}$ | $10^{-6}$ |
|---|---|---|---|---|---|---|
| bH | bh | $AgBrg_{95}Cl_5$ | Dmax | 5.12 | 5.15 | 5.15 |
| | | | Dmin | 0.04 | 0.04 | 0.04 |
| bI | bi | $AgBr_{90}Cl_{10}$ | Dmax | 5.1 | 5.1 | 5.1 |
| | | | Dmin | 0.04 | 0.04 | 0.04 |
| bJ | bj | $AgBr_{80}Cl_{20}$ | Dmax | 5.05 | 5.07 | 5.08 |
| | | | Dmin | 0.04 | 0.04 | 0.05 |

TABLE 4b-continued

| Photographic Light-Sensitive Material | Emulsion | Halogen composition | Dmax/Dmin | Exposure time (sec.) $10^0$ | $10^{-3}$ | $10^{-6}$ |
|---|---|---|---|---|---|---|
| bK | bk | $AgBr_{70}Cl_{30}$ | Dmax | 5.0 | 5.0 | 5.0 |
| | | | Dmin | 0.04 | 0.04 | 0.05 |
| bL | bl | $AgBr_{50}Cl_{50}$ | Dmax | 4.95 | 4.95 | 4.95 |
| | | | Dmin | 0.04 | 0.04 | 0.05 |
| bM | bm | $AgBr_{30}Cl_{70}$ | Dmax | 4.92 | 4.92 | 4.92 |
| | | | Dmin | 0.05 | 0.05 | 0.06 |
| bN | bn | $AgBr_{20}Cl_{80}$ | Dmax | 4.90 | 4.90 | 4.90 |
| | | | Dmin | 0.05 | 0.05 | 0.07 |
| bO | b0 | $AgBr_{10}Cl_{90}$ | Dmax | 4.85 | 4.86 | 4.84 |
| | | | Dmin | 0.06 | 0.06 | 0.08 |
| bP | bp | $AgBr_5Cl_{95}$ | Dmax | 4.81 | 4.83 | 4.82 |
| | | | Dmin | 0.06 | 0.06 | 0.08 |
| bQ | bq | $AgCl_{100}$ | Dmax | 4.21 | 4.2 | 4.2 |
| | | | Dmin | 3.5 | 3.8 | 4.0 |

(Note: Specimens bH to bP are according to the present invention while Specimen bQ is comparative).

EXAMPLE 1c

To Emulsion aa prepared in Example 1a was then added Compound IV-2 as a desensitizing dye in an amount of 20 mg/m². The emulsion was then coated on a polyethylene terephthalate film in such an amount that the coated amount of silver reached 3.0 g/m². As a protective layer, a solution containing 1.2 g/m² of gelatin, 20 mg/m² of an amorphous $SiO_2$ matting agent having an average grain size of 3 μm, 0.1 g/m² of methanol silica, a fluorine surface active agent ($C_8F_{17}SO_2N(C_3H_7)CH_2COOK$) and sodium dodecylbenzenesulfonate as coating aids, and a KBr solution for adjusting the pAg value of the film were simultaneously coated on the silver halide emulsion layer. Thus, Photographic Light-Sensitive Material cA was prepared.

The photographic light-sensitive material thus obtained was subjected to sensitometry exposure through a 780 nm interference filter and a step wedge having a density difference (ΔD) of 0.1 by means of an Xe sensitometer for $10^0$, $10^{-3}$, $10^{-4}$ and $10^{-6}$ seconds, processed with the foregoing Developer A and Fixing Solution B at a temperature of 38° C. by means of an automatic developing machine FG660F available from Fuji Photo Film Co., Ltd. for 20 seconds, and then measured for Dmax and Dmin.

TABLE 1c

| Exposure time (sec.) | Dmax | Dmin |
|---|---|---|
| $10^0$ | 4.8 | 0.04 |
| $10^{-3}$ | 4.8 | 0.04 |
| $10^{-4}$ | 4.8 | 0.04 |
| $10^{-6}$ | 4.8 | 0.04 |

As shown in Table 1c, the photographic light-sensitive material exhibited a low Dmin even in a high intensity exposure (for $10^{-3}$ seconds or more).

EXAMPLE 2c

Monodisperse emulsions of cubic silver bromide grains having different grain sizes as set forth in Table 2c were prepared in the same manner as in Emulsion aa of Example 1a, except that the temperature at which grains were formed or the amount of thioether were altered.

The emulsions thus obtained were then subjected to desalting by the flocculation process. To the emulsions were then added gelatin. The emulsions were then kept at a temperature of 65° C. and a pH value of 6.0. The emulsions were then ripened with formamidinesulfinic acid and tetrachloroauric acid. The emulsions were then cooled with the pH value thereof being kept at 6.5. Thus, Emulsions cb, cc, cd, ce, cf and cg were prepared.

Photographic Light-Sensitive Materials cB, cC, cD, cE, cF, and cG were prepared from these emulsions in the same manner as in Example 1a, and then measured for Dmax and Dmin in the same manner as in Example 1a.

The results are set forth in Table 2c.

As shown in Table 2c, when the grain size is in the range of 0.1 to 0.40 μm, these photographic light-sensitive materials exhibited Dmin as low as 0.08 or less, even upon a high intensity exposure for $10^{-3}$ seconds or more.

TABLE 2c

| Photographic Light-Sensitive Material | Emulsion | Grain size | Dmax/Dmin | Exposure time (sec.) $10^0$ | $10^{-3}$ | $10^{-6}$ |
|---|---|---|---|---|---|---|
| cB | cb | 0.45 | Dmax | 3.0 | 3.0 | 3.0 |
| | | | Dmin | 0.06 | 0.32 | 0.65 |
| cC | cc | 0.40 | Dmax | 4.5 | 4.5 | 4.5 |
| | | | Dmin | 0.05 | 0.05 | 0.06 |
| cD | cd | 0.30 | Dmax | 4.8 | 4.8 | 4.8 |
| | | | Dmin | 0.04 | 0.04 | 0.04 |
| cE | ce | 0.15 | Dmax | 4.7 | 4.7 | 4.7 |
| | | | Dmin | 0.04 | 0.04 | 0.05 |
| cF | Cf | 0.10 | Dmax | 4.6 | 4.6 | 4.6 |
| | | | Dmin | 0.05 | 0.06 | 0.06 |
| cG | cg | 0.08 | Dmax | 3.7 | 3.2 | 2.8 |
| | | | Dmin | 0.07 | 0.34 | 1.02 |

(Note: Photographic Light-Sensitive Materials cB and cG are comparative while the others are according to the present invention).

EXAMPLE 3c

Photographic Light-Sensitive Materials cA-1, cA-2, cA-3, cA-4, and cA-5 were prepared in the same manner as Photographic Light-Sensitive Material cA of Example 1c, except that the desensitizing Dye IV-2 was replaced by desensitizing Dyes IV-3, IV-4, IV-9, IV-18, and IV-30 as set forth in Table 3c, respectively.

These photographic light-sensitive materials were processed in the same manner as in Example 1c, and then measured for Dmax and Dmin. The results are set forth in Table 3c.

As shown in Table 3c, these photographic light-sensitive materials exhibit Dmin as low as 0.08 or less, even upon a high intensity exposure for $10^{-3}$ seconds or more.

TABLE 3c

| Photographic Light-Sensitive Material | Desensitizing Dye | Added amount (mg/m²) | Dmax/Dmin | Exposure time (sec.) $10^0$ | $10^{-3}$ | $10^{-6}$ |
|---|---|---|---|---|---|---|
| cA-1 | IV-3 | 20 | Dmax | 4.9 | 4.9 | 4.9 |
| | | | Dmin | 0.04 | 0.04 | 0.04 |
| CA-2 | IV-4 | 20 | Dmax | 4.8 | 4.8 | 4.8 |
| | | | Dmin | 0.04 | 0.04 | 0.04 |
| CA-3 | IV-9 | 25 | Dmax | 4.8 | 4.8 | 4.8 |
| | | | Dmin | 0.05 | 0.05 | 0.06 |
| CA-4 | IV-18 | 18 | Dmax | 4.8 | 4.8 | 4.8 |

TABLE 3c-continued

| Photographic Light-Sensitive Material | Desensitizing Dye | Added amount (mg/m²) | Dmax/Dmin | Exposure time (sec.) $10^0$ | $10^{-3}$ | $10^{-6}$ |
|---|---|---|---|---|---|---|
| | | | Dmin | 0.04 | 0.05 | 0.06 |
| CA-5 | IV-30 | 15 | Dmax | 4.7 | 4.7 | 4.7 |
| | | | Dmin | 0.04 | 0.05 | 0.05 |

(Note: All the specimens are according to the present invention).

EXAMPLE 4C

Ten kinds of emulsions of cubic silver bromochloride grains having a grain size of 0.24 μm were prepared in the same manner as in Emulsion aa of Example 1a, except that the halogen composition of the halogen solution was altered as set forth in Table 4c and the amount of thioether and the time at which thioether was added were altered.

The emulsions thus obtained were then subjected to desalting by a flocculation process. To the emulsions were then added gelatin. The emulsions were then kept at a temperature of 63° C. and a pH value of 5.8. The emulsions were then ripened with formamidinesulfinic acid and tetrachloroauric acid. The emulsions were then cooled with the pH value thereof being kept at 6.5. Thus, Emulsions ch, ci, cj, ck, cl, cm, cn, co, cp, and cq were prepared.

Photographic Light-Sensitive Materials cH, cI, cJ, cK, cL, cM, cN, cO, cP, and cQ were prepared from these emulsions, exposed to light, developed, and then measured for Dmax and Dmin in the same manner as Photographic Light-Sensitive Material cA of Example 1c.

The results are set forth in Table 4c.

As shown in Table 4c, the silver bromochloride emulsion having Br content of 5 mol % or more exhibit Dmin as low as 0.08 or less, even upon a high intensity exposure for $10^{-3}$ seconds or more.

TABLE 4c

| Photographic Light-Sensitive Material | Emulsion | Halogen composition | Dmax/Dmin | Exposure time (sec.) $10^0$ | $10^{-3}$ | $10^{-6}$ |
|---|---|---|---|---|---|---|
| cH | ch | $AgBr_{95}Cl_5$ | Dmax | 4.8 | 4.8 | 4.8 |
| | | | Dmin | 0.04 | 0.04 | 0.04 |
| cI | ci | $AgBr_{90}Cl_{10}$ | Dmax | 4.8 | 4.8 | 4.8 |
| | | | Dmin | 0.04 | 0.04 | 0.04 |
| cJ | cj | $AgBr_{80}Cl_{20}$ | Dmax | 4.8 | 4.8 | 4.8 |
| | | | Dmin | 0.04 | 0.04 | 0.05 |
| cK | ck | $AgBr_{70}Cl_{30}$ | Dmax | 4.75 | 4.75 | 4.75 |
| | | | Dmin | 0.04 | 0.04 | 0.05 |
| cL | cl | $AgBr_{50}Cl_{50}$ | Dmax | 4.75 | 4.75 | 4.75 |
| | | | Dmin | 0.04 | 0.04 | 0.05 |
| cM | cm | $AgBr_{30}Cl_{70}$ | Dmax | 4.7 | 4.7 | 4.7 |
| | | | Dmin | 0.05 | 0.05 | 0.06 |
| cN | cn | $AgBr_{20}Cl_{80}$ | Dmax | 4.7 | 4.7 | 4.7 |
| | | | Dmin | 0.05 | 0.05 | 0.07 |
| cO | c0 | $AgBr_{10}Cl_{90}$ | Dmax | 4.7 | 4.7 | 4.7 |
| | | | Dmin | 0.06 | 0.06 | 0.08 |
| cP | cp | $AgBr_5Cl_{95}$ | Dmax | 4.6 | 4.6 | 4.6 |
| | | | Dmin | 0.06 | 0.06 | 0.08 |
| cQ | cq | $AgCl_{100}$ | Dmax | 3.6 | 3.6 | 3.6 |
| | | | Dmin | 3.5 | 3.5 | 3.5 |

(Note: Specimens cH to CP are according to the present invention while Specimen cQ is comparative).

EXAMPLE 1 d

To Emulsion aa prepared in Example 1a was then added Compound V-1 as a desensitizing dye in an amount of 25 mg/m$^2$. The emulsion was then coated on a polyethylene terephthalate film in such an amount that the coated amount of silver reached 3.0 g/m$^2$. As a protective layer, a solution containing 1.2 g/m$^2$ of gelatin, 20 mg/m$^2$ of an amorphous $SiO_2$ matting agent having an average grain size of 3 μm, 0.1 g/mP$^2$ of methanol silica, a fluorine surface active agent ($C_8F_{17}SO_2N(C3H_7)CH_2COOK$) and sodium dodecylbenzenesulfonate as coating aids, and a KBr solution for adjusting the pAg value of the film were simultaneously coated on the silver halide emulsion layer. Thus, Photographic Light-Sensitive Material dA was prepared.

The photographic light-sensitive material thus obtained was subjected to sensitometry exposure through a 633 nm interference filter and a step wedge having a density difference (ΔD) of 0.1 by means of an Xe sensitometer for $10^0$, $10^{-3}$, $10^{-4}$ and $10^{-6}$ seconds processed with the foregoing Developer A and Fixing Solution B at a temperature of 38° C. by means of an automatic developing machine FG660F available from Fuji Photo Film Co., Ltd. for 20 seconds, and then measured for Dmax and Dmin.

As shown in Table 1d, the photographic light-sensitive material exhibited a low Dmin, even in a high intensity exposure (for $10^{-3}$ seconds or more).

TABLE 1d

| Exposure time (sec.) | Dmax | Dmin |
|---|---|---|
| $10^0$ | 5.0 | 0.03 |
| $10^{-3}$ | 5.0 | 0.03 |
| $10^{-4}$ | 5.0 | 0.03 |
| $10^{-6}$ | 5.0 | 0.03 |

EXAMPLE 2d

Monodisperse emulsions of cubic silver bromide grains having different grain sizes as set forth in Table 2d were prepared in the same manner as in Emulsion aa of Example 1a, except that the temperature at which grains were formed or the amount of thioether were altered.

The emulsions thus obtained were then subjected to desalting by a flocculation process. To the emulsions were then added gelatin. The emulsions were then kept at a temperature of 65 ° C. and a pH value of 6.0. The emulsions were then ripened with formamidinesulfinic acid and tetrachloroauric acid. The emulsions were then cooled with the pH value thereof being kept at 6.5. Thus, Emulsions db, dc, dd, de, df and dg were prepared.

Photographic Light-Sensitive Materials dB, dC, dD, dE, dF, and dG were prepared from these emulsions in the same manner as in Example 1d, and then measured for Dmax and Dmin in the same manner as in Example 1d.

As shown in Table 2d, when the grain size is in the range of 0.1 to 0.40 μm, these photographic light-sensitive materials exhibit Dmin as low as 0.06 or less even upon a high intensity exposure for $10^{-3}$ seconds or more.

TABLE 2d

| Photographic Light-Sensitive Material | Emulsion | Grain size | Dmax/Dmin | Exposure time (sec.) $10^0$ | $10^{-3}$ | $10^{-6}$ |
|---|---|---|---|---|---|---|
| dB | db | 0.45 | Dmax | 3.5 | 3.30 | 3.10 |
| | | | Dmin | 0.06 | 0.32 | 0.65 |
| dC | dc | 0.40 | Dmax | 4.5 | 4.5 | 4.5 |
| | | | Dmin | 0.05 | 0.05 | 0.06 |
| dD | dd | 0.30 | Dmax | 5.2 | 5.2 | 5.2 |
| | | | Dmin | 0.04 | 0.04 | 0.04 |
| dE | de | 0.15 | Dmax | 5.1 | 5.1 | 5.1 |
| | | | Dmin | 0.04 | 0.04 | 0.05 |
| dF | df | 0.10 | Dmax | 4.9 | 4.9 | 4.9 |
| | | | Dmin | 0.05 | 0.06 | 0.06 |
| dG | dg | 0.08 | Dmax | 4.0 | 3.58 | 3.20 |
| | | | Dmin | 0.05 | 0.33 | 0.82 |

(Note: Photographic Light-Sensitive Materials dB and dG are comparative, while the others are according to the present invention).

EXAMPLE 3d

Photographic Light-Sensitive Materials dA-1, dA-2, dA-3, dA-4, and dA-5 were prepared in the same manner as Photographic Light-Sensitive Material dA of Example 1d, except that the desensitizing Dye V-1 was replaced by desensitizing Dyes V-3, V-6, V-7, V-10, and V-14 as set forth in Table 3d, respectively.

These photographic light-sensitive materials were processed in the same manner as in Example 1d, and then measured for Dmax and Dmin. The results are set forth in Table 3d.

As shown in Table 3d, these photographic light-sensitive materials exhibited Dmin as low as 0.08 or less, even upon a high intensity exposure for $10^{-3}$ seconds or more.

TABLE 3d

| Photographic Light-Sensitive Material | Desensitizing Dye | Added amount (mg/m$^2$) | Dmax/Dmin | Exposure time (sec.) $10^0$ | $10^{-3}$ | $10^{-6}$ |
|---|---|---|---|---|---|---|
| dA-1 | V-3 | 15 | Dmax | 5.1 | 5.10 | 5.1 |
| | | | Dmin | 0.04 | 0.04 | 0.04 |
| dA-2 | V-6 | 20 | Dmax | 4.8 | 4.8 | 4.8 |
| | | | Dmin | 0.04 | 0.04 | 0.04 |
| dA-3 | V-7 | 15 | Dmax | 5.1 | 5.1 | 5.1 |
| | | | Dmin | 0.05 | 0.05 | 0.06 |
| dA-4 | V-10 | 20 | Dmax | 4.9 | 4.9 | 4.9 |
| | | | Dmin | 0.04 | 0.05 | 0.06 |
| dA-5 | V-14 | 25 | Dmax | 4.7 | 4.7 | 4.7 |
| | | | Dmin | 0.04 | 0.05 | 0.05 |

(Note: All the specimens are according to the present invention).

EXAMPLE 4d

Ten kinds of emulsions of cubic silver bromochloride grains having a size of 0.24 μm were prepared in the same manner Emulsion aa of Example 1a except that the halogen composition of the halogen solution was altered as set forth in Table 4d and the amount of thioether and the time at which thioether was added were altered.

The emulsions thus obtained were then subjected to desalting by the flocculation process. To the emulsions were then added gelatin. The emulsions were then kept at a temperature of 63° C. and a pH value of 5.8. The emulsions were then ripened with formamidinesulfinic acid and tetrachloroauric acid. The emulsions were then cooled with the pH value thereof being kept at 6.5. Thus, Emulsions dh, di, dj, dk, dl, dm, dn, do, dp, and dq were prepared.

Photographic Light-Sensitive Materials dH, dI, dj, dK, dL, dM, dN, dO, dP, and dQ were prepared from these emulsions, exposed to light, developed, and then measured for Dmax and Dmin in the same manner as the photographic light-sensitive material dA of Example 1d.

As shown in Table 4d, the silver bromochloride emulsion having Br content of 5 mol % or more exhibit Dmin as low as 0.08 or less, even in a high intensity exposure for $10^{-3}$ seconds or more.

TABLE 4d

| Photographic Light-Sensitive Material | Emulsion | Halogen composition | Dmax/Dmin | Exposure time (sec.) $10^0$ | $10^{-3}$ | $10^{-6}$ |
|---|---|---|---|---|---|---|
| dH | dh | $AgBr_{95}Cl_5$ | Dmax | 5.12 | 5.15 | 5.15 |
| | | | Dmin | 0.04 | 0.04 | 0.04 |
| dI | di | $AgBr_90Cl_{10}$ | Dmax | 5.1 | 5.1 | 5.1 |
| | | | Dmin | 0.04 | 0.04 | 0.04 |
| dJ | dj | $AgBr_80Cl_{20}$ | Dmax | 5.05 | 5.07 | 5.08 |
| | | | Dmin | 0.04 | 0.04 | 0.05 |
| dK | dk | $AgBr_{70}Cl_{30}$ | Dmax | 5.0 | 5.0 | 5.0 |
| | | | Dmin | 0.04 | 0.04 | 0.05 |
| dL | dl | $AgBr_{50}Cl_{50}$ | Dmax | 4.95 | 4.95 | 4.95 |
| | | | Dmin | 0.04 | 0.04 | 0.05 |
| dM | dm | $AgBr_{30}Cl_{70}$ | Dmax | 4.92 | 4.92 | 4.92 |
| | | | Dmin | 0.05 | 0.05 | 0.06 |
| dN | dn | $AgBr_{20}Cl_{80}$ | Dmax | 4.90 | 4.90 | 4.90 |
| | | | Dmin | 0.05 | 0.05 | 0.07 |
| dO | d0 | $AgBr_{10}Cl_{90}$ | Dmax | 4.85 | 4.86 | 4.84 |
| | | | Dmin | 0.06 | 0.06 | 0.08 |
| dP | dp | $AgBr_5Cl_{95}$ | Dmax | 4.81 | 4.83 | 4.82 |
| | | | Dmin | 0.06 | 0.06 | 0.08 |
| dQ | dq | $AgCl_{100}$ | Dmax | 4.21 | 4.2 | 4.2 |
| | | | Dmin | 3.5 | 3.8 | 4.0 |

(Note: Specimens cH to cP are according to the present invention while Specimen cQ is comparative).

EXAMPLE 1e

To Emulsion aa prepared in Example 1a was then added Compound VI-9 as a desensitizing dye in an amount 15 mg/m$^2$. The emulsion was then coated on a polyethylene terephthalate film in such an amount that the coated amount of silver reached 3.0 g/m$^2$. As a protective layer, a solution containing 1.2 g/m$^2$ of gelatin, 20 mg/m$^2$ of an amorphous $SiO_2$ matting agent having an average grain size of 3 μm, 0.1 g/m$^2$ of methanol silica, a fluorine surface active agent ($C_8F_{17}SO_2N(C_3H_7)CH_2COOK$) and sodium dodecylbenzenesulfonate as coating aids, and a KBr solution for adjusting the pAg value of the film were simultaneously coated on the silver halide emulsion layer. Thus, Photographic Light-Sensitive Material eA was prepared.

The photographic light-sensitive material thus obtained was subjected to sensitometry exposure through a 780 nm interference filter and a step wedge having a density difference (ΔD) of 0.1 by means of an Xe sensitometer for $10^0$, $10^{-3}$, $10^{-4}$ and $10^{-6}$ seconds, processed with the foregoing Developer A and Fixing Solution B at a temperature of 38° C. by means of an automatic developing machine FG660F available from Fuji Photo Film Co., Ltd. for 20 seconds, and then measured for Dmax and Dmin. As shown in Table 1e, the photographic light-sensitive material exhibited a Dmin as low as 0.08 or less, even in a high intensity exposure (for $10^{-3}$ seconds or more).

TABLE 1e

| Exposure time (sec.) | Dmax | Dmin |
|---|---|---|
| $10^0$ | 4.8 | 0.04 |
| $10^{-3}$ | 4.8 | 0.04 |
| $10^{-4}$ | 4.8 | 0.04 |
| $10^{-6}$ | 4.8 | 0.04 |

EXAMPLE 2e

Monodisperse emulsions of cubic silver bromide grains having different grain sizes as set forth in Table 2e were prepared in the same manner as in Emulsion aa of Example 1a, except that the temperature at which grains were formed or the amount of thioether were altered.

The emulsions thus obtained were then subjected to desalting by a flocculation process. To the emulsions were then added gelatin. The emulsions were then kept at a temperature of 65° C. and a pH value of 6.0. The emulsions were then ripened with formamidinesulfinic acid and tetrachloroauric acid. The emulsions were then cooled with the pH value thereof being kept at 6.5. Thus, Emulsions eb, ec, ed, ee, ef and eg were prepared.

Photographic Light-Sensitive Materials eB, de, eD, eE, eF, and eG were prepared from these emulsions in the same manner as in Example 1e, and then measured for Dmax and Dmin in the same manner as in Example 1e.

As shown in Table 2e, when the grain size is in the range of 0.1 to 0.40 μm, these photographic light-sensitive materials exhibited Dmin as low as 0.08 or less, even upon a high intensity exposure for $10^{-3}$ seconds or more.

TABLE 2e

| Photographic Light-Sensitive Material | Emulsion | Grain size | Dmax/Dmin | Exposure time (sec.) $10^0$ | $10^{-3}$ | $10^{-6}$ |
|---|---|---|---|---|---|---|
| eB | eb | 0.45 | Dmax | 3.2 | 3.0 | 2.8 |
| | | | Dmin | 0.06 | 0.42 | 0.78 |
| eC | ec | 0.40 | Dmax | 4.3 | 4.3 | 4.3 |
| | | | Dmin | 0.05 | 0.05 | 0.06 |
| eD | ed | 0.30 | Dmax | 4.9 | 4.9 | 4.9 |
| | | | Dmin | 0.04 | 0.04 | 0.04 |
| eE | ee | 0.15 | Dmax | 4.8 | 4.8 | 4.8 |
| | | | Dmin | 0.04 | 0.04 | 0.05 |
| eF | ef | 0.10 | Dmax | 4.7 | 4.7 | 4.7 |
| | | | Dmin | 0.05 | 0.06 | 0.06 |
| eG | eg | 0.08 | Dmax | 3.6 | 3.2 | 2.9 |
| | | | Dmin | 0.05 | 0.41 | 0.82 |

(Note: Photographic Light-Sensitive Materials eB and eG are comparative while the others are according to the present invention).

EXAMPLE 3e

Photographic Light-Sensitive Materials eA-1, eA-2, eA-3, eA-4, and eA-5 were prepared in the same manner as Photographic Light-Sensitive Material eA of Example 1e, except that the desensitizing Dye VI-9 was replaced by desensitizing Dyes VI-3, VI-10, VI-11, VI-13, and V-15 as set forth in Table 3e, respectively.

These photographic light-sensitive materials were processed in the same manner as in Example 1e, and then measured for Dmax and Dmin. As shown in Table 3e, these photographic light-sensitive materials exhibited Dmin as low as 0.08 or less, even upon a high intensity exposure for $10^{-3}$ seconds or more.

TABLE 3e

| Photographic Light-Sensitive Material | Desensitizing Dye | Added amount (mg/m²) | Dmax/Dmin | Exposure time (sec.) $10^0$ | $10^{-3}$ | $10^{-6}$ |
|---|---|---|---|---|---|---|
| eA-1 | VI-3 | 15 | Dmax | 4.9 | 4.9 | 4.9 |
| | | | Dmin | 0.04 | 0.04 | 0.04 |
| eA-2 | VI-10 | 20 | Dmax | 4.8 | 4.8 | 4.8 |
| | | | Dmin | 0.04 | 0.04 | 0.04 |
| eA-3 | VI-11 | 15 | Dmax | 4.9 | 4.9 | 4.9 |
| | | | Dmin | 0.05 | 0.05 | 0.06 |
| eA-4 | VI-13 | 20 | Dmax | 4.8 | 4.8 | 4.8 |
| | | | Dmin | 0.04 | 0.05 | 0.06 |
| eA-5 | VI-15 | 25 | Dmax | 4.7 | 4.7 | 4.7 |
| | | | Dmin | 0.04 | 0.05 | 0.05 |

(Note: All the specimens are according to the present invention).

EXAMPLE 4e

Ten kinds of emulsions of cubic silver bromochloride grains having a grain size of 0.24 μm were prepared in the same manner as in Emulsion aa of Example 1a, except that the halogen composition of the halogen solution was altered as set forth in Table 4e and the amount of thioether and the time at which thioether was added were altered.

The emulsions thus obtained were then subjected to desalting by a flocculation process. To the emulsions were then added gelatin. The emulsions were then kept at a temperature of 63° C. and a pH value of 5.8. The emulsions were then ripened with formamidinesulfinic acid and tetrachloroauric acid. The emulsions were then cooled with the pH value thereof being kept at 6.5. Thus, Emulsions eh, ei, ej, ek, el, em, en, eo, ep, and eq were prepared.

Photographic Light-Sensitive Materials eH, eI, eJ, eK, eL, eM, eN, eO, eP, and eQ were prepared from these emulsions, exposed to light, developed, and then measured for Dmax and Dmin in the same manner as the Photographic Light-Sensitive Material eA of Example 1e.

As shown in Table 4e, the silver bromochloride emulsion having Br content of 5 mol % or more exhibit Dmin as low as 0.08 or less, even in a high intensity exposure for $10^{-3}$ seconds or more.

TABLE 4e

| Photographic Light-Sensitive Material | Emulsion | Halogen composition | Dmax/Dmin | Exposure time (sec.) $10^0$ | $10^{-3}$ | $10^{-6}$ |
|---|---|---|---|---|---|---|
| eH | eh | $AgBr_{95}Cl_5$ | Dmax | 4.9 | 4.9 | 4.9 |
| | | | Dmin | 0.04 | 0.04 | 0.04 |
| eI | ei | $AgBr_{90}Cl_{10}$ | Dmax | 4.9 | 4.9 | 4.9 |
| | | | Dmin | 0.04 | 0.04 | 0.04 |
| eJ | ej | $AgBr_{80}Cl_{20}$ | Dmax | 4.9 | 4.9 | 4.9 |
| | | | Dmin | 0.04 | 0.04 | 0.05 |
| eK | ek | $AgBr_{70}Cl_{30}$ | Dmax | 4.8 | 4.8 | 4.8 |
| | | | Dmin | 0.04 | 0.04 | 0.05 |
| eL | el | $AgBr_{50}Cl_{50}$ | Dmax | 4.8 | 4.8 | 4.8 |
| | | | Dmin | 0.04 | 0.04 | 0.05 |
| eM | em | $AgBr_{30}Cl_{70}$ | Dmax | 4.75 | 4.75 | 4.75 |
| | | | Dmin | 0.05 | 0.05 | 0.06 |
| eN | en | $AgBr_{20}Cl_{80}$ | Dmax | 4.75 | 4.75 | 4.75 |
| | | | Dmin | 0.05 | 0.05 | 0.07 |
| eO | e0 | $AgBr_{10}Cl_{90}$ | Dmax | 4.7 | 4.7 | 4.7 |
| | | | Dmin | 0.06 | 0.06 | 0.08 |

TABLE 4e-continued

| Photographic Light-Sensitive Material | Emulsion | Halogen composition | Dmax/Dmin | Exposure time (sec.) $10^0$ | $10^{-3}$ | $10^{-6}$ |
|---|---|---|---|---|---|---|
| eP | ep | $AgBr_5Cl_{95}$ | Dmax | 4.7 | 4.7 | 4.7 |
| | | | Dmin | 0.06 | 0.06 | 0.06 |
| eQ | eq | $AgCl_{100}$ | Dmax | 3.9 | 3.9 | 3.9 |
| | | | Dmin | 3.5 | 3.8 | 3.9 |

(Note: Specimens eH to eP are according to the present invention while Specimen eQ is comparative).

EXAMPLE 1f

To Emulsion aa prepared in Example 1a was then added Compound VII-2 as a desensitizing dye in an amount of 20 mg/m². The emulsion was then coated on a polyethylene terephthalate film in such an amount that the coated amount of silver reached 3.0 g/m². As a protective layer, a solution containing 1.2 g/m² of gelatin, 20 mg/m² of an amorphous $SiO_2$ matting agent having an average grain size of 3 μm, 0.1 g/m² of methanol silica, a fluorine surface active agent ($C_8F_{17}SO_2N(C_3H_7)CH_2COOK$) and sodium dodecylbenzenesulfonate as coating aids, and a KBr solution for adjusting the pAg value of the film were simultaneously coated on the silver halide emulsion layer. Thus, Photographic Light-Sensitive Material fA was prepared.

The photographic light-sensitive material thus obtained was subjected to sensitometry exposure through a 780 nm interference filter and a step wedge having a density difference (ΔD) of 0.1 by means of an Xe sensitometer for $10^0$, $10^{-3}$, $10^{-4}$ and $10^{-6}$ seconds, processed with the foregoing Developer A and Fixing Solution B at a temperature of 38° C. by means of an automatic developing machine FG660F available from Fuji Photo Film Co., Ltd. for 20 seconds, and then measured for Dmax and Dmin. The results are set forth in Table 1f.

As shown in Table 1f, the photographic light-sensitive material exhibits a Dmin, even in a high intensity exposure (for $10^{-3}$ seconds or more).

TABLE 1f

| Exposure time (sec.) | Dmax | Dmin |
|---|---|---|
| $10^0$ | 5.1 | 0.04 |
| $10^{-3}$ | 5.1 | 0.04 |
| $10^{-4}$ | 5.1 | 0.04 |
| $10^{-6}$ | 5.1 | 0.04 |

EXAMPLE 2f

Monodisperse emulsions of cubic silver bromide grains having different grain sizes as set forth in Table 2f were prepared in the same manner as in Emulsion aa of Example 1a except that the temperature at which grains were formed or the amount of thioether were altered.

The emulsions thus obtained were then subjected to desalting by a flocculation process. To the emulsions were then added gelatin. The emulsions were then kept at a temperature of 65° C. and a pH value of 6.0. The emulsions were then ripened with formamidinesulfinic acid and tetrachloroauric acid. The emulsions were then cooled with the pH value thereof being kept at 6.5. Thus, Emulsions fb, fc, fd, re, ff and fg were prepared.

Photographic Light-Sensitive Materials fB, fe, fD, fE, fF, and fG were prepared from these emulsions in the same manner as in Example 1f, and then measured for Dmax and Dmin in the same manner as in Example 1f. The results are set forth in Table 2f.

As shown in Table 2f, when the grain size is in the range of 0.1 to 0.40 μm, these photographic light-sensitive materials exhibit Dmin as low as 0.08 or less even upon a high intensity exposure for $10^{-3}$ seconds or more.

TABLE 2f

| Photographic Light-Sensitive Material | Emulsion | Grain size | Dmax/ Dmin | Exposure time (sec.) $10^0$ | $10^{-3}$ | $10^{-6}$ |
|---|---|---|---|---|---|---|
| fB | fb | 0.45 | Dmax | 3.5 | 3.30 | 3.10 |
| | | | Dmin | 0.06 | 0.45 | 0.78 |
| fC | fc | 0.40 | Dmax | 4.6 | 4.6 | 4.6 |
| | | | Dmin | 0.05 | 0.05 | 0.06 |
| fD | fd | 0.30 | Dmax | 5.1 | 5.1 | 5.1 |
| | | | Dmin | 0.04 | 0.04 | 0.04 |
| fE | fe | 0.15 | Dmax | 5.1 | 5.1 | 5.1 |
| | | | Dmin | 0.04 | 0.04 | 0.05 |
| fF | ff | 0.10 | Dmax | 4.9 | 4.9 | 4.9 |
| | | | Dmin | 0.05 | 0.06 | 0.06 |
| fG | fg | 0.08 | Dmax | 3.9 | 3.7 | 3.5 |
| | | | Dmin | 0.05 | 0.36 | 0.85 |

(Note: Photographic Light-Sensitive Materials fB and fG are comparative while the others are according to the present invention).

EXAMPLE 3f

Photographic Light-Sensitive Materials fA-1, fA-2, fA-3, fA-4, and fA-5 were prepared in the same manner as photographic light-sensitive material fA of Example 1f, except that the desensitizing Dye VII-2 was replaced by desensitizing Dyes VII-3, VII-18, VII-27, VII-29, and VII-30 as set forth in Table 3f, respectively.

These photographic light-sensitive materials were processed in the same manner as in Example 1f, and then measured for Dmax and Dmin. The results are set forth in Table 3f.

As shown in Table 3f, these photographic light-sensitive materials exhibit Dmin as low as 0.06 or less, even upon a high intensity exposure for $10^{-3}$ seconds or more.

TABLE 3f

| Photographic Light-Sensitive Material | Desensitizing Dye | Added amount ($mg/m^2$) | Dmax/ Dmin | Exposure time (sec.) $10^0$ | $10^{-3}$ | $10^{-6}$ |
|---|---|---|---|---|---|---|
| fA-1 | VII-3 | 20 | Dmax | 5.1 | 5.1 | 5.1 |
| | | | Dmin | 0.04 | 0.04 | 0.04 |
| fA-2 | VII-18 | 15 | Dmax | 4.8 | 4.8 | 4.8 |
| | | | Dmin | 0.04 | 0.04 | 0.04 |
| fA-3 | VII-27 | 20 | Dmax | 5.0 | 5.0 | 5.0 |
| | | | Dmin | 0.05 | 0.05 | 0.06 |
| fA-4 | VII-29 | 20 | Dmax | 4.9 | 4.9 | 4.9 |
| | | | Dmin | 0.04 | 0.05 | 0.06 |
| fA-5 | VII-30 | 20 | Dmax | 4.8 | 4.8 | 4.8 |
| | | | Dmin | 0.04 | 0.05 | 0.05 |

(Note: All the specimens are according to the present invention).

EXAMPLE 4f

Ten kinds of emulsions of cubic silver bromochloride grains having a grain size of 0.24 μm were prepared in the same manner as in Emulsion aa of Example 1a, except that the halogen composition of the halogen solution was altered as set forth in Table 4f and the amount of thioether and the time at which thioether was added were altered.

The emulsions thus obtained were then subjected to desalting by a flocculation process. To the emulsions were then added gelatin. The emulsions were then kept at a temperature of 63° C. and a pH value of 5.8. The emulsions were then ripened with formamidinesulfinic acid and tetrachloroauric acid. The emulsions were then cooled with the pH value thereof being kept at 6.5. Thus, Emulsions fh, fi, fj, fk, fl, fm, fn, fo, fp, and fq were prepared.

Photographic Light-Sensitive Materials fH, fI, fJ, fK, fL, fM, fN, fO, fP, and fQ were prepared from these emulsions, exposed to light, developed, and then measured for Dmax and Dmin in the same manner as Photographic Light-Sensitive Material fA of Example 1f.

As shown in Table 4f, the silver bromochloride emulsion having Br content of 5 mol % or more exhibit Dmin as low as 0.08 or less, even in a high intensity exposure for $10^{-3}$ seconds or more.

TABLE 4f

| Photographic Light-Sensitive Material | Emulsion | Halogen composition | Dmax/ Dmin | Exposure time (sec.) $10^0$ | $10^{-3}$ | $10^{-6}$ |
|---|---|---|---|---|---|---|
| fH | fh | $AgBr_{95}Cl_5$ | Dmax | 5.1 | 5.1 | 5.1 |
| | | | Dmin | 0.04 | 0.04 | 0.04 |
| fI | fi | $AgBr_{90}Cl_{10}$ | Dmax | 5.0 | 5.0 | 5.0 |
| | | | Dmin | 0.04 | 0.04 | 0.04 |
| fJ | fj | $AgBr_{80}Cl_{20}$ | Dmax | 5.1 | 5.1 | 5.1 |
| | | | Dmin | 0.04 | 0.04 | 0.05 |
| fK | fk | $AgBr_{70}Cl_{30}$ | Dmax | 5.0 | 5.0 | 5.0 |
| | | | Dmin | 0.04 | 0.04 | 0.05 |
| fL | fl | $AgBr_{50}Cl_{50}$ | Dmax | 4.9 | 4.9 | 4.9 |
| | | | Dmin | 0.04 | 0.04 | 0.05 |
| fM | fm | $AgBr_{30}Cl_{70}$ | Dmax | 4.9 | 4.9 | 4.9 |
| | | | Dmin | 0.05 | 0.05 | 0.06 |
| fN | fn | $AgBr_{20}Cl_{80}$ | Dmax | 4.90 | 4.90 | 4.90 |
| | | | Dmin | 0.05 | 0.05 | 0.07 |
| fO | f0 | $AgBr_{10}Cl_{90}$ | Dmax | 4.85 | 4.86 | 4.84 |
| | | | Dmin | 0.06 | 0.06 | 0.08 |
| fP | fp | $AgBr_5Cl_{95}$ | Dmax | 4.81 | 4.83 | 4.82 |
| | | | Dmin | 0.06 | 0.06 | 0.08 |
| fQ | fq | $AgCl_{100}$ | Dmax | 4.0 | 4.0 | 4.0 |
| | | | Dmin | 3.5 | 3.8 | 4.0 |

(Note: Specimens fH to fP are according to the present invention while Specimen fQ is comparative).

EXAMPLE 1g

To Emulsion aa prepared in Example 1a was then added Compound VIII-8 as a desensitizing dye in an amount of 15 $mg/m^2$. The emulsion was then coated on a polyethylene terephthalate film in such an amount that the coated amount of silver reached 3.0 $g/m^2$. As a protective layer, a solution containing 1.2 $g/m^2$ of gelatin, 20 $mg/m^2$ of an amorphous $SiO_2$ matting agent having an average grain size of 3 μm, 0.1 $g/m^2$ of methanol silica, a fluorine surface active agent ($C_8F_{17}SO_2N(C_3H_7)CH_2COOK$) and sodium dodecylbenzenesulfonate as coating aids, and a KBr solution for adjusting the pAg value of the film were simultaneously coated on the silver halide emulsion layer. Thus, Photographic Light-Sensitive Material gA was prepared.

The photographic light-sensitive material thus obtained was subjected to sensitometry exposure through a 633 nm interference filter and a step wedge having a density difference (ΔD) of 0.1 by means of an Xe sensitometer for $10^0$, $10^{-3}$, $10^{-4}$ and $10^{-6}$ seconds, processed with the foregoing developer A and fixing solution B at a temperature of 38° C. by means of an automatic developing machine FG660F available from Fuji Photo Film Co., Ltd. for 20 seconds, and then measured for Dmax and Dmin. As shown in Table 1g, the photographic light-sensitive material exhibited a Dmin, even in a high intensity exposure (for $10^{-3}$ seconds or more).

TABLE 1g

| Exposure time (sec.) | Dmax | Dmin |
|---|---|---|
| $10^0$ | 4.75 | 0.04 |
| $10^{-3}$ | 4.75 | 0.04 |
| $10^{-4}$ | 4.75 | 0.04 |
| $10^{-6}$ | 4.75 | 0.04 |

EXAMPLE 2g

Monodisperse emulsions of cubic silver bromide grains having different grain sizes as set forth in Table 2 g were prepared in the same manner as in Emulsion aa of Example 1a, except that the temperature at which grains were formed or the amount of thioether were altered.

The emulsions thus obtained were then subjected to desalting by a flocculation process. To the emulsions were then added gelatin. The emulsions were then kept at a temperature of 65° C. and a pH value of 6.0. The emulsions were then ripened with formamidinesulfinic acid and tetrachloroauric acid. The emulsions were then cooled with the pH value thereof being kept at 6.5. Thus, Emulsions gb, gc, gd, ge, gf and gg were prepared.

Photographic Light-Sensitive Materials gB, ge, gD, gE, gF, and gG were prepared from these emulsions in the same manner as in Example 1g, and then measured for Dmax and Dmin in the same manner as in Example 1g. As shown in Table 2 g, when the grain size is in the range of 0.1 to 0.40 μm, these photographic light-sensitive materials exhibited Dmin as low as 0.06 or less, even upon a high intensity exposure for $10^{-3}$ seconds or more.

TABLE 2g

| Photographic Light-Sensitive Material | Emulsion | Grain size | Dmax/ Dmin | Exposure time (sec.) $10^0$ | $10^{-3}$ | $10^{-6}$ |
|---|---|---|---|---|---|---|
| gB | gb | 0.45 | Dmax | 3.4 | 3.2 | 3.2 |
| | | | Dmin | 0.06 | 0.32 | 0.65 |
| gC | gc | 0.40 | Dmax | 4.6 | 4.6 | 4.6 |
| | | | Dmin | 0.05 | 0.05 | 0.06 |
| gD | gd | 0.30 | Dmax | 4.7 | 4.7 | 4.7 |
| | | | Dmin | 0.04 | 0.04 | 0.04 |
| gE | ge | 0.15 | Dmax | 4.7 | 4.7 | 4.7 |
| | | | Dmin | 0.04 | 0.04 | 0.05 |
| gF | gf | 0.10 | Dmax | 4.6 | 4.6 | 4.6 |
| | | | Dmin | 0.05 | 0.06 | 0.06 |
| gG | gg | 0.08 | Dmax | 3.8 | 3.8 | 3.8 |
| | | | Dmin | 0.05 | 0.33 | 0.82 |

(Note: Photographic Light-Sensitive materials gB and gG are comparative while the others are according to the present invention).

EXAMPLE 3g

Photographic Light-Sensitive Materials gA-1, gA-2 , gA-3, gA-4, and gA-5 were prepared in the same manner as Photographic Light-Sensitive Material gA of Example 1g, except that the desensitizing Dye VIII-8 was replaced by desensitizing Dyes VIII-10, VIII-11, VIII-13, VIII-16, and VIII-18 as set forth in Table 3g, respectively.

These photographic light-sensitive materials were processed in the same manner as in Example 1g, and then measured for Dmax and Dmin. The results are set forth in Table 3g.

As shown in Table 3g, these photographic light-sensitive materials exhibit Dmin as low as 0.06 or less, even upon a high intensity exposure for $10^{-3}$ seconds or more.

TABLE 3g

| Photographic Light-Sensitive Material | Desensitizing Dye | Added amount (mg/m²) | Dmax/ Dmin | Exposure time (sec.) $10^0$ | $10^{-3}$ | $10^{-6}$ |
|---|---|---|---|---|---|---|
| gA-1 | VIII-10 | 15 | Dmax | 4.75 | 4.75 | 4.75 |
| | | | Dmin | 0.04 | 0.04 | 0.04 |
| gA-2 | VIII-11 | 20 | Dmax | 4.75 | 4.75 | 4.75 |
| | | | Dmin | 0.04 | 0.04 | 0.04 |
| gA-3 | VIII-13 | 15 | Dmax | 4.7 | 4.7 | 4.7 |
| | | | Dmin | 0.05 | 0.05 | 0.06 |
| gA-4 | VIII-16 | 20 | Dmax | 4.7 | 4.7 | 4.7 |
| | | | Dmin | 0.04 | 0.05 | 0.06 |
| gA-5 | VIII-18 | 25 | Dmax | 4.7 | 4.7 | 4.7 |
| | | | Dmin | 0.04 | 0.05 | 0.05 |

(Note: All the specimens are according to the present invention).

EXAMPLE 4g

Ten kinds of emulsions of cubic silver bromochloride grains having a grain size of 0.24 Nm were prepared in the same manner as in Emulsion aa of Example 1a, except that the halogen composition of the halogen solution was altered as set forth in Table 4g and the amount of thioether and the time at which thioether was added were altered.

The emulsions thus obtained were then subjected to desalting by a flocculation process. To the emulsions were then added gelatin. The emulsions were then kept at a temperature of 63° C. and a pH value of 5.8. The emulsions were then ripened with formamidinesulfinic acid and tetrachloroauric acid. The emulsions were then cooled with the pH value thereof being kept at 6.5. Thus, Emulsions gh, gi, gj, gk, gl, gm, gn, go, gp, and gq were prepared.

Photographic Light-Sensitive Materials gH, gI, gJ, gK, gL, gM, gN, gO, gP, and gQ were prepared from these emulsions, exposed to light, developed, and then measured for Dmax and Dmin in the same manner as the photographic light-sensitive material gA of Example 1g.

As shown in Table 4g, the silver bromochloride emulsion having Br content of 5 mol % or more exhibit Dmin as low as 0.08 or less, even in a high intensity exposure for $10^{-3}$ seconds or more.

TABLE 4g

| Photographic Light-Sensitive Material | Emulsion | Halogen composition | Dmax/ Dmin | Exposure time (sec.) $10^0$ | $10^{-3}$ | $10^{-6}$ |
|---|---|---|---|---|---|---|
| gH | gh | $AgBr_{95}Cl_5$ | Dmax | 4.75 | 4.75 | 4.75 |
| | | | Dmin | 0.04 | 0.04 | 0.04 |
| gI | gi | $AgBr_{90}Cl_{10}$ | Dmax | 4.75 | 4.75 | 4.75 |
| | | | Dmin | 0.04 | 0.04 | 0.04 |
| gJ | gj | $AgBr_{80}Cl_{20}$ | Dmax | 4.75 | 4.75 | 4.75 |
| | | | Dmin | 0.04 | 0.04 | 0.05 |
| gK | gk | $AgBr_{70}Cl_{30}$ | Dmax | 4.7 | 4.7 | 4.7 |
| | | | Dmin | 0.04 | 0.04 | 0.05 |

TABLE 4q-continued

| Photographic Light-Sensitive Material | Emulsion | Halogen composition | Dmax/Dmin | Exposure time (sec.) $10^0$ | $10^{-3}$ | $10^{-6}$ |
|---|---|---|---|---|---|---|
| gL | gl | $AgBr_{50}Cl_{50}$ | Dmax | 4.7 | 4.7 | 4.7 |
| | | | Dmin | 0.04 | 0.04 | 0.05 |
| gM | gm | $AgBr_{30}Cl_{70}$ | Dmax | 4.7 | 4.7 | 4.7 |
| | | | Dmin | 0.05 | 0.05 | 0.06 |
| gN | gn | $AgBr_{20}Cl_{80}$ | Dmax | 4.7 | 4.7 | 4.7 |
| | | | Dmin | 0.05 | 0.05 | 0.07 |
| gO | f0 | $AgBr_{10}Cl_{90}$ | Dmax | 4.6 | 4.6 | 4.6 |
| | | | Dmin | 0.06 | 0.06 | 0.08 |
| gP | gp | $AgBr_5Cl_{95}$ | Dmax | 4.6 | 4.6 | 4.6 |
| | | | Dmin | 0.06 | 0.06 | 0.08 |
| gQ | gq | $AgCl_{100}$ | Dmax | 4.0 | 4.0 | 4.0 |
| | | | Dmin | 3.5 | 3.8 | 4.0 |

(Note: Specimens gH to gP are according to the Present invention while Specimen gQ is comparative).

While the invention has been described in detail and with reference to specific embodiments thereof, it will be apparent to one skilled in the art that various changes and modifications can be made therein without departing from the spirit and scope thereof.

What is claimed is:

1. A pre-fogged direct reversal silver halide photographic material comprising on a support at least an emulsion layer comprising a previously fogged silver halide emulsion for forming a direct positive image, wherein said emulsion layer comprises at least one compound represented by one of the following general formula (II), (V) or (VIII):

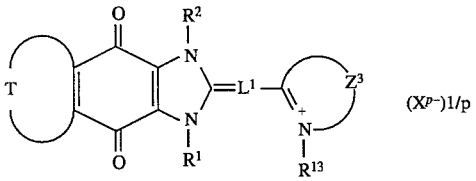

(II)

wherein T represents an atomic group necessary for the formation of a benzene ring; $R^1$, $R^2$ and $R^3$ each represents an alkyl, aralkyl, phenyl or allyl group; $L^1$ represents a trivalent connecting group in which 1, 3, 5 or 7 methine groups are connected to form conjugated double bonds; $Z^3$ represents an atomic group necessary for the formation of a 5- or 6-membered ring; X represents an anion; and p represents an integer 1 or 2;

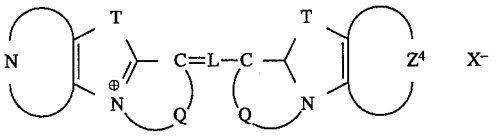

(V)

wherein $Z^4$ represents an atomic group necessary for the formation of a benzene ring, naphthalene ring or heterocyclic aromatic ring; T represents O, S, Se, N—$R^1$, $CR^2R^3$ or —$CR^4$=$CR^5$—; $R^1$, $R^2$ and $R^3$ each independently represents an alkyl group, alkenyl group or aryl group; $R^4$ and $R^5$ each independently represents a hydrogen atom, halogen atom, alkyl group, aryl group, alkoxy group, aryloxy group, carboxyl group, acyl group, acylamino group, carbamoyl group, sulfamoyl group or sulfonamido group; Q is an ethylene group, propylene group, butylene group, or group formed by replacing one or more hydrogen atoms in these groups by a fluorine atom, a chlorine atom or a $C_{1-4}$ alkyl group; L represents a trivalent group in which 5 or 7 methine groups are connected to form conjugated double bonds; and X- represents an anion;

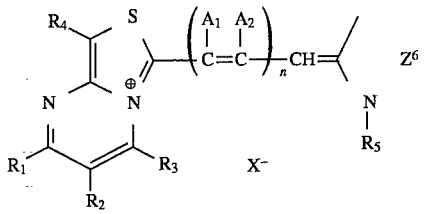

(VIII)

wherein $A_1$ and $A_2$ each independently represents a hydrogen atom a halogen atom, an alkoxy group, an aryloxy group, a cyano group, an alkyl group, an aryl group, or an aralkyl group; $Z^6$ represents an atomic group necessary for the formation of a 5-membered heterocyclic group; $R_1$ to $R_4$ each independently represents a hydrogen atom a $C_{1-20}$ alkyl group, a $C_{6-20}$ phenyl group or a $C_{7-20}$ benzyl group; $R_5$ represents a $C_{1-20}$ alkyl group, a $C_{6-20}$ phenyl group, a $C_{7-20}$ aralkyl group or may form a 6-membered heterocyclic group with $Z^6$; n represents an integer 0, 1 or 2; and $X^-$ represents an anion.

2. The pre-fogged direct reversal silver halide photographic material as in claim 1, wherein said emulsion layer comprises a compound according to formula (II).

3. The pre-fogged direct reversal silver halide photographic material as in claim 1, wherein said emulsion layer comprises a compound according to formula (V).

4. The pre-fogged direct reversal silver halide photographic material as in claim 1, wherein said emulsion layer comprises a compound according to formula (VIII).

5. The pre-fogged direct reversal silver halide photographic material as in claim 1, wherein the emulsion layer contains silver halide grains having a grain size of 0.10–0.40 μm.

* * * * *